US005118597A

United States Patent [19]

Mihayashi et al.

[11] Patent Number: 5,118,597

[45] Date of Patent: Jun. 2, 1992

[54] SILVER HALIDE COLOR PHOTOGRAPHIC MATERIAL CONTAINING AT LEAST ONE MONODISPERSED EMULSION HAVING A SPECIFIED PARTICLE SIZE DISTRIBUTION

[75] Inventors: Keiji Mihayashi; Mamoru Tashiro; Kohzaburoh Yamada, all of Kanagawa, Japan

[73] Assignee: Fuji Photo Film Co., Ltd., Kanagawa, Japan

[21] Appl. No.: 609,034

[22] Filed: Nov. 7, 1990

Related U.S. Application Data

[63] Continuation of Ser. No. 75,010, Jul. 17, 1987, abandoned.

[30] Foreign Application Priority Data

Jul. 17, 1986 [JP] Japan ..... 61-168938

[51] Int. Cl.[5] ..... G03C 1/08

[52] U.S. Cl. ..... 430/544; 430/567; 430/957

[58] Field of Search ..... 430/544, 567, 957

[56] References Cited

U.S. PATENT DOCUMENTS

| | | | |
|---|---|---|---|
| 4,421,845 | 12/1983 | Uemura et al. | 430/553 |
| 4,444,877 | 4/1984 | Koitabashi et al. | 430/567 |
| 4,461,826 | 7/1984 | Yamashita et al. | 430/544 |
| 4,477,563 | 10/1984 | Ichijima et al. | 430/553 |
| 4,511,648 | 4/1985 | Yamashita et al. | 430/503 |
| 4,547,458 | 10/1985 | Iijima et al. | 430/458 |
| 4,618,571 | 10/1986 | Ichijima et al. | 430/553 |
| 4,640,889 | 2/1987 | Komorita et al. | 430/567 |
| 4,737,451 | 4/1988 | Ichijima et al. | 430/544 |
| 4,770,982 | 9/1988 | Ichijima et al. | 430/505 |
| 4,818,664 | 4/1989 | Ueda et al. | 430/430 |

FOREIGN PATENT DOCUMENTS 2024252 2/1987 Japan .

*Primary Examiner*—Richard L. Schilling
*Assistant Examiner*—Janet C. Baxter
*Attorney, Agent, or Firm*—Sughrue, Mion, Zinn Macpeak & Seas

[57] ABSTRACT

A silver halide color photographic material comprising a support having thereon at least one light-sensitive silver halide emulsion layer, wherein the light-sensitive silver halide emulsion layer contains at least one monodispersed emulsion having a particle size distribution such that a coefficient of variation with respect to a particle diameter of silver halide grains, $S/\bar{r}$ (wherein S represents a standard deviation regarding to a particle diameter and $\bar{r}$ represents an average particle diameter) is not more than about 0.25, and the silver halide color photographic material contains at least one primary compound capable of releasing, upon a reaction with an oxidation product of a developing agent, a secondary compound which is capable of further releasing a development inhibitor upon a reaction with another molecule of an oxidation product of a developing agent.

The silver halide color photographic material is excellent in sharpnes, graininess and color reproducibility and has a broad exposure latitude.

17 Claims, 1 Drawing Sheet

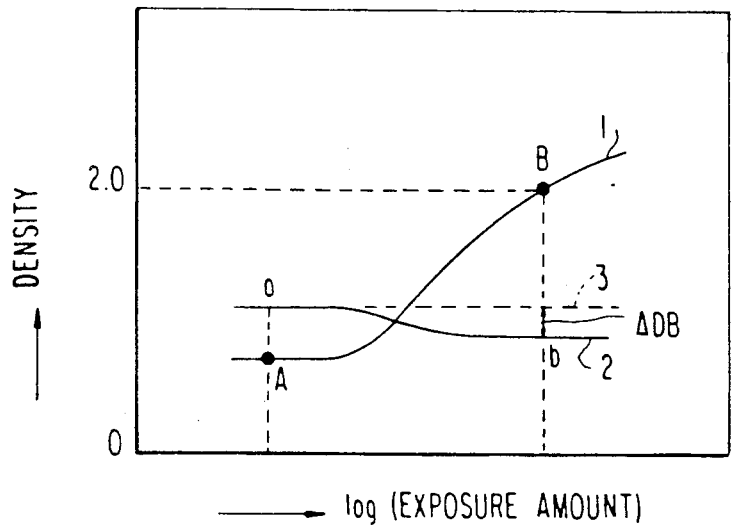
1 : CHARACTERISTIC CURVE OF A MAGENTA COLOR IMAGE IN A GREEN-SENSITIVE LAYER.
2 : DENSITY CURVE OF A YELLOW COLOR IMAGE IN A BLUE-SENSITIVE LAYER OBTAINED BY UNIFORM EXPOSURE TO BLUE LIGHT.
3 : THEORITICAL YELLOW DENSITY CURVE IN A BLUE-SENSITIVE LAYER DUE TO UNIFORM EXPOSURE TO BLUE LIGHT.

SILVER HALIDE COLOR PHOTOGRAPHIC MATERIAL CONTAINING AT LEAST ONE MONODISPERSED EMULSION HAVING A SPECIFIED PARTICLE SIZE DISTRIBUTION

This is a continuation of application Ser. No. 07/075,010, filed Jul. 17, 1987, now abandoned.

FIELD OF THE INVENTION

The present invention relates to a silver halide color photographic material and, more particularly, to a silver halide color photographic material for photography which is excellent in sharpness, graininess and color reproducibility and has a broad exposure latitude.

BACKGROUND OF THE INVENTION

Recently, in the field of silver halide color photographic materials, particularly those used for photography, those having super high sensitivity (as typically illustrated by ISO 1,600 films, etc.), or those having excellent image quality, particularly graininess, suitable for use in small format cameras (as typically illustrated by 110 sized cameras or disc cameras) and capable of providing satisfactory prints by high magnification of enlargement, have been keenly desired.

One technique for improving graininess is the use of a monodispersed silver halide emulsion, as described in Japanese Patent Application (OPI) Nos. 14829/83, 28743/83 (corresponding to U.S. Pat. No. 4,446,226) and 100846/83(corresponding to U.S. Pat. No. 4,511,648), etc. (the term "OPI" as used herein means an "unexamined published application"). However, this method has some problems, namely, that an exposure latitude is narrow and that graininess is inferior in an area of high exposure amount. Further, color reproducibility is also not good when using only a monodispersed emulsion.

In order to eliminate these problems, a method wherein a monodispersed emulsion is employed together with a DIR compound capable of releasing a diffusible development inhibiting substance is proposed in Japanese Patent Application (OPI) No. 100847/83 (corresponding to U.S. Pat. No. 4,446,226). According to this method, color reproducibility is improved to some extent, and sharpness is also improved. Further, in Japanese Patent Application (OPI) No. 232544/85 (corresponding to European Patent 145,560A), a method wherein a monodispersed emulsion having a high silver iodidobromide content in the interior o silver halide grains is used together with a DIR compound having a relatively high degree of development inhibiting ability is proposed. This method can provide improved graininess and sharpness.

It is also known that DIR compounds as described in U.S. Pat. Nos. 3,227,554, 3,701,783, 3,703,375, 4,052,213, 4,138,258, 4,146,396 and 4,477,563, etc., or DIR compounds having a timing group as described in U.S. Pat. Nos. 4,248,962 and 4,421,845, are added to photographic light-sensitive materials in order to improve sharpness, color reproducibility and graininess. Further, the compounds as described in Japanese Patent Application (OPI) Nos. 185950/85 (corresponding to U.S. Pat. No. 4,618,571) and 56837/82, etc. are proposed for the purpose of improving the above-described photographic properties. However, the effects on the improvement of these properties are still not sufficient when these compounds described above are employed.

SUMMARY OF THE INVENTION

Therefore, an object of the present invention is to provide a silver halide color photographic material which is excellent in sharpness.

Another object of the present invention is to provide a silver halide color photographic material which is excellent in graininess.

A further object of the present invention is to provide a silver halide color photographic material having improved color reproducibility.

These and other objects of the present invention will become apparent from the following detailed description of the invention and illustrative examples.

These objects of the present invention are accomplished by a silver halide color photographic material comprising a support having thereon at least one light-sensitive silver halide emulsion layer, wherein the light-sensitive silver halide emulsion layer contains at least one monodispersed emulsion having a particle size distribution such a coefficient of variation with respect to a particle diameter of silver halide grains, $S/\bar{r}$ (wherein S represents a standard deviation with respect to a particle diameter and $\bar{r}$ represents an average particle diameter) is not more than about 0.25, and the silver halide color photographic material contains at least one primary compound capable of releasing, upon a reaction with an oxidation product of a developing agent, a secondary compound which is capable of further releasing a development inhibitor upon a reaction with another molecule of an oxidation product of a developing agent.

BRIEF DESCRIPTION OF THE ACCOMPANYING DRAWING

The drawing is a graph showing a characteristic curve of a magenta color image, wherein 1 represents a characteristic curve of a magenta color image in a green-sensitive layer, 2 represents a density curve of a yellow color image in a blue-sensitive layer obtained by uniform exposure to blue light, and 3 represents a theoretical yellow density curve of a blue-sensitive layer due to uniform exposure to blue light,

DETAILED DESCRIPTION OF THE INVENTION

The primary compound capable of releasing, upon a reaction with an oxidation product of a developing agent, a secondary compound which is capable of further releasing a development inhibitor upon a reaction with another molecule of an oxidation product of a developing agent used in the present invention can be represented by the following general formula (I):

$$A—PDI \qquad (I)$$

wherein A represents a group capable of releasing PDI upon a reaction with an oxidation product of a developing agent; and PDI represents a group capable of releasing a development inhibitor through a reaction with an oxidation product of a developing agent after being released from A.

The primary compounds represented by general formula (I) are described in detail below.

Of the primary compounds represented by the general formula (I) according to the present invention, preferred compounds are represented by the following general formula (II):

$$A\text{-}(L_1)_v\text{—}B\text{-}(L_2)_w\text{—}DI \qquad (II)$$

wherein A represents a group capable of releasing $(L_1)_v$—B—$(L_2)_w$—DI reaction with oxidation product of a developing agent; $L_1$ represents a group capable of releasing B—$(L_2)_w$—DI after being released from A; B represents a group capable of releasing $(L_2)_w$—DI upon a reaction with an oxidation product of a developing agent after being released from A—$(L_1)_v$; $L_2$ represents a group capable of releasing DI after being released from B; DI represents a development inhibitor; and v and w each represents 0 or 1.

The reaction process during which the compound represented by general formula (II) releases DI at the time of development can be represented by the following schematic formulae:

$$A\text{-}(L_1)_v\text{-}B\text{-}(L_2)_w\text{-}DI \xrightarrow{T^{\oplus}} (L_1)_v\text{-}B\text{-}(L_2)_w\text{-}DI \longrightarrow$$

$$B\text{-}(L_2)_w\text{-}DI \xrightarrow{T^{\oplus}} (L_2)_w\text{-}DI \longrightarrow DI$$

wherein A, $L_1$, B, $L_2$, DI, v and w each has the same meaning as defined in general formula (II) above; and $T^{\oplus}$ represents an oxidation product of a developing agent.

In the above-described reaction schematic formulae, the excellent effects able to be attained according to the present invention are characterized by the reaction of forming $(L_2)_w$—DI from B—$(L_2)_w$—DI. Specifically, this reaction is a second order reaction between $T^{\oplus}$ and B—$(L_2)_w$—DI, and the rate of reaction depends on a concentration of each reactant. Therefore, B—$(L_2)_w$—DI immediately releases $(L_2)_w$—DI in a region where $T^{\oplus}$'s are generated in a large amount. In contrast therewith, in a region where are $T^{\oplus}$'s are generated only in a small amount, B—$(L_2)_w$—DI slowly releases $(L_2)_w$—DI. Such a reaction process coupled with the above-described reaction processes effectively reveals the function of DI as a development inhibitor.

The compound represented by general formula (II) is described in greater detail below.

In general formula (II), A specifically represents a coupler residue or an oxidation reduction group.

When A represents a coupler residue, any known coupler residue can be utilized. Suitable examples thereof include a yellow coupler residue (for example, an open-chain ketomethylene type coupler residue, etc.), a magenta coupler residue (for example, a 5-pyrazolone type coupler residue, a pyrazoloimidazole type coupler residue, a pyrazolotriazole type coupler residue, etc.), a cyan coupler residue (for example, a phenol type coupler residue, a naphthol type coupler residue, etc.), and a non-color forming coupler residue (for example, an indanone type coupler residue, an actophenone type coupler residue, etc.), etc. Further, the coupler residues as described in U.S. Pat. No. 4,315,070, 4,183,752, 4,171,223 and 4,226,934, etc. are also useful.

When A represents an oxidation reduction group, the compounds represented by general formula (II) is specifically represented by the following general formula (III):

$$A_1\text{—}P\text{—}(X{=}Y)_n\text{—}Q\text{—}A_2 \qquad (III)$$

wherein P and Q, which may be the same or different, each represents an oxygen atom or a substituted or unsubstituted imino group; at least one of X and Y represents a methine group having a group of —$(L_1)_v$—B—$(L_2)_w$—DI as a substituent, and the other of X and Y represent a substituted or unsubstituted methine group or a nitrogen atom; n represents an integer from 1 to 3, when n is 2 or 3, X and Y may be the same as or different from X and Y defined above; $A_1$ and $A_2$ which may be the same or different each represents a hydrogen atom or a group capable of being removed upon reaction with an alkali; and any two of substituents of P, X, Y, Q, $A_1$ and $A_2$ may be divalent groups and connected with each other to form a cyclic structure.

Examples of the cyclic structure include a benzene ring or a pyridine ring, etc. formed by $(X{=}Y)_n$.

In general formula (II), the groups represented by $L_1$ and $L_2$ may or may not be present depending on the desired purpose. Preferred examples of the groups represented by $L_1$ and $L_2$ include known linking groups described below.

(1) Groups utilizing a cleavage reaction of hemiacetal

Examples of these groups include those as described, for example, in U.S. Pat. No. 4,146,396, Japanese Patent Application (OPI) Nos. 249148/85 and 249149/85, etc., and are represented by the following general formula (T-1):

(T-1)

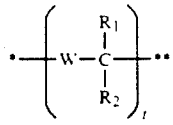

wherein a bond indicated by * denotes the position at which the group is connected to the left side group in general formula (II); a bond indicated by ** denotes the position at which the group is connected to the right side group in general formula (II); W represents an oxygen atom, a sulfur atom or a group of

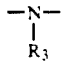

(wherein $R_3$ represents an organic substituent such as an alkyl, aryl or heterocyclic group); $R_1$ and $R_2$, which may be the same or different, each represents a hydrogen atom or a substituent such as an alkyl, aryl or heterocyclic group; t represents 1 or 2; when t represents 2, two $R_1$'s and two $R_2$'s may be the same or different; and any two of $R_1$, $R_2$ and $R_3$ may be connected to each other to form a cyclic structure.

Specific non-limitative examples of the groups represented by general formula (T-1) are set forth below.

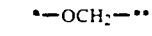
T-1-1

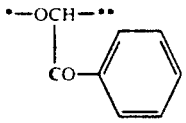
T-1-2

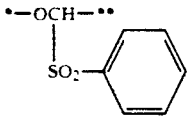
T-1-3

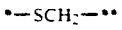
T-1-4

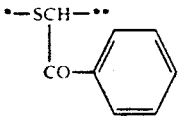
T-1-5

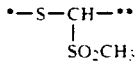
T-1-6

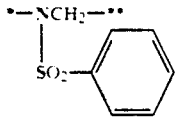
T-1-7

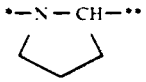
T-1-8

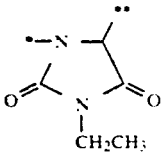
T-1-9

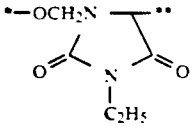
T-1-10

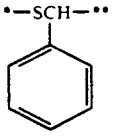
T-1-11

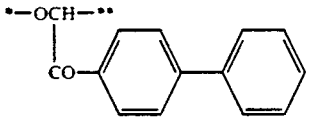
T-1-12

-continued

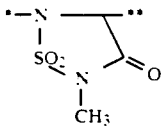
T-1-13

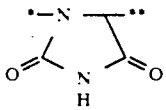
T-1-14

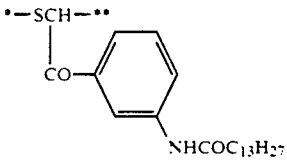
T-1-15

(2) A group causing a cleavage reaction utilizing an intramolecular nucleophilic displacement reaction Examples of these groups include the timing groups as described in U.S. Pat. No. 4,248,962, etc., and are represented by the following general formula (T-2):

$$*-Nu-Link-E-** \qquad (T\text{-}2)$$

wherein a bond indicated by * denotes the position at which the group is connected to the left side group in general formula (II); a bond indicated by  denotes the position at which the group is connected to the right side group in general formula (II); Nu represents a nucleophilic group including, e.g., an oxygen atom or a sulfur atom, etc.; E represents an electrophilic group which is able to cleave the bond indiated by  upon a nucleophilic attack of Nu; and Link represents a linking group which connects Nu with E in a stereochemical position capable of causing an intramolecular nucleophilic displacement reaction between Nu and E.

Specific non-limitative examples of the groups represented by general formula (T-2) are set forth below:

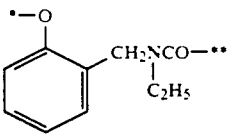
T-2-1

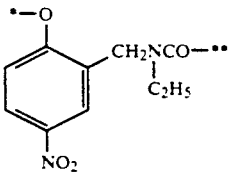
T-2-2

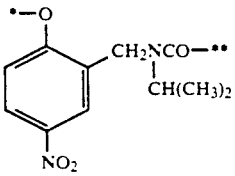
T-2-3

-continued

T-2-4

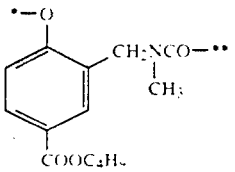

T-2-5

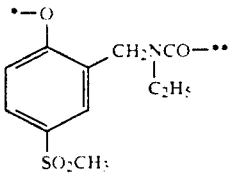

T-2-6

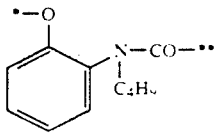

T-2-7

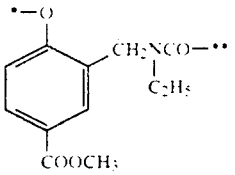

T-2-8

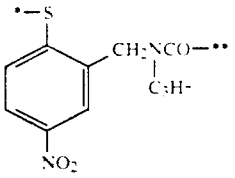

T-2-9

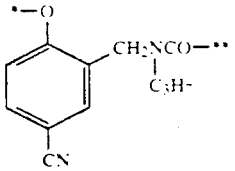

T-2-10

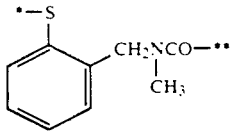

T-2-11

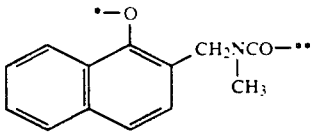

(3) A group causing a cleavage reaction utilizing an electron transfer reaction via a conjugated system Examples of these groups include those as described in U.S. Pat. Nos. 4,409,323 and 4,421,845, and are represented by the following general formula (T-3):

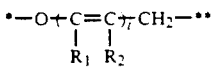

(T-3)

wherein a bond indicated by *, a bond indicated by II, $R_1$, $R_2$ and t each has the same meaning as defined in general formula (T-1) above.

Specific non-limitative examples of the groups represented by general formula (T-3) are set forth below:

T-3-1

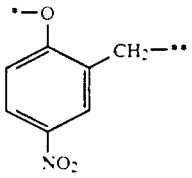

T-3-2

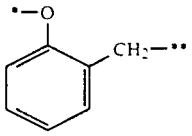

T-3-3

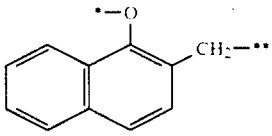

T-3-4

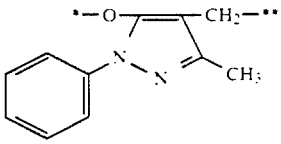

T-3-5

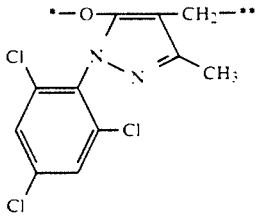

T-3-6

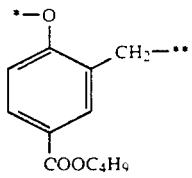

T-3-7

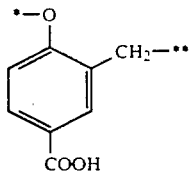

T-3-8

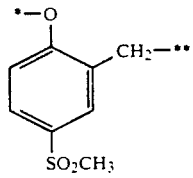

-continued

T-3-9

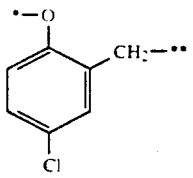

T-3-10

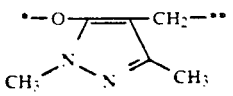

(4) A group utilizing a cleavage reaction of an ester upon hydrolysis

Examples of these groups include those as described in West German Patent Application (OLS) No. 2,626,315, etc., and are specifically represented by the following formulae (T-4) and (T-5):

(T-4)

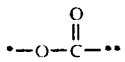

(T-5)

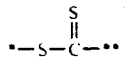

wherein a bond indicated by * and a bond indicated by ** each has the same meaning as defined in general formula (T-1) above.

In general formula (II), the group represented by B is specifically a group capable of forming a coupler after being released from $A—(L_1)_v$ or a group capable of forming an oxidation reduction group after being released from $A—(L_1)_v$. Examples of the group forming a coupler include a group which is formed by removing a hydrogen atom from a hydroxy group of a phenol type coupler and is connected to $A—(L_1)_v$ at the oxygen atom of the hydroxy group, and a group which is formed by removing a hydrogen atom from a hydroxy group of 5-hydroxypyrazole (which is a tautomer of a 5-pyrazolone type coupler) and is connected to $A—(L_1)_v$ at the oxygen atom of the hydroxy group. In these cases, the group forms a phenol type coupler or a 5-pyrazolone type coupler for the first time after being released from $A—(L_1)_v$. These couplers have $(L_2)_w—DI$ their coupling position.

When B represents a group capable of forming an oxidation reduction group, B is preferably represented by the following general formula (B-1):

$$*—P—(X'=Y')_n—Q—A_2 \quad \text{(B-1)}$$

wherein a bond indicated by * denotes the position at which the group is connected to $A—(L_1)_v—$; $A_2$, P, Q and n each has the same meaning as defined in general formula (III); one of X' and Y' represents a methine group having a group of $(L_2)_w—DI$ as a substituent, and the other of X' and Y' represents a substituted or unsubstituted methine group or a nitrogen atom; and any two substituents of $A_2$, P, Q, X' and Y' may be divalent groups and connected with each other to form a cyclic structure.

In general formula (II), the group represented by DI specifically includes a tetrazolylthio group, a benzimidazolylthio group, a benzothiazolylthio group, a benzoxazolylthio group, a benzotriazolyl group, a benzindazolyl group, a triazolylthio group, an imidazolylthio group, a thiadiazolylthio group, a thioether-substituted triazolyl group (for example, the development inhibitors as described in U.S. Pat. No. 4,579,816, etc.), and an oxadiazolyl group, etc., and these groups may have one or more appropriate substituents.

Representative examples of such substituents include a halogen atom, an aliphatic group, a nitro group, an acylamino group, an aliphatic oxycarbonyl group, an aromatic oxycarbonyl group, an imido group, a sulfonamido group, an aliphatic oxy group, an aromatic oxy group, an amino group, an imino group, a cyano group, an aromatic group, an acyloxy group, a sulfonyloxy group, an aliphatic thio group, an aromatic thio group, an aromatic oxysulfonyl group, an aliphatic oxysulfonyl group, an aliphatic oxycarbonylamino group, an aromatic oxycarbonylamino group, an aliphatic oxycarbonyloxy group, a heterocyclic oxycarbonyl group, a heterocyclic oxy group, a sulfonyl group, an acyl group, a heterocyclic oxy group, a ulsfonyl group, an acyl group, a uredio group, a htereocyclic group, a hydroxy group, etc. The total number of carbon atoms included in one or more substituents is preferably not more than 20.

In general formula (II), any two groups represented by A, $L_1$, B, $L_2$, and DI may have a bond in addition to the bond represented by the general formula (II), and may be connected with each other. In such cases, even when the second bond is not cleaved at the time of development, the effect of the present invention can be achieved. Examples of compounds including such a second bond are represented by the following general formulae:

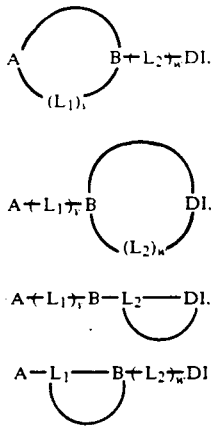

wherein A, $L_1$, B, $L_2$, DI, v and w each has the same meaning as defined in general formula (II) above.

The primary compound represented by general formula (II) used in the present invention includes the case that the compound is a polymer. That is, the primary compound may be a homopolymer derived from a monomer represented by general formula (P-1) described below and having a recurring unit represented by general formula (P-2) described below, or may be a copolymer of the above-described monomer and at least one non-color forming monomer containing at least one ethylene group which does not have an ability to undergo a coupling reaction with an oxidation product of an aromatic primary amine developing agent; in this case, two or more kinds of the monomer may be simultaneously polymerized:

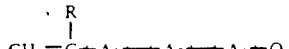

(P-1)

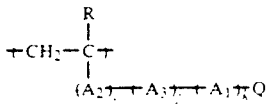

(P-2)

wherein, R represents a hydrogen atom, a lower alkyl group having from 1 to 4 carbon atoms or a chlorine atom; $A_1$ represents —CONH—, —NHCONH—, —NHCOO—, —COO—, —$SO_2$—, —CO—, —NHCO—, —$SO_2$NH—, —NH$SO_2$—, —OCO—, —OCONH—, —S—, —NH—or —O—; $A_2$ represents —CONH—or —COO—; $A_3$ represents a substituted or unsubstituted alkylene group having from 1 to 10 carbon atoms, a substituted or unsubstituted aralkylene group having from 7 to 20 carbon atoms, or a substituted or unsubstituted arylene group having from 6 to 20 carbon atoms.

The alkylene group may be a straight chain or branched chain alkylene group. Examples of the alkylene group include a methylene group, a methylmethylene group, a dimethylmethylene group, a dimethylene group, a trimethylene group, a tetramethylene group, a pentamethylene group, a hexamethylene group, a decylmethylene group, etc. Examples of the aralkylene group include a benzylidene group, etc. Examples of the arylene group include a phenylene group, a naphthylene group, etc.

Q in the above-described general formulae represents a residue of the primary compound represented by general formula (II), and may be bonded through any moiety of A, $L_1$, B and $L_2$ in general formula (II).

Further, i, j, and k each represents 0 or 1, with the proviso that i, j, and k are not simultaneously 0.

Examples of the substituent for the alkylene group, aralkylene group or arylene group represented by $A_3$ include an aryl group (e.g., a phenyl group, etc.), a nitro group, a hydroxy group, a cyano group, a sulfo group, an alkoxy group (e.g., a methoxy group, etc.), an aryloxy group (e.g., a phenoxy group, etc.), an acyloxy group (e.g., an acetoxy group, etc.), an acylamino group (e.g., an acetylamino group, etc.), a sulfonamido group (e.g., a methanesulfonamido group, etc.), a sulfamoyl group (e.g., a methylsulfamoyl group, etc.), a halogen atom (e.g., a fluorine atom, a chlorine atom, a bromine atom, etc.), a carboxyl group, a carbamoyl group (e.g., a methylcarbamoyl group, etc.), an alkoxycarbonyl group (e.g., a methoxycarbonyl group, etc.), a sulfonyl group (e.g., a methylsulfonyl group, etc.), etc. When the group represented by $A_3$ has two or more substituents, they may be the same or different.

Examples of the non-color forming ethylenic monomer which does not undergo a coupling reaction with the oxidation product of an aromatic primary amine developing agent include acrylic acids such as acrylic acid, α-chloroacrylic acid, α-alkylacrylic acid, etc., an ester or amide derived from an acrylic acid, methylenebisacrylamide, a vinyl ester, an acrylonitrile, an aromatic vinyl compound, a maleic acid derivative, a vinylpyridine, etc. In this case, two or more of such non-color forming ethylenically unsaturated monomers can be used together.

Of the compounds according to the present invention, preferred compounds are explained in detail below:

Where A represents a coupler residue in general formula (I) or (II), preferred coupler residues include those represented by general formula (Cp-1), (Cp-2), (Cp-3), (Cp-4), (Cp-5), (Cp-6), (Cp-7), (Cp-8) or (Cp-9) described below. These coupler residues are preferred because of their high coupling rates:

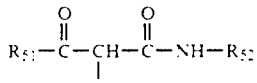

(Cp-1)

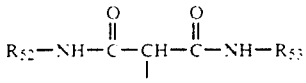

(Cp-2)

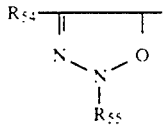

(Cp-3)

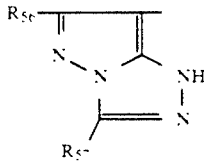

(Cp-4)

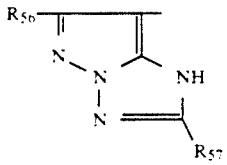

(Cp-5)

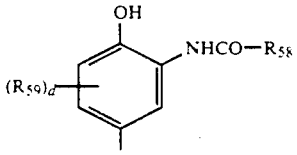

(Cp-6)

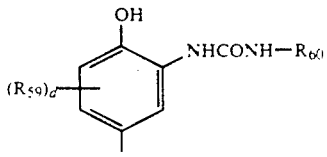

(Cp-7)

-continued (Cp-8)

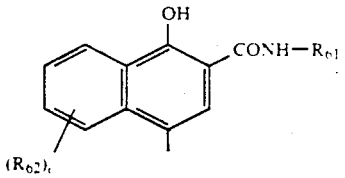

(Cp-9)

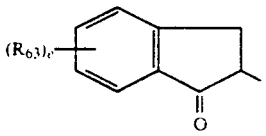

In the above-described general formulae, a free bond attached to the coupling position indicates a position to which a group capable of being released upon coupling is bonded. When any of $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$ or $R_{63}$ in the above-described general formulae contain a diffusion-resistant group, it is selected so that the total number of carbon atoms included therein is from 8 to 40, and preferably from 10 to 30. In other cases (i.e., these R groups lack a diffusion-resistant group), the total number of carbon atoms comprising the R group is preferably not more than 15. With respect to bis-type, telomer-type or polymer-type couplers, any of the above-described substituents $R_{51}$ to $R_{63}$, forms a divalent group and may connect to a repeating unit, etc. In such cases, the total number of carbon atoms can be more than 40.

$R_{51}$ to $R_{63}$, d and e in the above-described general formulae (Cp-1) to (Cp-9) are explained in detail below. In the following description, $R_{41}$ represents an aliphatic group, an aromatic group or a heterocyclic group; $R_{42}$ represents an aromatic group or a heterocyclic group; and $R_{43}$, $R_{44}$ and $R_{45}$, which may be the same or different, each represents a hydrogen atom, an aliphatic group, an aromatic group or a heterocyclic group.

$R_{51}$ represents a group as defined for $R_{41}$.

$R_{52}$ and $R_{53}$, which may be the same or different, each represents a group as defined for $R_{42}$.

$R_{54}$ represents a group as defined for $R_{41}$, a group of $$R_{41}-\underset{\underset{R_{43}}{|}}{CON}-,$$

a group of $$R_{41}-\underset{\underset{R_{43}}{|}}{N}-,$$

a group of $$R_{41}-\underset{\underset{R_{43}}{|}}{SO_2N}-,$$

a group of $R_{41}$—S—, a group of $R_{43}$—O—, a group $$R_{45}-\underset{\underset{R_{43}}{|}}{N}\underset{\underset{R_{44}}{|}}{CON}-,$$

a group of $R_{41}$—OOC—, a group of $$R_{44}-\underset{\underset{R_{43}}{|}}{N}CO-$$

or a group of N=C—.

$R_{55}$ represents a group as defined for $R_{41}$.

$R_{56}$ and $R_{57}$, which may be the same or different, each represents a group as defined for $R_{43}$, a group of $R_{41}$S—, a group of $R_{43}$—O—, a group of $$R_{41}-\underset{\underset{R_{43}}{|}}{CON}-,$$

a group of $$R_{41}-\underset{\underset{R_{43}}{|}}{N}-,$$

a group or $$R_{43}-\underset{\underset{R_{44}}{|}}{N}\underset{\underset{R_{45}}{|}}{CON}-$$

or a group of $$R_{41}-\underset{\underset{R_{43}}{|}}{SO_2N}-,$$

$R_{58}$ represents a group as defined for $R_{41}$.

$R_{59}$ represents a group as defined for $R_{41}$, a group of $$R_{41}-\underset{\underset{R_{43}}{|}}{CON}-,$$

a group of $$R_{41}-\underset{\underset{R_{43}}{|}}{OCON}-,$$

a group of $$R_{41}-\underset{\underset{R_{43}}{|}}{SO_2N}-,$$

a group of $$R_{43}-\underset{\underset{R_{44}}{|}}{N}\underset{\underset{R_{45}}{|}}{CON}-,$$

a group of $R_{43}-\underset{\underset{R_{44}}{|}}{N}SO_2\underset{\underset{R_{45}}{|}}{N}-$, a group of $R_{41}-O-$, a group of $R_{41}-S-$, a halogen atom or a group of $R_{41}-\underset{\underset{R_{43}}{|}}{N}-$.

d represents an integer of from 0 to 3. When d represents 2 or more, two or more $R_{59}$'s may be the same or different. Further, each of two $R_{59}$'s may be a divalent group and connected with each other to form a cyclic structure.

Examples of the divalent groups for forming a cyclic structure include a group of

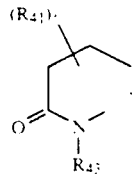

a group of

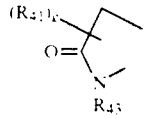

or a group of

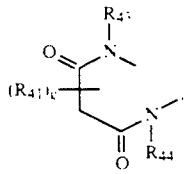

wherein F represents an integer of from 0 ro 4; and g represents an integer from 0 to 2.

$R_{60}$ represents a group as defined for $R_{41}$.

$R_{61}$ represents a group as defined for $R_{41}$.

$R_{62}$ represents a group as defined for $R_{41}$, a group of $R_{41}-CONH-$, a group of $R_{41}-OCONH-$, a group of $R_{41}-SO_2NH-$, a group of $R_{43}-\underset{\underset{R_{44}}{|}}{N}CO\underset{\underset{R_{45}}{|}}{N}-$, a group of $R_{43}-\underset{\underset{R_{44}}{|}}{N}SO_2\underset{\underset{R_{45}}{|}}{N}-$, a group of $R_{43}-O-$, a group of $R_{41}-S-$, a halogen atom or a group of $R_{43}-\underset{\underset{R_{43}}{|}}{N}-$.

$R_{63}$ represents a group as defined for $R_{41}$, a group of $R_{43}-CO\underset{\underset{R_{44}}{|}}{N}-$, a group of $R_{43}-NCO-$, a group of $R_{41}-SO_2\underset{\underset{R_{44}}{|}}{N}-$, a group of $R_{43}-\underset{\underset{R_{44}}{|}}{N}SO_2-$, a group of $R_{41}-SO_2-$, a group of $R_{43}-OCO-$, a group of $R_{43}-OSO_2-$, a halogen atom, a nitro group, a cyano group or a group of $R_{43}-CO-$.

e represents an integer from 0 to 4. When e represents 2 or more, two or more $R_{62}$'s or $R_{63}$ may be the same or different.

The aliphatic group described above is an aliphatic hydrocarbon group having from 1 to 32 carbon atoms, preferably from 1 to 22 carbon atoms, and may be saturated or unsaturated, a straight-chain, branched chain or cyclic, or substituted or unsubstituted. Representative examples of the unsubstituted aliphatic group include a methyl group, an ethyl group, a propyl group, an isopropyl group, a butyl group, a tert-butyl group, an isobutyl group, a tert-amyl group, a hexyl group, a cyclohexyl group, a 2-ethylhexyl group, an octyl group, a 1,1,3,3-tetramethylbutyl group, a decyl group, a dodecyl group, a hexadecyl group, or an octadecyl group, etc.

The aromatic group described above is an aromatic group having from 6 to 20 carbon atoms, and preferably is an unsubstituted or substituted phenyl group or an unsubstituted or substituted naphthyl group.

The heterocyclic group described above is a heterocyclic group having from 1 to 20 carbon atoms, preferably from 1 to 7 carbon atoms, and containing, as a hetero atom, at least one of a nitrogen atom, an oxygen atom and a sulfur atom, and preferably is a three-membered to eight-membered, substituted or unsubstituted heterocyclic group. Representative examples of the unsubstituted heterocyclic group include a 2-pyridyl group, a 4-pyridyl group, a 2-thienyl group, a 2-furyl group, a 2-imidazolyl group, a pyrazinyl group, a 2-pyrimidinyl group, a 1-imidazolyl group, a 1-indolyl group, a phthalimido group, a 1,3,4-thiadiazol-2-yl group, a benzoxazol-2-yl group, a 2-quinolyl group, a 2,4-dioxo-1,3-imidazolidin-5-yl group, a 2,4-dioxo-1,3-imidazolidin-3-yl group, a succinimido group, a phthalimido group, a 1,2,4-triazol-2-yl group, or a 1-pyrazolyl group, etc.

The aliphatic group, aromatic group and heterocyclic group may have one or more substituents as described above. Representative examples of these substituents include a halogen atom, a group of $R_{47}$—O—, a group of —S—, a group of $$R_{47}-\underset{\underset{R_{48}}{|}}{CON}-,$$

a group of $$R_{47}-\underset{\underset{R_{48}}{|}}{NCO}-,$$

a group of $$R_{47}-\underset{\underset{R_{47}}{|}}{OCON}-,$$

a group of $$R_{47}-\underset{\underset{R_{47}}{|}}{SO_2N}-,$$

a group of $$R_{47}-\underset{\underset{R_{48}}{|}}{NSO_2}-,$$

a group of $R_{46}$—$SO_2$—, a group of $R_{47}$—OCO—, a group of $$R_{47}-\underset{\underset{R_{48}}{|}}{N}\underset{\underset{R_{49}}{|}}{CON}-,$$

a group or $R_{46}$, a grou of

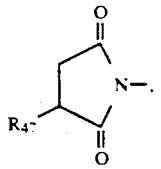

group of $R_{46}$—COO—, a group of $R_{47}$—$OSO_21$—, a cyano group, or a nitro group, etc. In the above-described formulae, $R_{46}$ represents an aliphatic group, an aromatic group or a heterocyclic group; and $R_{47}$, $R_{48}$ and $R_{49}$, which may be the same or different, each represents a hydrogen atom, an aliphatic group, an aromatic group or a heterocyclic group. The aliphatic group, aromatic group and heterocyclic group each has the same meaning as defined immediately above for $R_{41}$ to $R_{45}$.

Preferred scopes of $R_{51}$ to $R_{63}$, d and e are described below.

$R_{51}$ is preferably an aliphatic group or an aromatic group.

$R_{52}$, $R_{53}$ and $R_{55}$ each is preferably an aromatic group.

$R_{54}$ is preferably a group of $R_{41}$—CONH— or group of $$R_{41}-\underset{\underset{R_{43}}{|}}{N}-.$$

$R_{56}$ and $R_{57}$ each is preferably an aliphatic group, a group of $R_{41}$—O— or a group of $R_{41}$—S—.

$R_{58}$ is preferably an aliphatic group or an aromatic group.

$R_{59}$ in general formula (Cp-6) is preferably a chlorine atom, an aliphatic group or a group of $R_{41}$—CONH—.

d in general formula (Cp-6) is preferably 1 or 2.

$R_{60}$ is preferably an aromatic group.

$R_{59}$ in general formula (Cp-7) is preferably a group of $R_{41}$—CONH—.

d in general formula (Cp-7) is preferably 1.

$R_{61}$ is preferably an aliphatic group or an aromatic group.

e in general formula (Cp-8) is preferably 0 or 1.

$R_{62}$ is preferably a group of $R_{41}$—OCONH—, a group of $R_{41}$—CONH—or a group of $R_{41}$—$SO_2$NH—. The position of $R_{62}$ is preferably the 5-position of the naphthol ring.

$R_{63}$ is preferably a group of $R_{41}$—CONH—, a group $R_{41}$—$SO_2$NH—, a group of $$R_{41}-\underset{\underset{R_{43}}{|}}{NSO_2}-,$$

a group of $R_{41}$l—$SO_2$—, a group of $$R_{41}-\underset{\underset{R_{43}}{|}}{NCO}-,$$

a nitro group or a cyano group.

Representative examples of $R_{51}$ to $R_{63}$ are set forth below.

Examples of $R_{51}$ include a tert-butyl group, a 4-methoxyphenyl group, a phenyl group, a 3-[2-(2,4-di-tert-amylphenoxy)butanamido]phenyl group, a 4-octadecyloxyphenyl group or a methyl group, etc.

Examples of $R_{52}$ and $R_{53}$ include a 2-chloro-5-dodecyloxycarbonylphenyl group, a 2-chloro-5-hexadecylsulfonamidophenyl group, a 2-chloro-5-tetradecanamidophenyl group, a 2-chloro-5-[4-(2,4-di-tert-amylphenoxy)butanamido]phenyl group, a 2-chloro-5-[2-(2,4-di-tert-amylphenoxy)butanamido]-phenyl group, a 2-methoxyphenyl group, a 2-methoxy-5-tetradecyloxycarbonylphenyl group, a 2-chloro-5-(1-ethoxycarbonylethoxycarbonyl)phenyl group, a 2-pyridyl group, a 2-chloro-5-octyloxycarbonylphenyl group, a 2,4-dichlorophenyl group, a 2-chloro-5-(1-dodecyloxycarbonylethoxycarbonyl)phenyl group, a 2-chlorophenyl group, or a 2-ethoxyphenyl group, etc.

Examples of $R_{54}$ include a 3-[2-(2,4-di-tert-amylphenoxy)butanamido]benzamido group, a 3-[4-(2,4-di-tert-amylphenoxy)butanamido]benzamido group, a 2-chloro-5-tetradecanamidoanilino group, a 5-(2,4-di-tert-amylphenoxyacetamido)benzamido group, a 2-chloro-5-dodecenylsuccinimidoanilino group, a 2-chloro-5-[2-(3-tert-butyl-4-hydroxyphenoxy)tetradecanamido]anilino group, a 2,2-dimethylpropanimido group, a 2-(3-pentadecylphenoxy)butanamido group, a pyrrolidino group, or an N,N-dibutylamino group, etc.

Examples of $R_{55}$ include a 2,4,6-trichlorophenyl group, a 2-chlorophenyl group, a 2,5-dichlorophenyl group, a 2,3-dichlorophenyl group, a 2,6-dichloro-4-methoxyphenyl group, a 4-[2-(2,4-di-tert-amylphenoxy)butanamido]phenyl group, or a 2,6-dichloro-4-methanesulfonylphenyl group, etc.

Examples of $R_{56}$ include a methyl group, an ethyl group, an isopropyl group, a methoxy group, an ethoxy group, a methylthio group, an ethylthio group, a 3-phenylureido group, a 3-butylureido group, or a 3-(2,4-di-tert-amylphenoxy)propyl group, etc.

Examples of $R_{57}$ include a 3-(2,4-di-tert-amylphenoxy)propyl group, a 3-[4-{2-[4-(4-hydroxyphenylsulfonyl)phenoxy]tetradecanamido}phenyl]propyl group, a methoxy group, an ethoxy group, a methylthio group, an ethylthio group, a melhyl group, a 1-methyl-2-{2-octyloxy-5-[2-octyloxy-5-(1,1,3,3-tetramethylbutyl)-phenylsulfonamido]phenylsulfonamido}ethyl group, a 3-[4-(4-dodecyloxyphenylsulfonamido)phenyl]propyl group, a 1,1-dimethyl-2-[2-octyloxy-5-(1,1,3,3-tetramethylbutyl)phenylsulfonamido]ethyl group, or a dodecylthio group, etc.

Examples of $R_{58}$ include a 2-chlorophenyl group, a pentafluorophenyl group, a heptafluoropropyl group, a 1-(2,4-di-tert-amylphenoxy)propyl group, a 3-(2,4-di-tert-amylphenoxy)propyl group, a 2,4-di-tert-amylmethyl group, or a furyl group, etc.

Examples of $R_{59}$ include a chlorine atom, a methyl group, an ethyl group, a propyl group, a butyl group, an isopropyl group, a 2-(2,4-di-tert-amylphenoxy)butanamido group, a 2-(2,4-di-tert-amylphenoxy)hexanamido group, a 2-(2,4-di-tert-octylphenoxy)octanamido group, a 2-(2-chlorophenoxy)tetradecanamido group, a 2,2-dimethylpropanamido group, a 2-[4-(4-hydroxyphenylsulfonyl)phenoxy]tetradecanamido group, or a 2-[2-(2,4-di-tert-amylphenoxyacetamido)phenoxy]butanamido group, etc.

Examples of $R_{60}$ include a 4-cyanophenyl group, a 2-cyanophenyl group, a 4-butylsulfonylphenyl group, a 4-propylsulfonylphenyl group, a 4-ethoxycarbonylphenyl group, a 4-N,N-diethylsulfamoylphenyl group, a 3,4-dichlorophenyl group, or a 3-methoxycarbonylphenyl group, etc.

Examples of $R_{61}$ include a dodecyl group, a hexadecyl group a cyclohexyl group, a butyl group, a 3-(2,4-di-tert-amylphenoxy)propyl group, a 4-(2,4-di-tert-amylphenoxy)butyl group, a 3-dodecyloxypropyl group, a 2-tetradecyloxyphenyl group, a tert-butyl group, a 2-(2-hexadecyloxy)phenyl group, a 2-methoxy 5-dodecyloxycarbonylphenyl group, a 2-butoxyphenyl group, or a 1-naphthyl group, etc.

Examples of $R_{62}$ include an isobutyloxycarbonylamino group, an ethoxycarbonylamino group, a phenylsulfonylamino group, a methanesulfonamido group, a butanesulfonamido group, a 4-methylbenzenesulfonamido group, a benzamido group, a trifluoroacetamido group, a 3-phenylureido group, a butoxycarbonylamino group, or an acetamido group, etc.

Examples of $R_{63}$ include a 2,4-di-tert-amylphenoxyacetamido group, a 2-(2,4-di-tert-amylphenoxy)butanamido group, a hexadecylsulfonamido group, an N-methyl-N-octadecylsulfamoyl group, an N,N-dioctylsulfamoyl group, a dodecyloxycarbonyl group, a chlorine atom, a fluorine atom, a nitro group, a cyano group, an N-3-(2,4-di-tert-amylphenoxy)propylsulfamoyl group, a methanesulfonyl group, or a hexadecylsulfonyl group, etc.

When A in general formula (II) represents the oxidation reduction group of general formula (III) described above, a preferred scope of such a group is described below.

When P and Q each represents a substituted or unsubstituted imino group substituted with a sulfonyl group or an acyl group is preferred. In such a case, P or Q is represented by the following general formula (N-1) or (N-2):

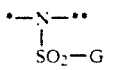
(N-1)

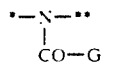
(N-2)

wherein a bond indicated by * denotes the position at which the group is connected to $A_1$ or $A_2$; a bond indicated by ** denotes the position at which the group is connected to one of the free bonds of $-(X=Y)_n-$; and G represents an aliphatic group containing from 1 to 32 carbon atoms, preferably from 1 to 22 carbon atoms, which may be a straight chain, branched chain or cyclic, saturated or unsaturated, or substituted or unsubstituted (for example, a methyl group, an ethyl group, a benzyl group, a phenoxybutyl group, an isopropyl group, etc.), a substituted or unsubstituted aromatic group containing from 6 to 10 carbon atoms (for example, a phenyl group, a 4-methylphenyl group, a 1-naphthyl group, a 4-dodecyloxyphenyl group, etc.) or a 4-membered to 7-membered heterocyclic group containing as a hetero atom a nitrogen atom, a sulfur atom or an oxygen atom (for example, a 2-pyridyl group, a 1-phenyl-4-imidazolyl group, a 2-furyl group, a benzothienyl group, etc.).

When $A_1$ and $A_2$ each represents a group capable of being removed upon reaction with an alkali (hereinafter referred to as a precursor group), preferred examples of suitable precursor groups include a hydrolyzable group, for example, an acyl group, an alkoxycarbonyl group, an aryloxycarbonyl group, a carbamoyl group, an imidoyl group, an oxazolyl group, a sulfonyl group, etc.; a precursor group of a type utilizing a reversal Michael reaction as described in U.S. Pat. No. 4,009,029, etc.; a precursor group of a type utilizing an anion generated after a ring cleavage reaction as an intramolecular nucleophilic group, as described in U.S. Pat. No. 4,310,612, etc.; a precursor group utilizing an electron transfer of an anion via a conjugated system whereby a cleavage reaction occurs as described in U.S. Pat. Nos. 3,674,478, 3,932,480 and 3,993,661, etc.; a precursor group utilizing an electron transfer of an anion reacted after a ring cleavage reaction whereby a cleavage reaction occurs as described in U.S. Pat. No. 4,335,200, or a precursor group utilizing an imidomethyl group as described in U.S. Pat. Nos. 4,363,865 and 4,410,618, etc.

In general formula (III), it is more preferred that P represents an oxygen atom and $A_2$ represents a hydrogen atom.

It is more preferred that in general formula (III), X and Y each represents a substituted or unsubstituted methine group, with the proviso that at least one X or Y represents a methine group having a group of $-(L_1)_l-B-(L_2)_m-DI$ as a substituent.

Of the groups represented by general formula (III), those particularly preferred are represented by the following general formula (IV) or (V):

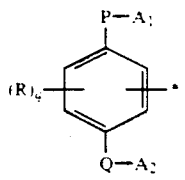

(IV)

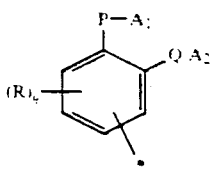

(V)

wherein a bond indicated by * denotes the position at which the group is connected to $-(L_1)_l-B-(L_2)_m-DI$; P, Q, $A_1$ and $A_2$ each has the same meaning as defined in general formula (III); R represents a substituent; q represents an integer of 0, 1, 2 or 3; and when q represents 2 or 3, two or three R's may be the same or different, or when two R's represent substituents positioned on two adjacent carbon atoms, they may be divalent groups and connected to each other to form a cyclic structure.

Examples of the cyclic structures formed by condensing the benzene ring and another ring include a naphthalene ring, a benzonorbornene ring, a chroman ring, an indole ring, a benzothiophene ring, quinoline ring, a benzofuran ring, a. 2,4-dihydrobenzofuran ring, an indane ring, an indene ring, etc. These rings may further have one or more substituents.

Preferred examples of the substituents represented by R and the substituents on the condensing ring described above include an aliphatic group (for example, a methyl group, an ethyl group, an allyl group, a benzyl group, a dodecyl group, etc.), an aromatic group (for example, a phenyl group, a naphthyl group, a 4-phenoxycarbonylphenyl group, etc.), a halogen atom (for example, a chlorine atom, a bromine atom, etc.), an alkoxy group (for example, a methoxy group, a hexadecyloxy group, etc.), an alkylthio group (for example, a methylthio group, a dodecylthio group, a benzylthio group, etc.), an aryloxy group (for example, a phenoxy group, a 4-tert-butylphenoxy group, a 2,4-di-tert-amylphenoxy group, etc.), an arylthio group (for example, a phenylthio group, a 4-dodecyloxyphenylthio group, etc.), a carbamoyl group (for example, an N-ethylcarbamoyl group, an N-propylcarbamoyl group, an N-hexadecylcarbamoyl group, an N-tert-butylcarbamoyl group, an N-3-(2,4-di-tert-amylphenoxy)propylcarbamoyl group, an N-methyl-N-octadecylcarbamoyl group, etc.), an alkoxycarbonyl group (for example, a methoxycarbonyl group, a 2-cyanoethoxycarbonyl group, an ethoxycarbonyl group, a dodecyloxycarbonyl group, a 3-(2,4-di-tert-amylphenoxy)propoxycarbonyl group, etc.), an aryloxycarbonyl group (for example, a phenoxycarbonyl group, a 4-nonylphenoxycarbonyl group, etc.), a sulfonyl group (for example, a methanesulfonyl group, a benzenesulfonyl group, a p-toluenesulfonyl group, etc.), a sulfamoyl group (for example, an N-propylsulfamoyl group, an N-methyl-N-octadecylsulfamoyl group, an N-phenylsulfamoyl group, an N-dodecylsulfamoyl group, etc.), an acylamino group (for example, an acetamido group, a benzamido group, a tetradecanamido group, a 4-(2,4-di-tert-amylphenoxy)butanamido group, a 2-(2,4-di-tert-amylphenoxy)butanamido group, a 2-(2,4-di-tert-amylphenoxy)tetradecanamido group, etc.), a sulfonamido group (for example, a methanesulfonamido group, a benzenesulfonamido group, a hexadecylsulfonamido group, etc.), an acyl group (for example, an acetyl group, a benzoyl group, a myristoyl group; a palmitoyl group, etc.), a nitroso group, an acyloxy group (for example, an acetoxy group, a benzoyloxy group, a lauryloxy group, etc.), a ureido group (for example, a 3-phenylureido group, a 3-(4-cyanophenyl)ureido group, etc.), a nitro group, a cyano group, a heterocyclic group (preferably a 4-membered, 5-membered or 6-membered heterocyclic group containing as a hetero atom a nitrogen atom, an oxygen atom or a sulfur atom, for example, a 2-furyl group, a 2-pyridyl group, a 1-imidazolyl group, a 1-morpholino group, etc.), a hydroxy group, a carboxy group, an alkoxycarbonylamino group (for example, a methoxycarbonylamino group, a phenoxycarbonylamino group, a dodecyloxycarbonylamino group, etc.), a sulfo group, an amino group, an arylamino group (for example, an anilino group, a 4-methoxycarbonylanilino group, etc.), an aliphatic amino group (for example, an N,N-diethylamino group, a dodecylamino group, etc.), a sulfinyl group (for example, a benzenesulfinyl group, a propylsulfinyl group, etc.), a sulfamoylamino group (for example, a 3-phenylsulfamoylamino group, etc.), a thioacyl group (for example, a thiobenzoyl group, etc.), a thioureido group (for example, a 3-phenylthioureido group, etc.), a heterocyclic thio group (for example, a thiadiazolylthio group, etc.), an imido group (for example, a succinimido group, a phthalimido group, an octadecenylimido group, etc.), or a heterocyclic amino group (for example, a 4-imidazolylamino group, a 4-pyridylamino group, etc.), etc.

The aliphatic moiety included in the above-described substituents may have from 1 to 32 carbon atoms, preferably from 1 to 20 carbon atoms, and may be a straight chain, branched chain or cyclic, saturated or unsaturated, substituted or unsubstituted aliphatic group.

The aromatic moiety included in the above-described substituents may have from 6 to 10 carbon atoms and is preferably a substituted or unsubstituted phenyl group.

It is preferred that the group represented by B in general formula (II) is a group represented by general formula (B-1) shown below.

In general formula (B-1), P preferably represents an oxygen atom and Q preferably represents an oxygen atom or one of the following groups:

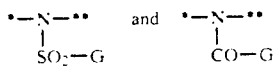

wherein a bond indicated by * denotes the position at which the group is connected to —(X'=Y')n—; a bond indicated by ** denotes the position at which the group is connected to $A_2$; and G has the same meanings as defined in general formula (N-1) or (N-2).

Further, the effects of the present invention are particularly exhibited when the group represented by B in general formula (II) represents a group represented by the following general formula (B-2) or (B-3):

(B-2)

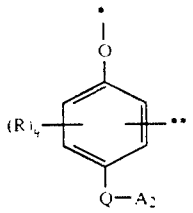

(B-3)

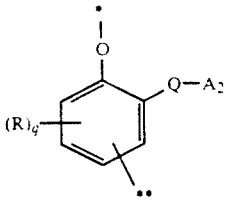

wherein a bond indicated by * denotes the position at which the group is connected to $A—(L_1)_v—$; a bond indicated by ** denotes the position at which the group is connected to $—(L_2)_w—DI$; and R, q, Q and $A_2$ each has the same meaning as defined in general formula (IV) or (V) above. Preferred examples of the substituents represented by R in general formula (B-2) or (B-3) include an aliphatic group (for example, a methyl group, an ethyl group, etc.), an alkoxy group (for example, a methoxy group, an ethoxy group, etc.), an alkylthio group (for example, a methylthio group, an ethylthio group, etc.), an alkoxycarbonyl group (for example, a methoxycarbonyl group, a propoxycarbonyl group, etc.), an aryloxycarbonyl group (for example, a phenoxycarbonyl group, etc.), a carbamoyl group (for example, an N-propylcarbamoyl group, an N-tert-butylcarbamoyl group, an N-ethylcarbamoyl group, etc.), a sulfonamido group (for example, a methanesulfonamido group, etc.), an acylamino group (for example, an acetamido group, etc.), a heterocyclic thio group (for example, a tetrazolylthio group, etc.), a hydroxy group, or an aromatic group, etc. It is preferred that the total number of carbon atoms included in the above described group(s) for R is not more than 15.

In general formula (II), it is preferred that both v and w are 0.

It is particularly preferred that the group represented by A in general formula (II) is a coupler residue.

Hereinafter, more preferred embodiments according to the present invention are described.

In general formula (II), a particularly preferred example of the development inhibitor represented by DI is a development inhibitor which is a compound having a development inhibiting function upon being released as DI, and which is capable of being decomposed (or converted into) a compound having substantially no effect on photographic properties after being discharged into a color developing solution.

Examples of these development inhibitors include those as described in U.S. Pat. No. 4,477,563, Japanese Patent Application (OPI) Nos. 218644/85, 221750/85, 233650/85 and 11743/86, etc.

Preferred examples of the development inhibitors represented by DI include those represented by the following general formula (D-1), (D-2), (D-3), (D-4), (D-5), (D-6), (D-7), (D-8), (D-9), (D-10) or (D-11):

(D-1)

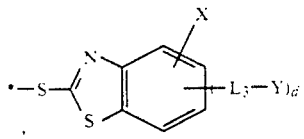

(D-2)

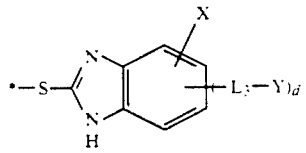

(D-3)

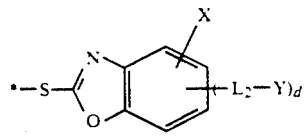

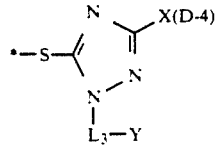

(D-5)

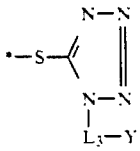

-continued (D-6)

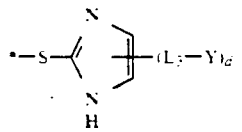

(D-7)

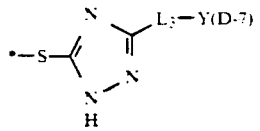

(D-8)

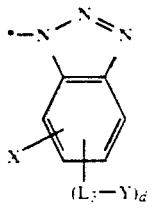

(D-9)

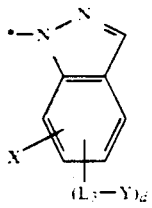

(D-10)

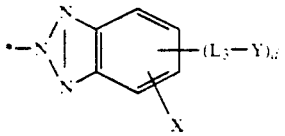

(D-11)

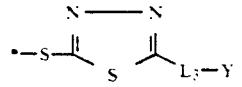

wherein a bond indicated by * denotes the position at which the group is connected to $A-(L_1)_v-B-(L_2)_w-$; X represents a hydrogen atom or a substituent; d represents 1 or 2; $L_3$ represents a group containing a chemical bond which is capable of being cleaved in a developing solution; and Y represents a substituent capable of providing a development inhibiting function and is selected from an aliphatic group, an aromatic group or a heterocyclic group.

The development inhibitor represented by DI described above which is released from $A-(L_1)_v-B-(L_2)_w-$ diffuses in a photographic layer while exhibiting the development inhibiting function, and a part thereof subsequently discharges into the color developing solution. The development inhibitor discharged into the color developing solution rapidly decomposes at the chemical bond included in $L_3$ to release the group represented by Y (for example, by hydrolysis of an ester bond) upon a reaction with a hydroxy ion or hydroxylamine generally present in the color developing solution, whereby the compound changes into a compound having a high degree of water-solubility and a low development inhibiting ability and thus the development inhibiting function substantially disappears.

While X in the above-described formulae is preferably a hydrogen atom, it may be a substituent. Representative examples of the substituent include an aliphatic group (for example, a methyl group, an ethyl group, etc.), an acylamino group (for example, an acetamido group, a propionamido group, etc.), an alkoxy group (for example, a methoxy group, an ethoxy group, etc.), a halogen atom (for example, a chlorine atom, a bromine atom, etc.), a nitro group, or a sulfonamido group (for example, a methanesulfonamido group, etc.), etc.

The linking group represented by $L_3$ in the above-described general formulae includes a chemical bond which is cleaved in a developing solution. Suitable examples of such chemical bonds include those described in Table A below. These chemical bonds are cleaved with a nucleophilic reagent such as a hydroxy ion or hydroxylamine, etc., which is a component of the color developing solution.

TABLE A

| Chemical Bond Included in $L_3$ | Cleavage Reaction of Chemical Bond (Reaction with $^-OH$) |
|---|---|
| $-COO-$ | $-COOH + HO-$ |
| $-NHCOO-$ | $-NH_2 + HO-$ |
| $-SO_2O-$ | $-SO_3H + HO-$ |
| $-OCH_2CH_2SO_2-$ | $-OH + CH_2{=}CHSO_2-$ |
| $-OC(=O)-$ | $-OH + HO-$ |
| $-NHC(=O)C(=O)-$ | $-NH_2 + HO-$ |

The divalent linking group shown in Table A above is connected directly or through an alkylene group and/or a phenylene group with a heterocyclic moiety constituting a development inhibitor and connected directly with Y. When the divalent linking group is connected through an alkylene group and/or a phenylene group, the alkylene group and/or phenylene group may contain an ether bond, an amido bond, a carbonyl group, a thioether bond, a sulfon group, a sulfamido bond or a ureido group.

The aliphatic group represented by Y is an aliphatic hydrocarbon group having from 1 to 20 carbon atoms, preferably from 1 to 10 carbon atoms, and may be saturated or unsaturated, a straight chain, branched chain or cyclic, or substituted or unsubstituted. A substituted aliphatic hydrocarbon group is particularly preferred.

The aromatic group represented by Y is a substituted or unsubstituted phenyl group or a substituted or unsubstituted naphthyl group.

The heterocyclic group represented by Y is a substituted or unsubstituted 4-membered to 8-membered heterocyclic group containing as a hetero atom a sulfur atom, an oxygen atom or a nitrogen atom.

Specific examples of the heterocyclic groups to be used include a pyridyl group, an imidazolyl group, a furyl group, a pyrazolyl group, an oxazolyl group, a thiazolyl group, a thiadiazolyl group, a triazolyl group, a diazolidinyl group, or a diadinyl group, etc.

Examples of the substituents for the substituted aliphatic group, aromatic group or heterocyclic group include a halogen atom, a nitro group, an alkoxy group having from 1 to 10 carbon atoms, an aryloxy group having from 6 to 10 carbon atoms, an alkanesulfonyl group having from 1 to 10 carbon atoms, an arylsulfonyl group having from 6 to 10 carbon atoms, an alkanamido group having from 1 to 10 carbon atoms, an anilino group, a benzamido group, a carbamoyl group, an alkyl carbamoyl group having from 1 to 10 carbon atoms, an aryl carbamoyl group having from 6 to 10 carbon atoms, an alkylsulfonamido group having from 1 to 10 carbon atoms, an arylsulfonamido group having from 6 to 10 carbon atoms, an alkylthio group having from 1 to 10 carbon atoms, an arylthio group having from 6 to 10 carbon atoms, a phthalimido group, a succinimido group, an imidazolyl group, a 1,2,4-triazolyl group, a pyrazolyl group, a benzotriazole group, a furyl group, a benzothiazolyl group, an alkylamino group having from 1 to 10 carbon atoms, an alkanoyl group having from 1 to 10 carbon atoms, a benzoyl group, an alkanoyloxy group having from 1 to 10 carbon atoms, a benzoyloxy group, a perfluoroalkyl group having from 1 to 5 carbon atoms, a cyano group, a tetrazolyl group, a hydroxy group, a mercapto group, an amino group, an alkylsulfamoyl group having from 1 to 10 carbon atoms, an arylsulfamoyl group having from 6 to 10 carbon atoms, a morpholino group, an aryl group having from 6 to 10 carbon atoms, a pyrrolidinyl group, a ureido group, a urethane group, an alkoxy carbonyl group having from 1 to 10 carbon atoms, an aryloxy carbonyl group having from 6 to 10 carbon atoms, an imidazolidinyl group, or an alkylidenamino group having from 1 to 10 carbon atoms, etc.

Specific examples of the primary compounds used in the present invention are set forth below, but the present invention should not be constured as being limited thereto.

(1)

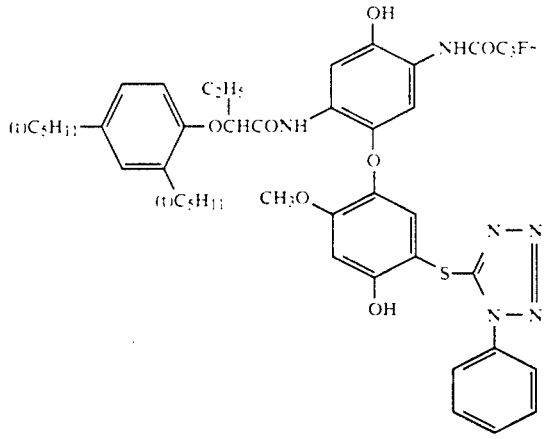

(2)

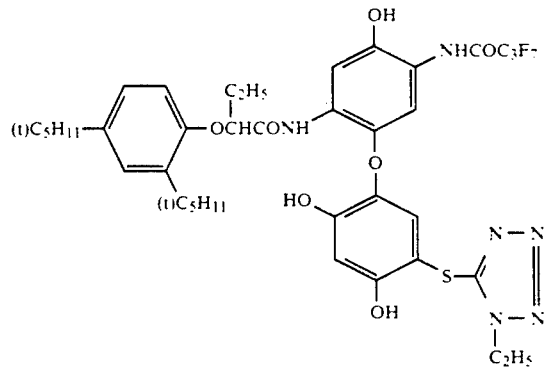

-continued
(3)
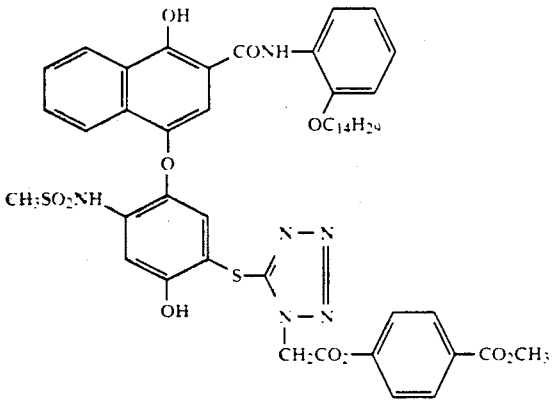
(4)
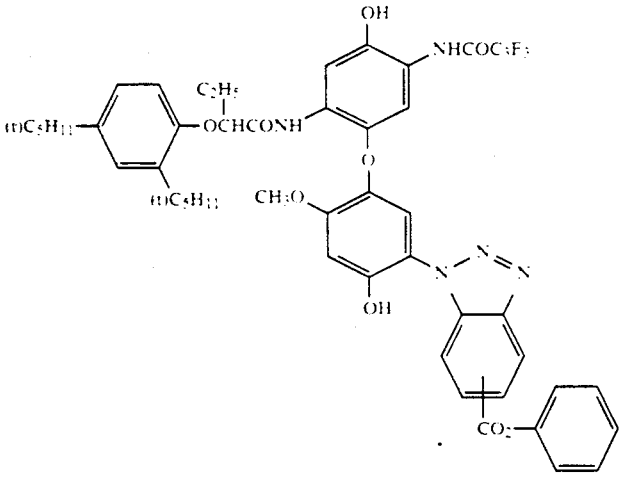
(5)
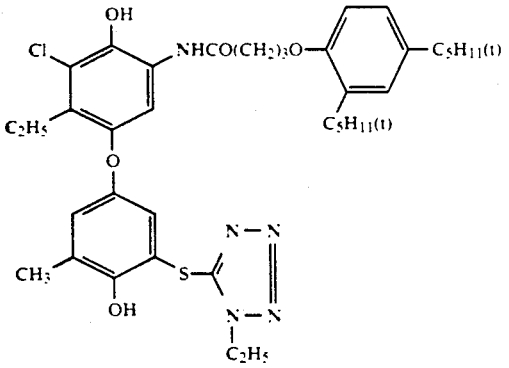

-continued
(6)
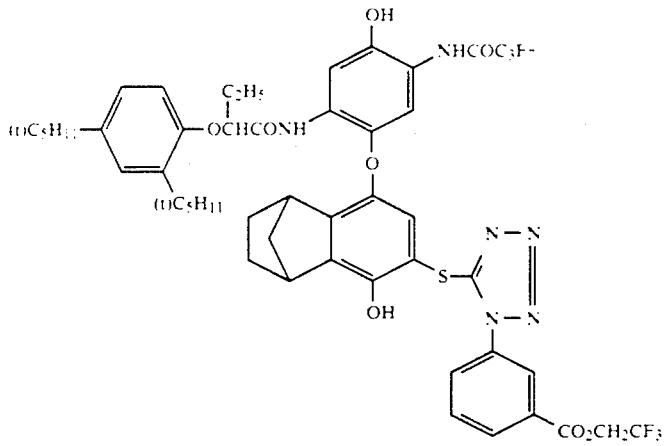
(7)
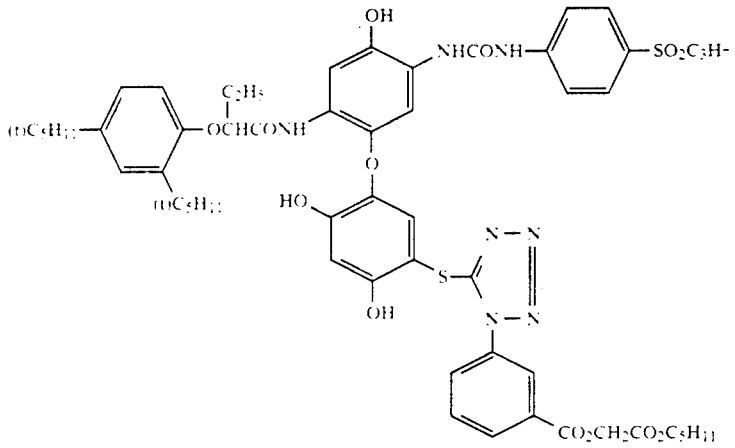
(8)
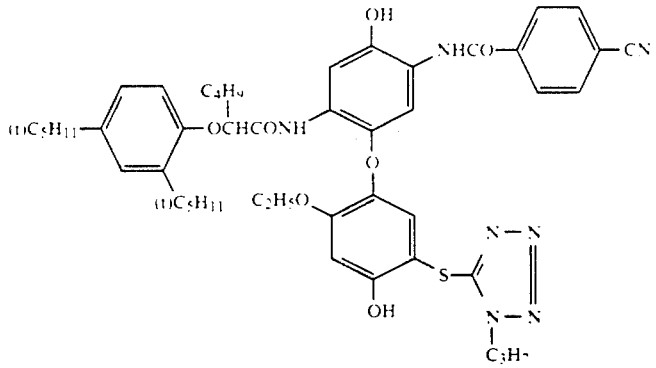
(9)
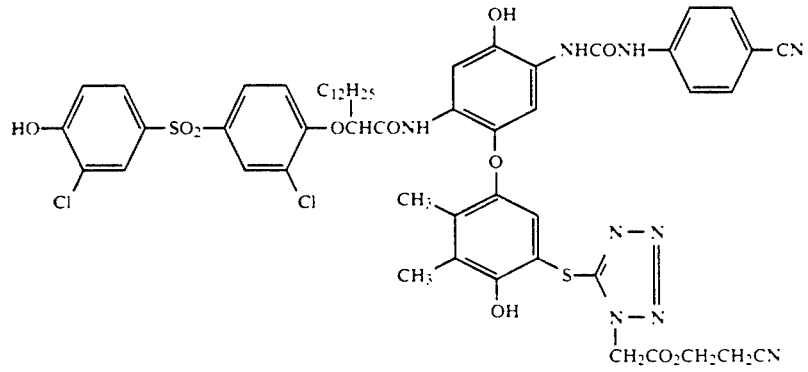

-continued
(10)
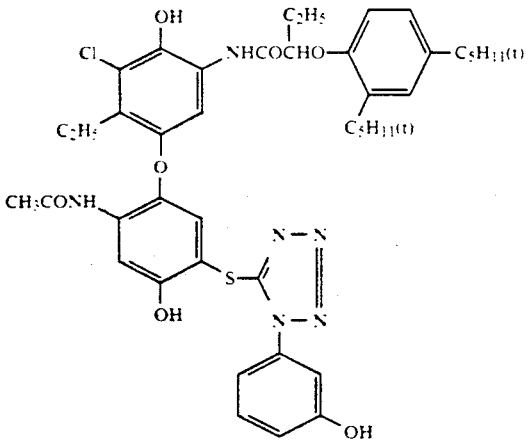
(11)
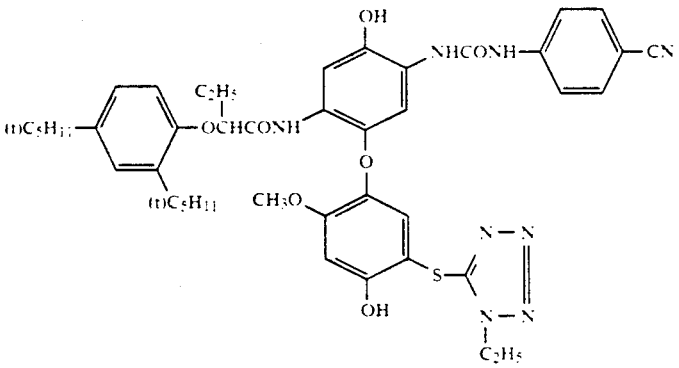
(12)
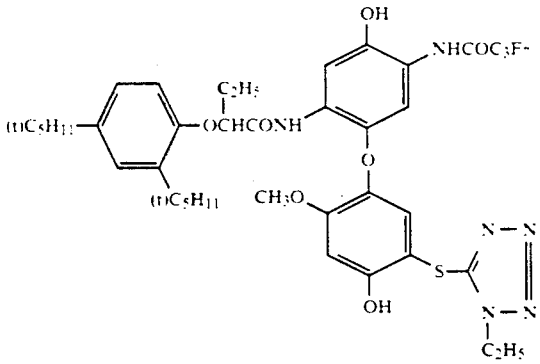
(13)
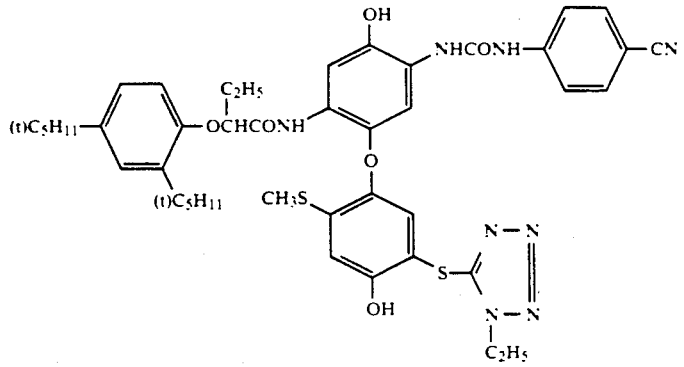

-continued
(14)
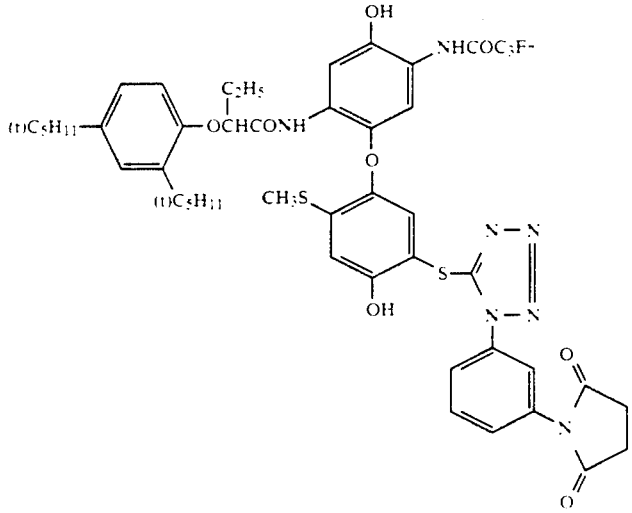
(15)
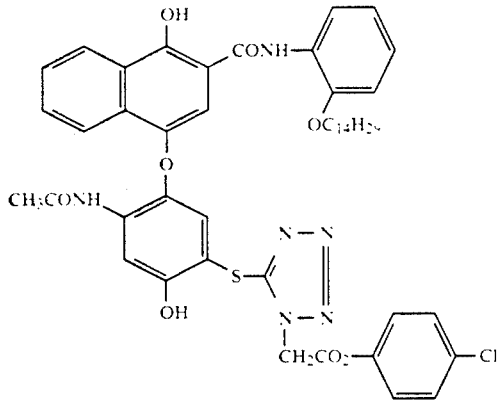
(16)
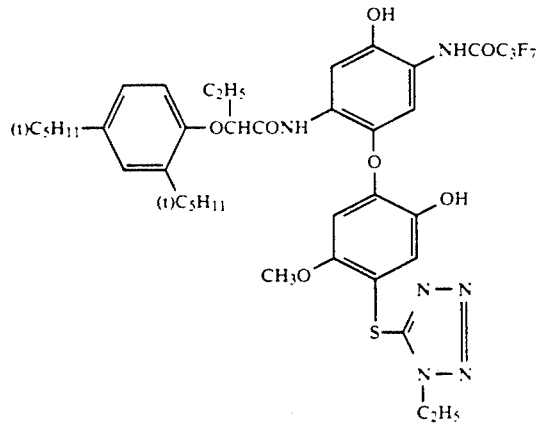

-continued
(17)
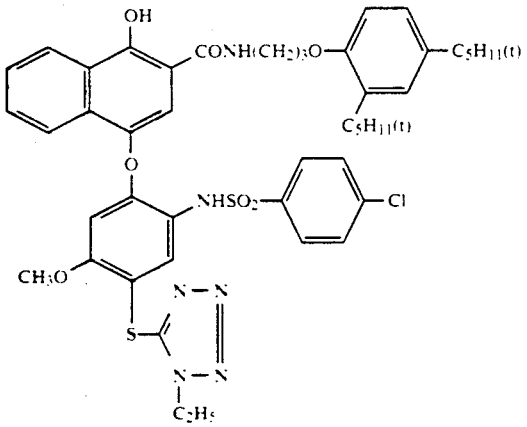
(18)
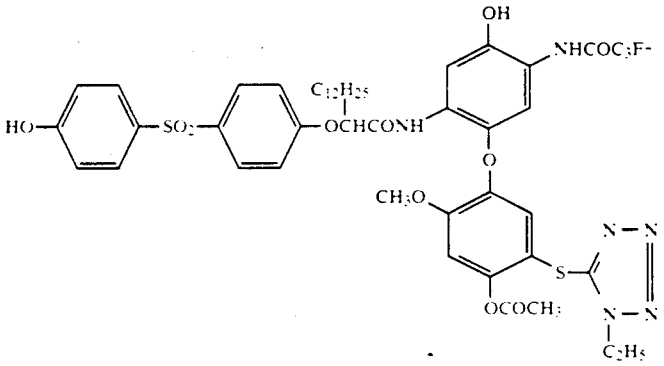
(19)
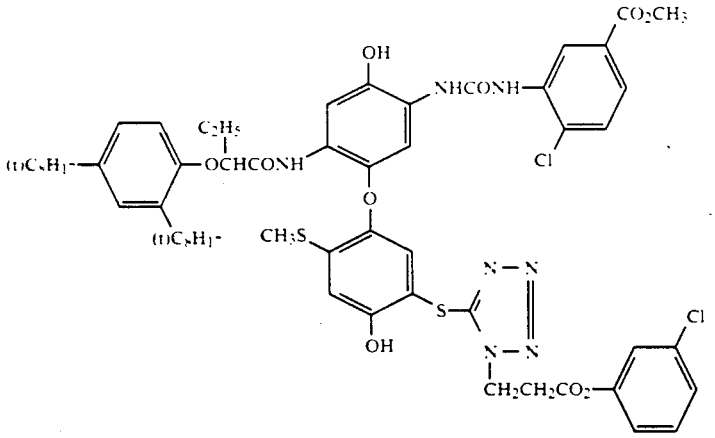
(20)
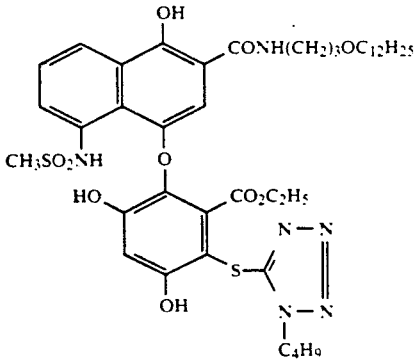

-continued
(21)
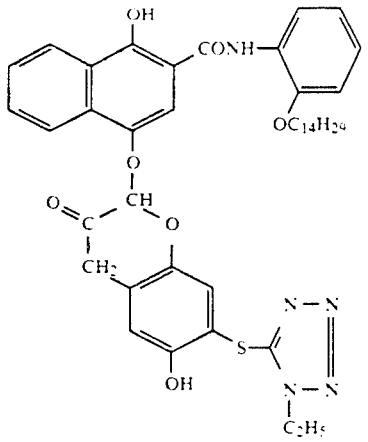
(22)
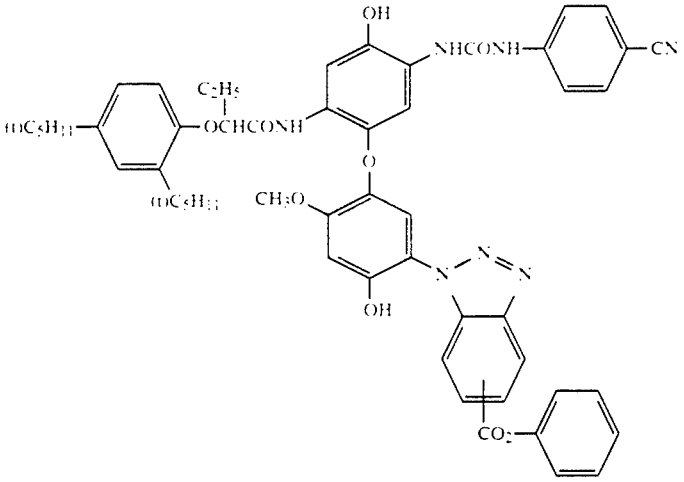
(23)
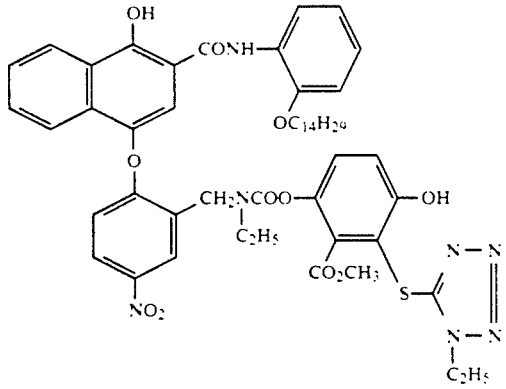

-continued
(24)
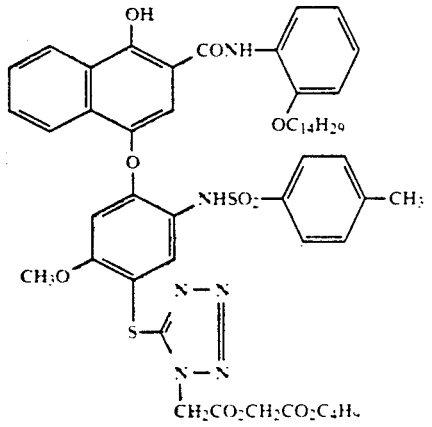
(25)
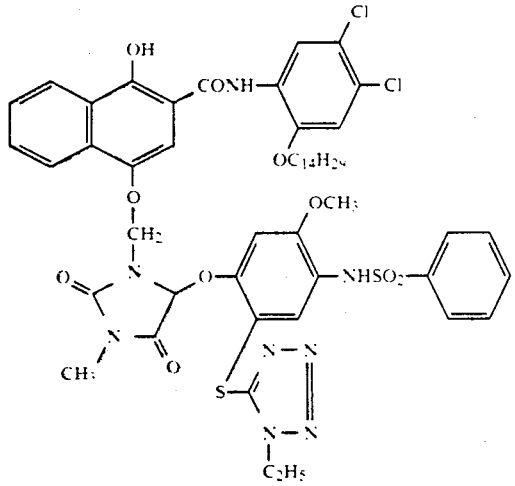
(26)
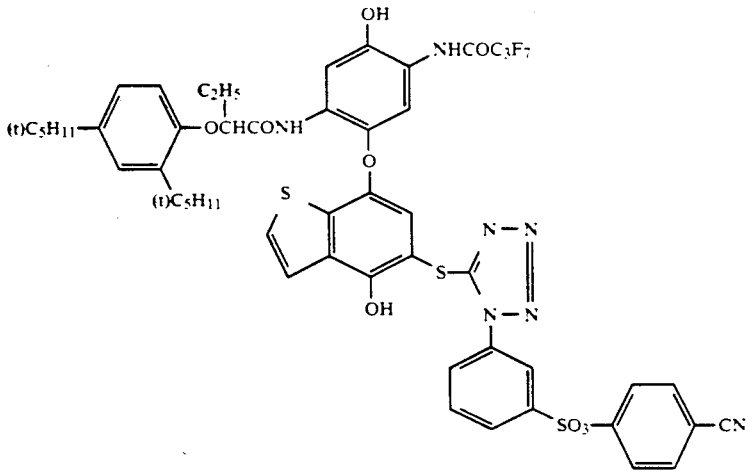

-continued
(27)
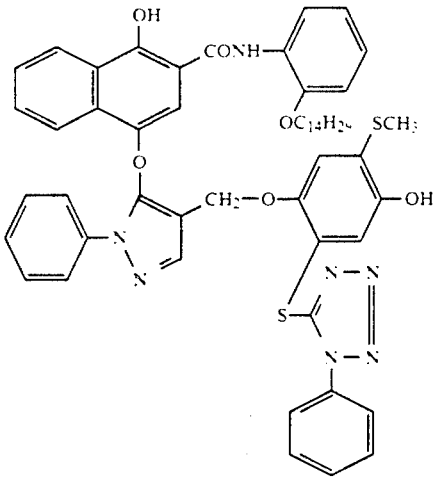
(28)
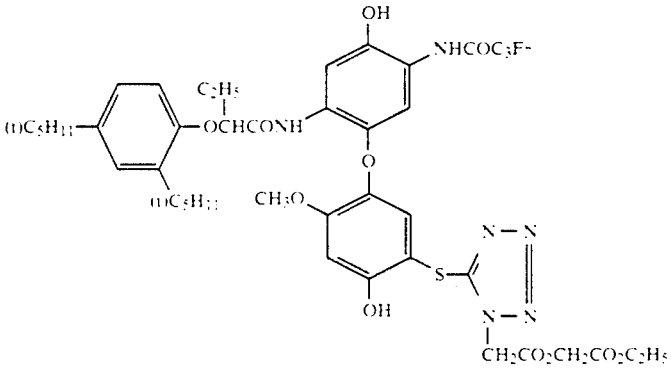
(29)
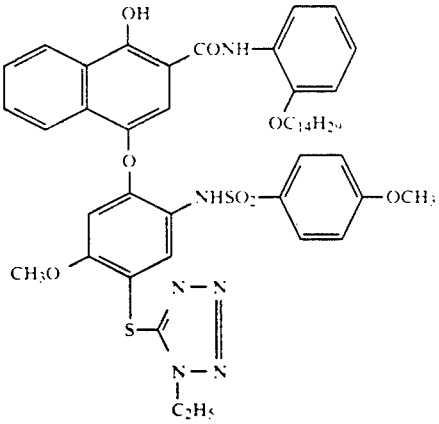

-continued
(30)
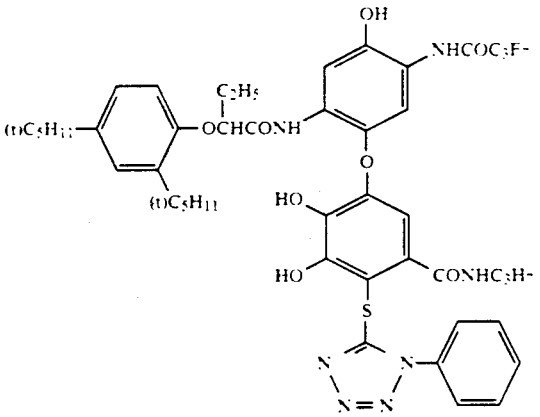
(31)
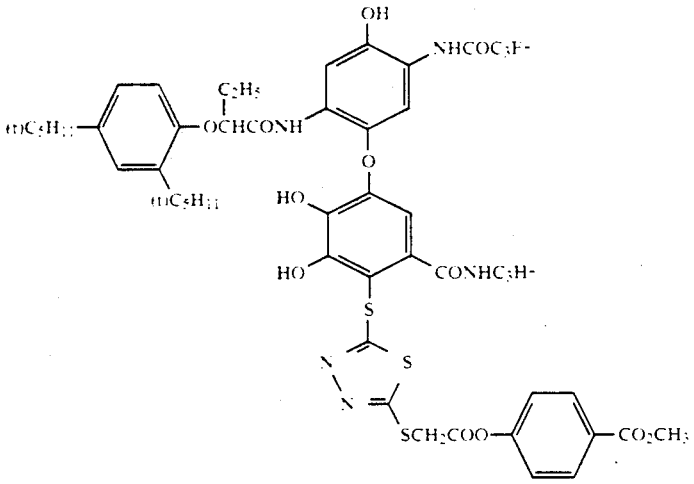
(32)
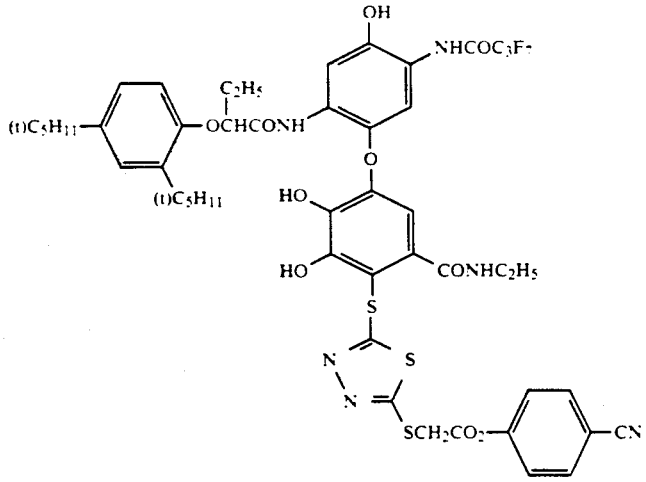

-continued
(33)
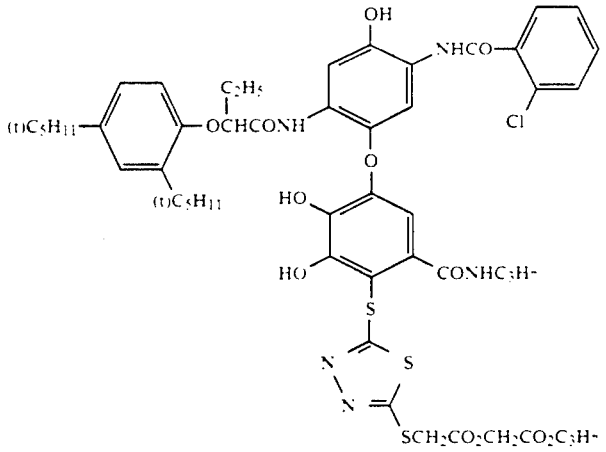
(34)
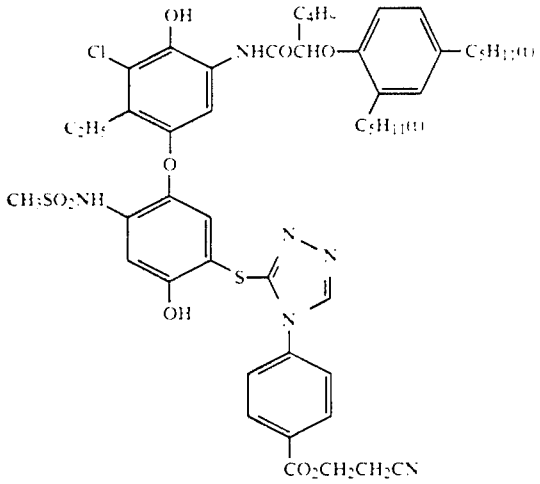
(35)
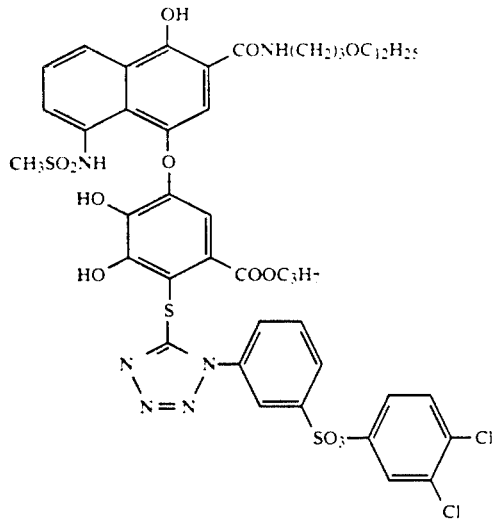

-continued
(36)
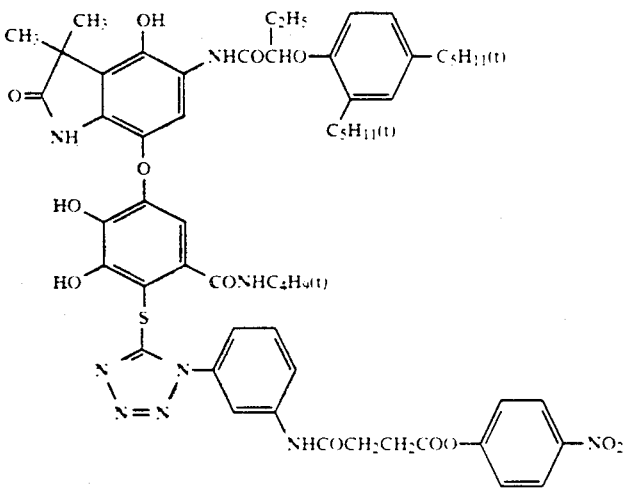
(37)
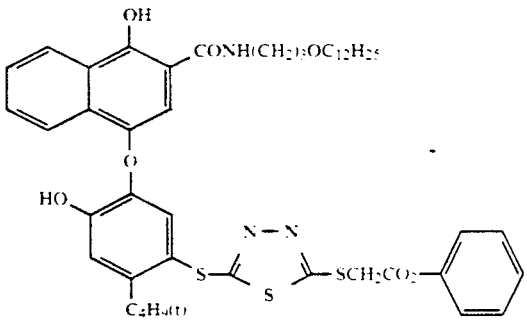
(38)
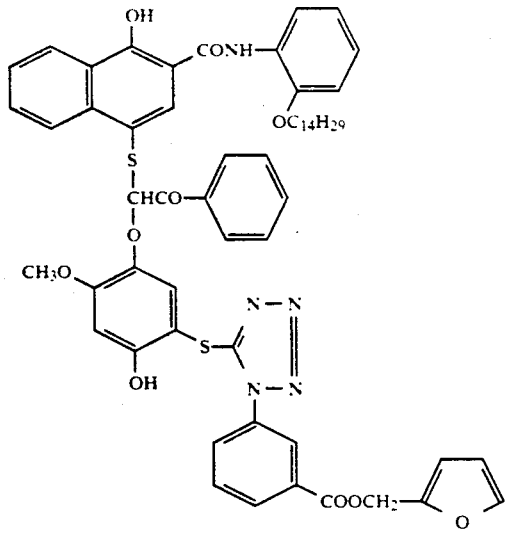

-continued
(39)
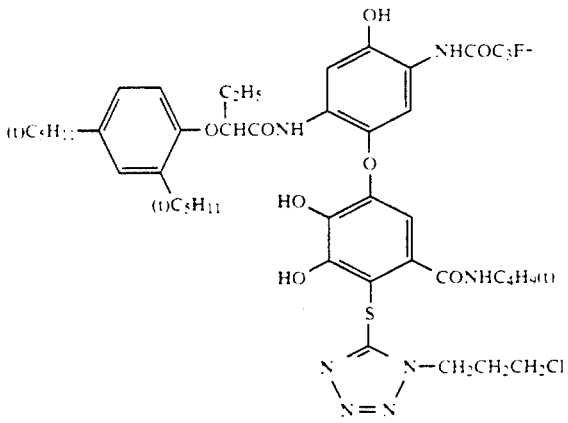
(40)
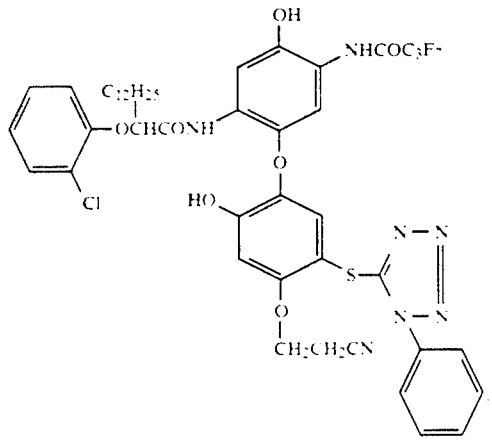
(41)
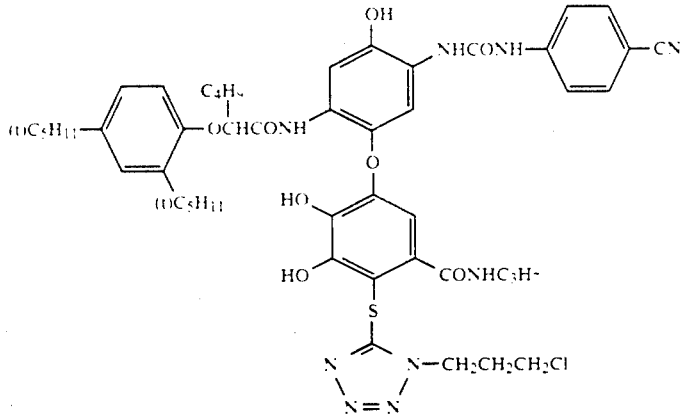
(42)
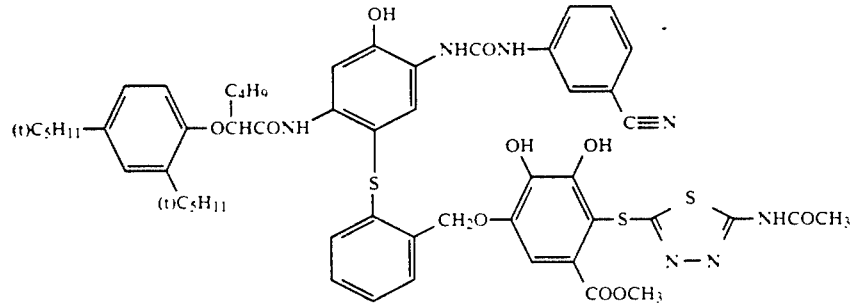

-continued
(43)
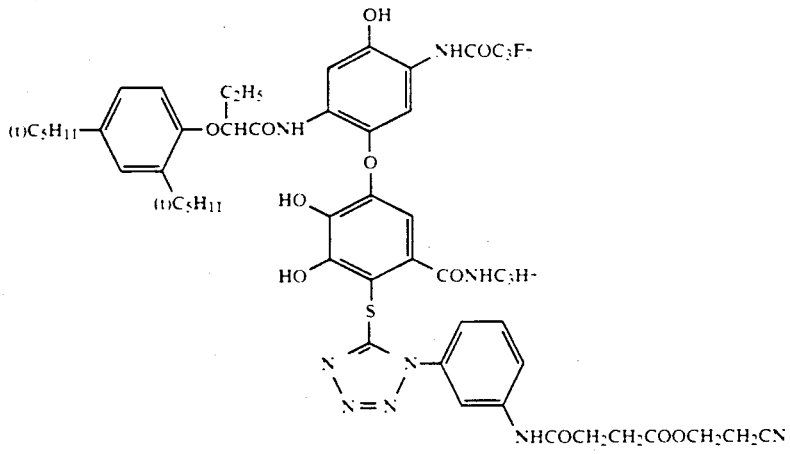
(44)
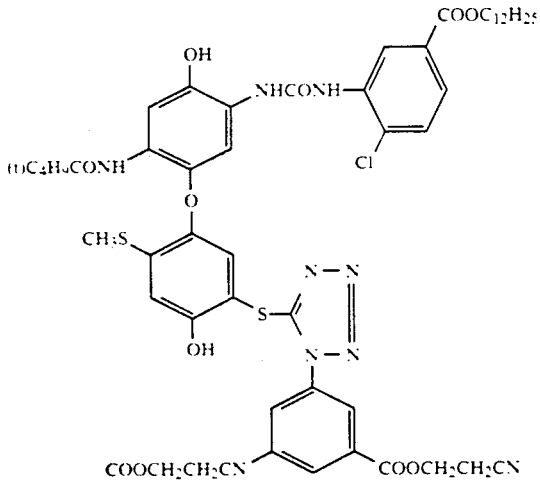
(45)
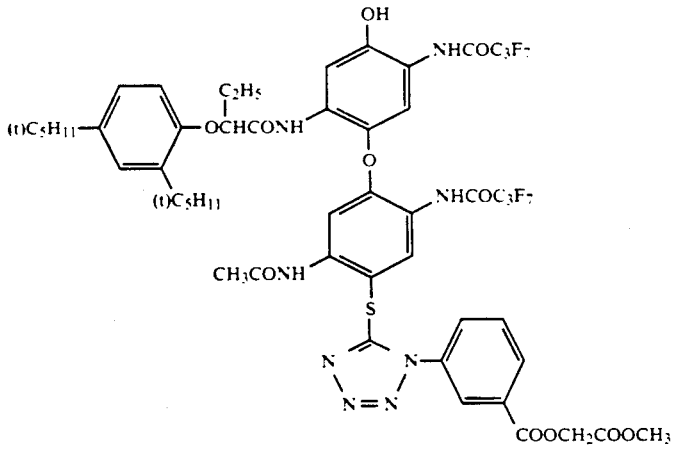

-continued
(46)
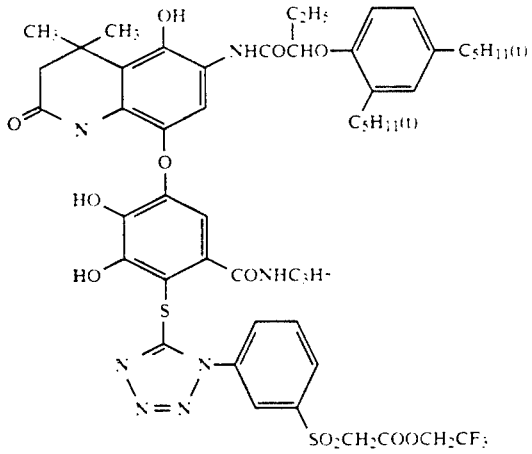
(47)
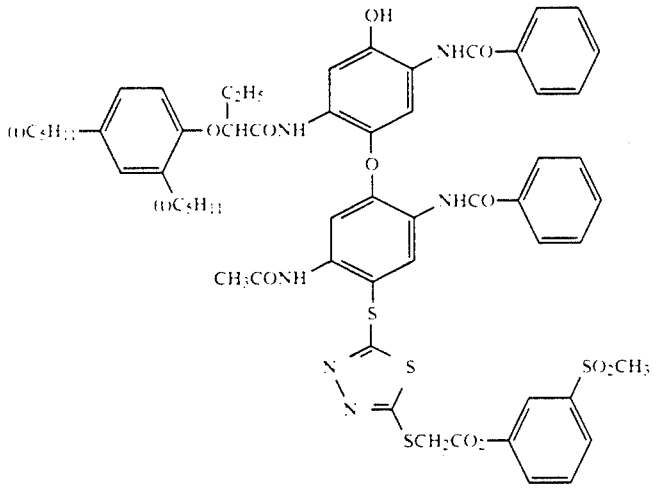
(48)
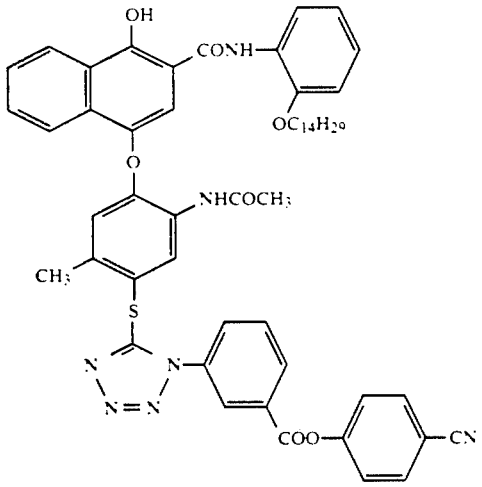

-continued
(49)
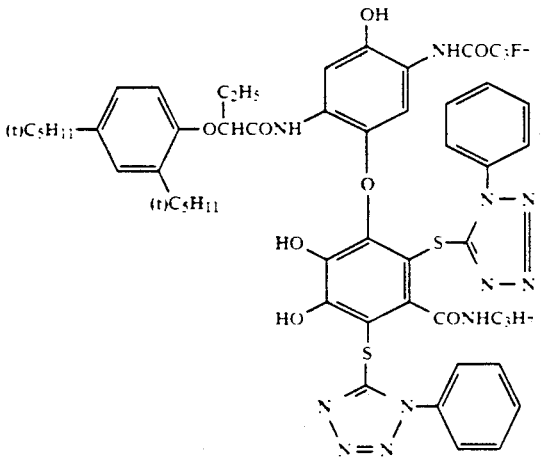
(50)
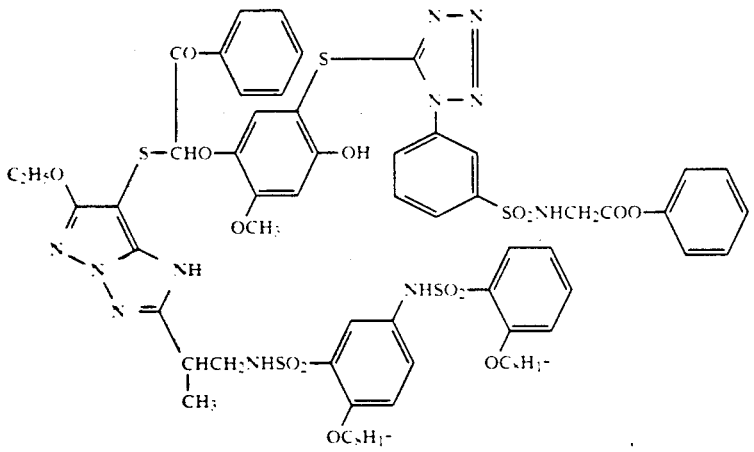
(51)
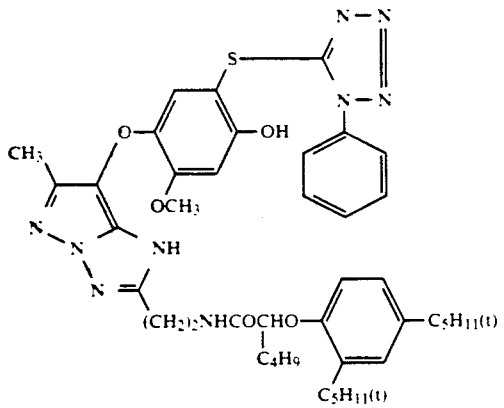

-continued
(52)
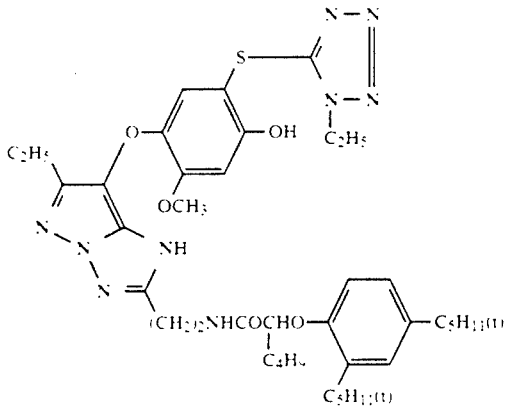
(53)
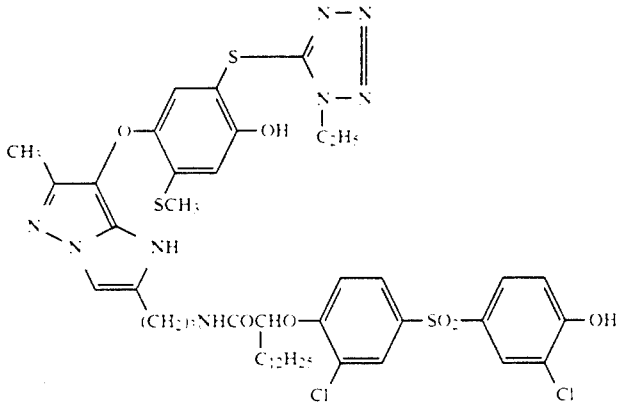
(54)
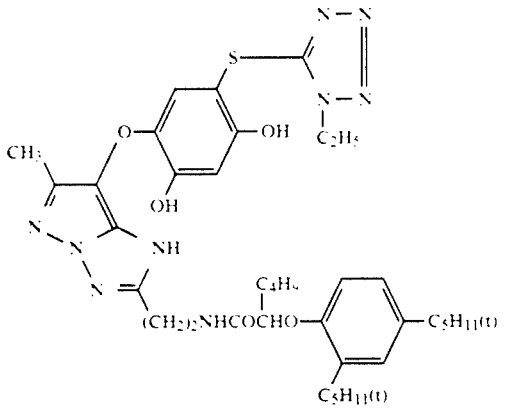
(55)
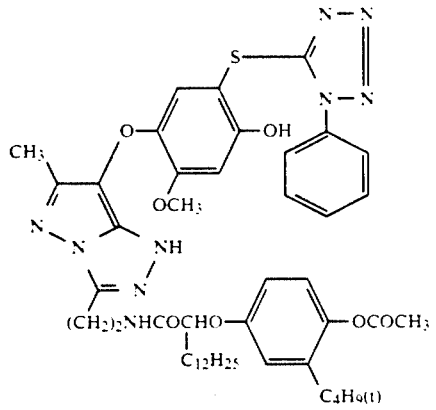

-continued
(56)
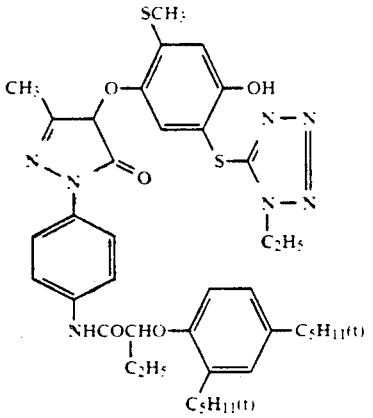
(57)
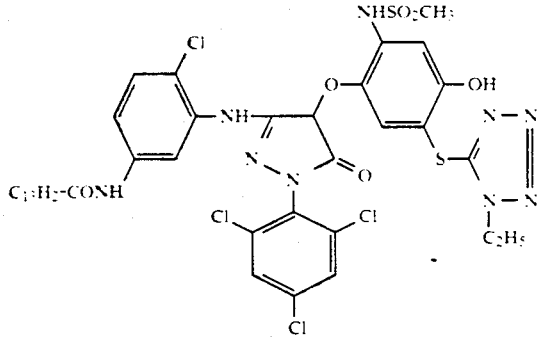
(58)
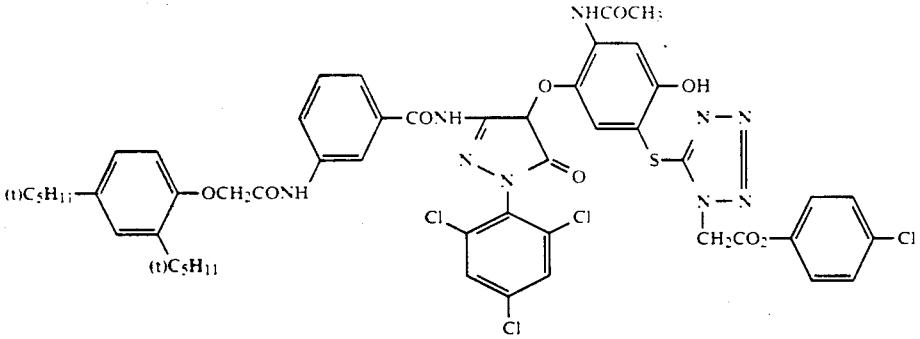
(59)
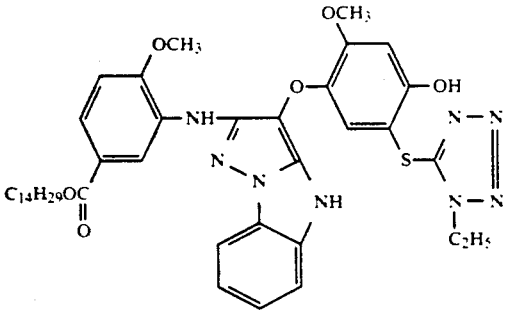

-continued
(60)
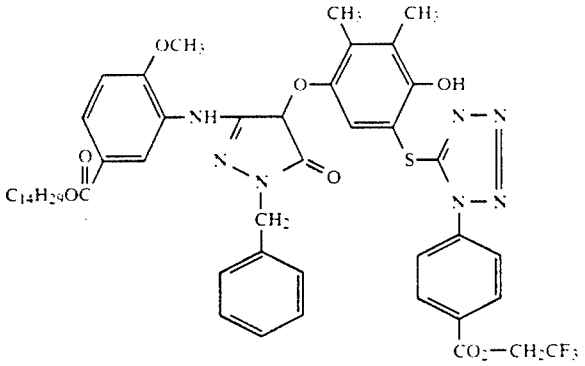
(61)
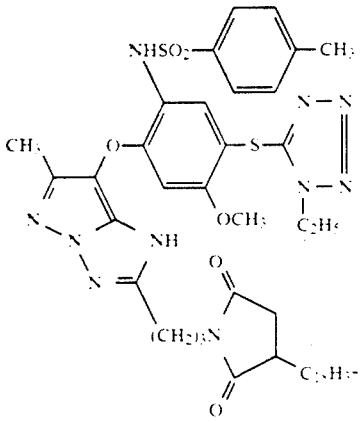
(62)
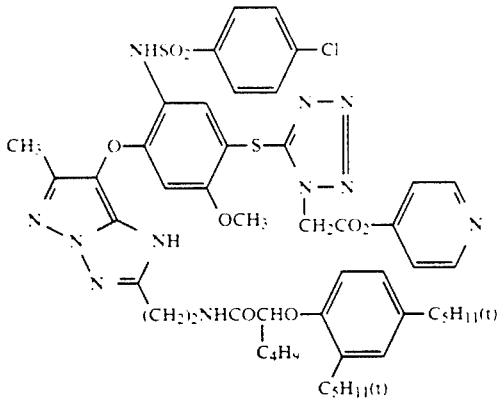
(63)
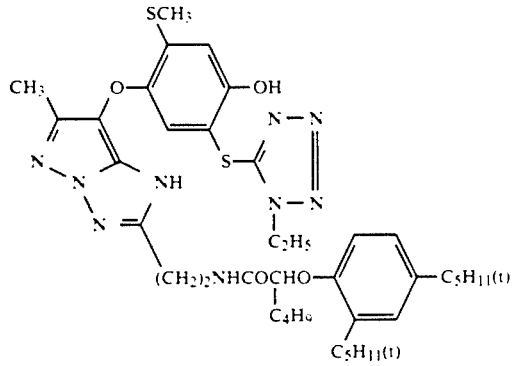

-continued
(64)
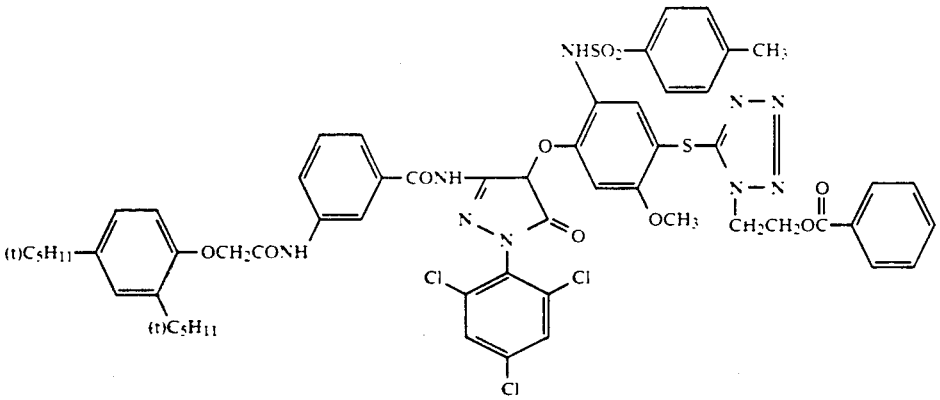
(65)
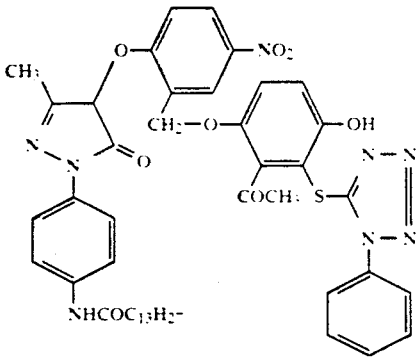
(66)
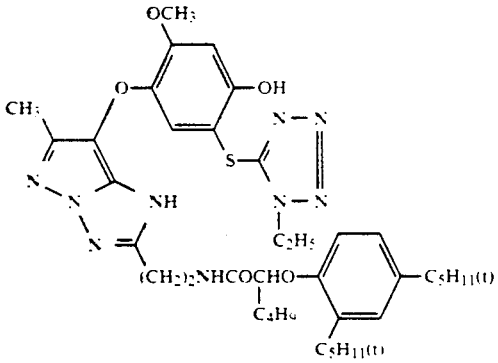
(67)
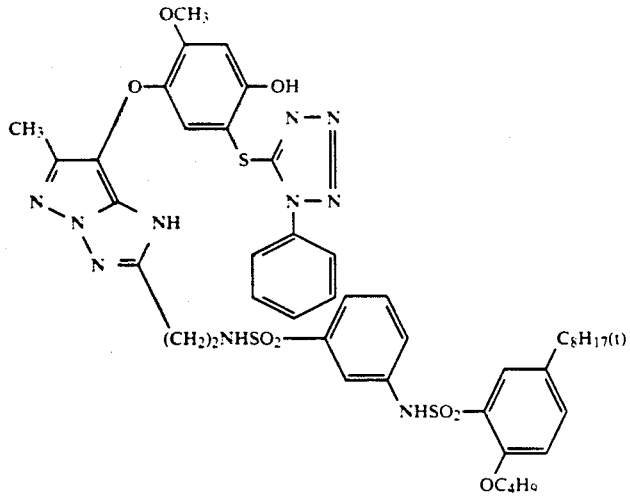

-continued
(68)
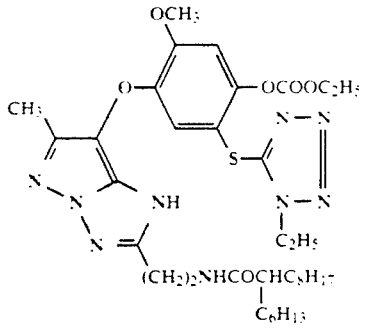
(69)
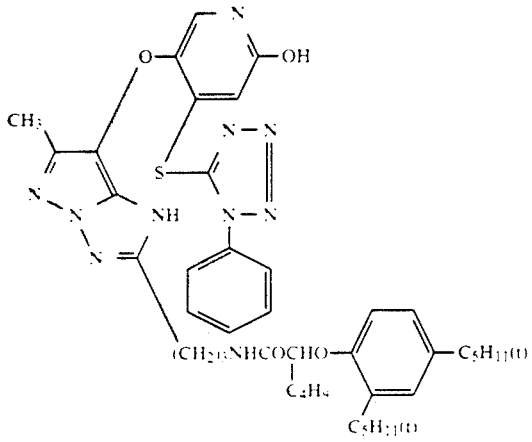
(70)
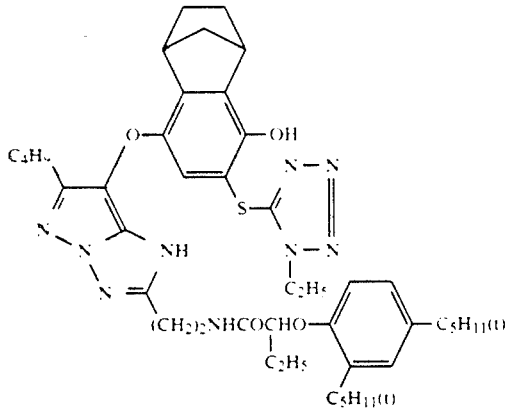
(71)
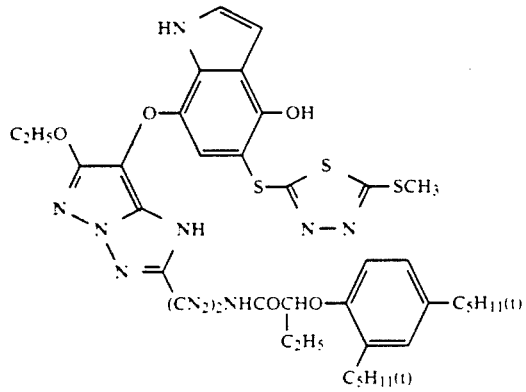

-continued
(72)
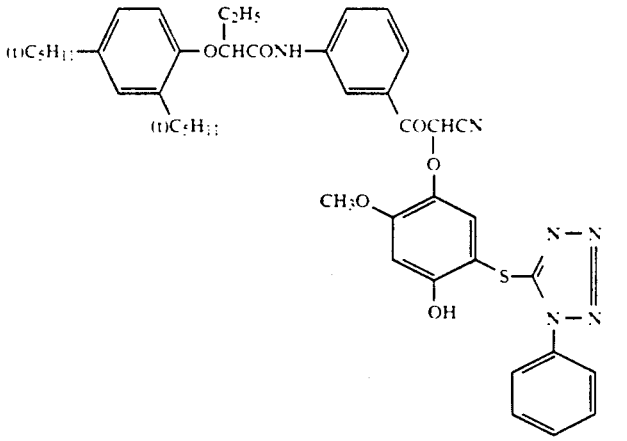
(73)
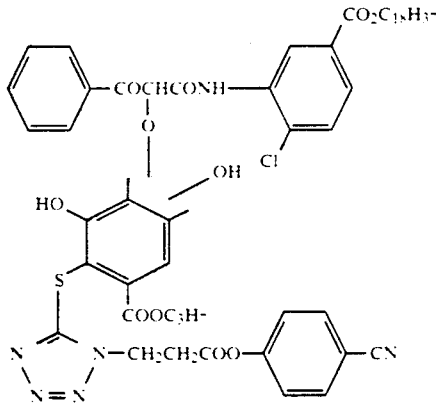
(74)
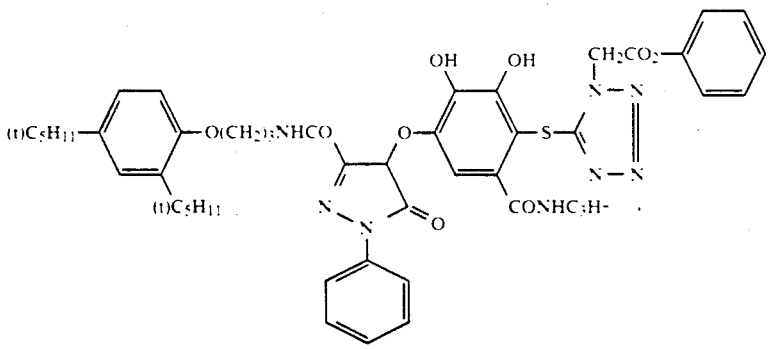
(75)
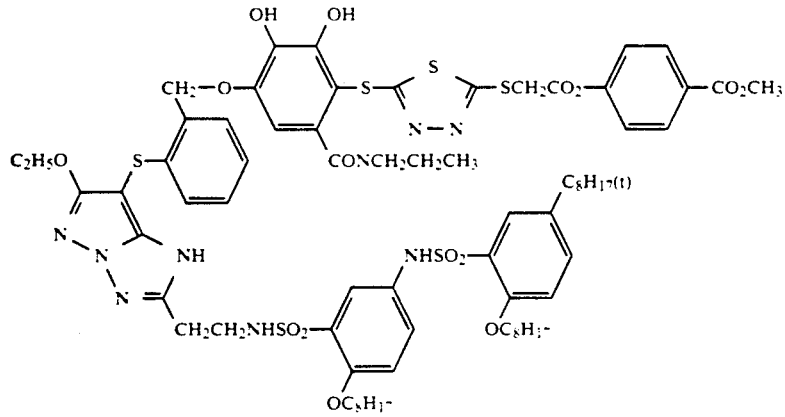

-continued
(76)
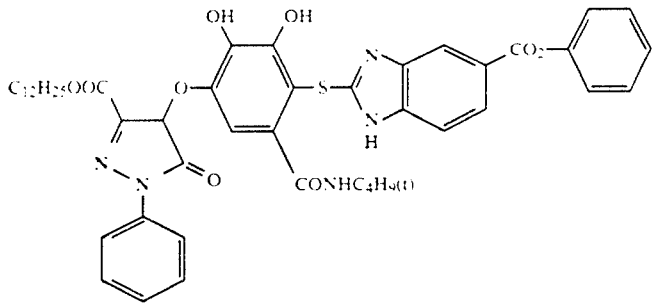
(77)
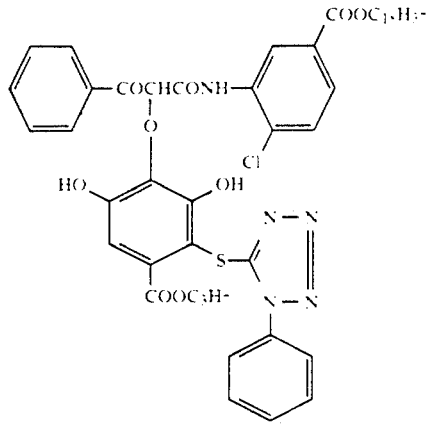
(78)
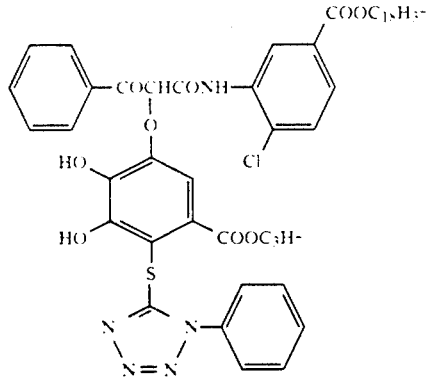
(79)
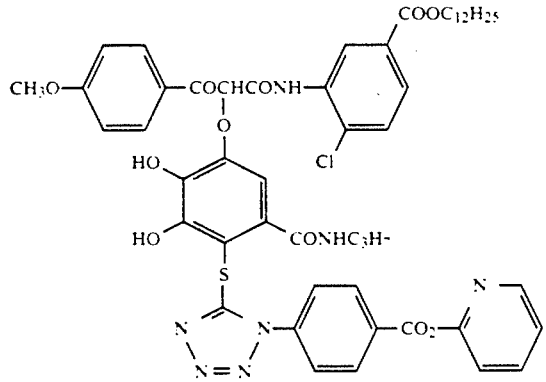

-continued
(80)
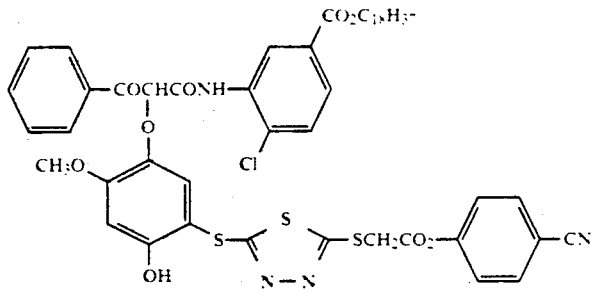
(81)
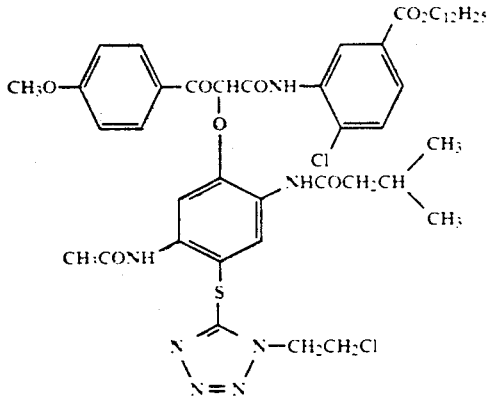
(82)
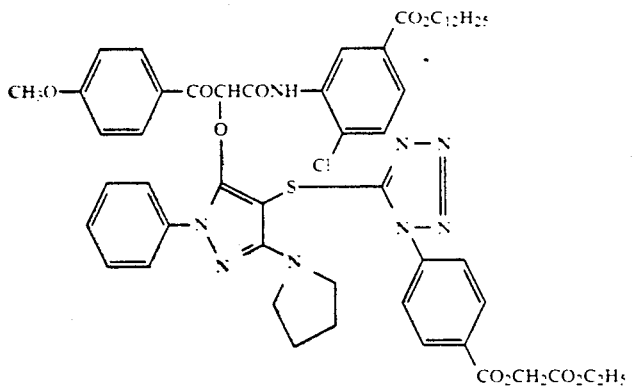
(83)
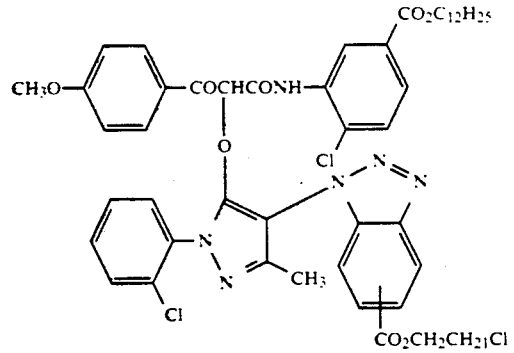

-continued
(84)
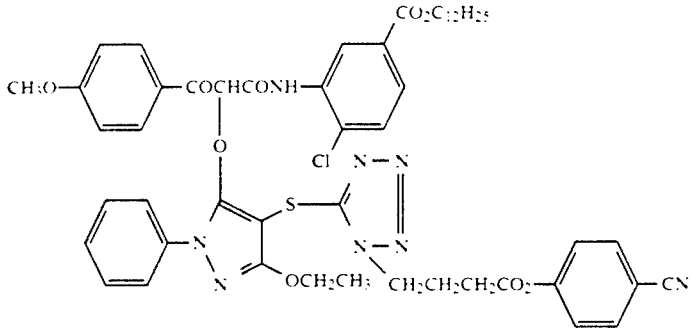
(85)
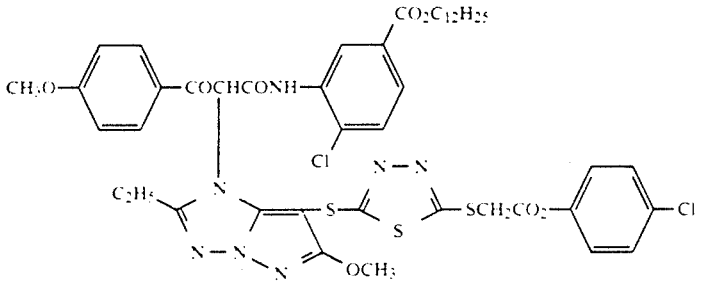
(86)
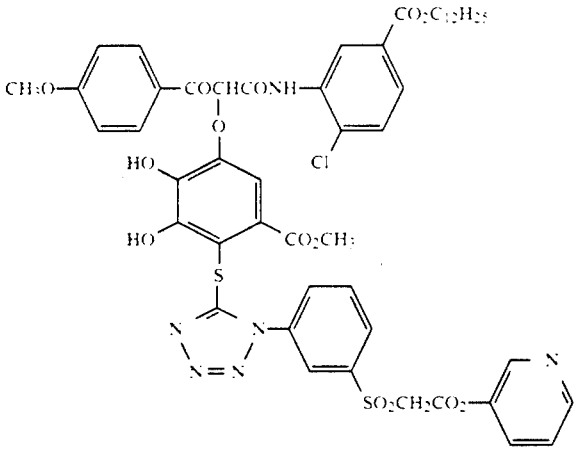
(87)
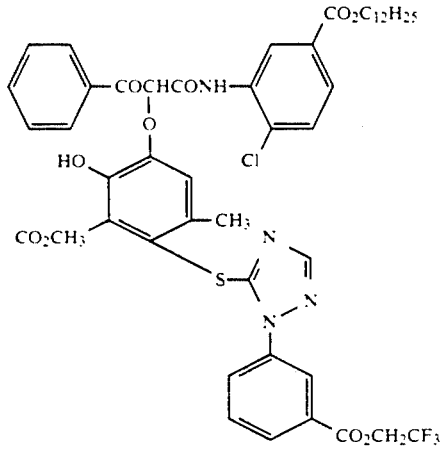

-continued
(88)
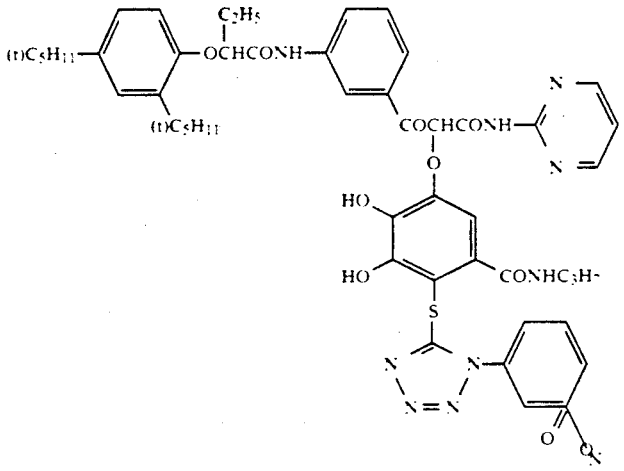
(89)
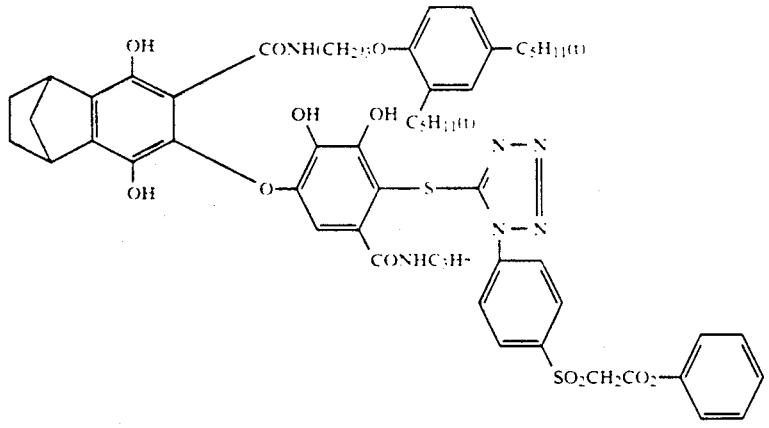
(90)
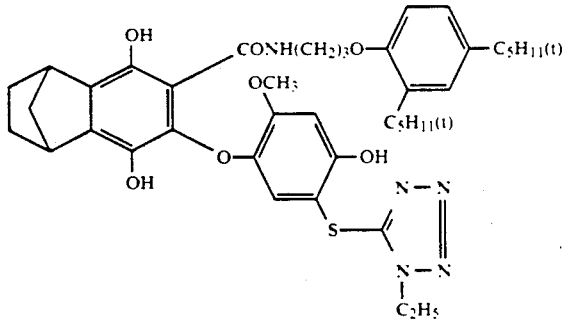

-continued
(91)
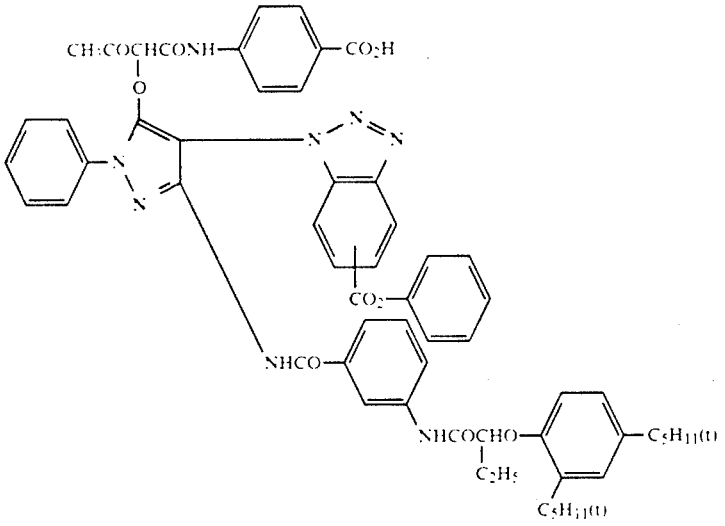
(92)
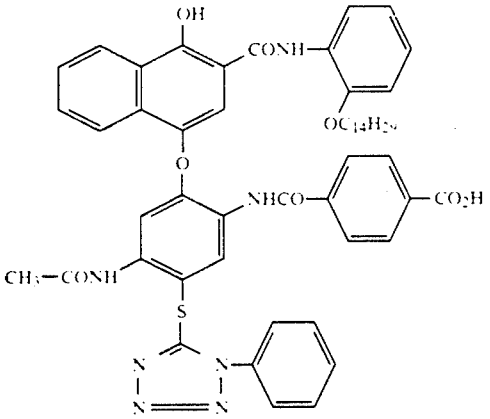
(93)
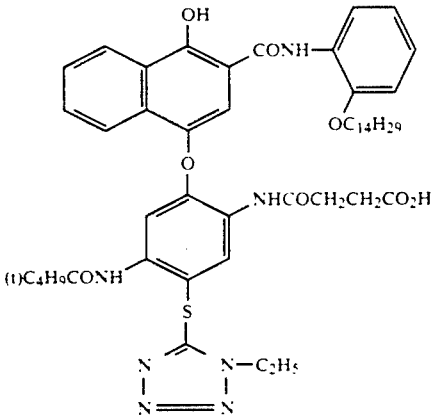

-continued
(94)
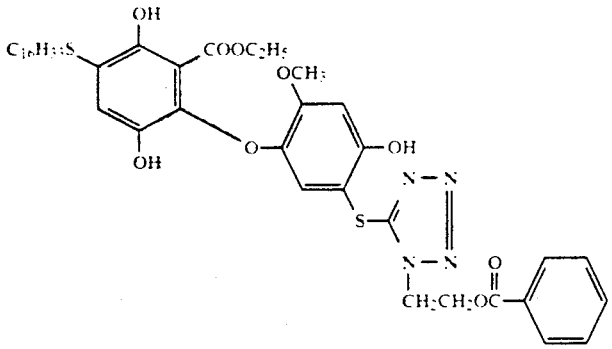
(95)
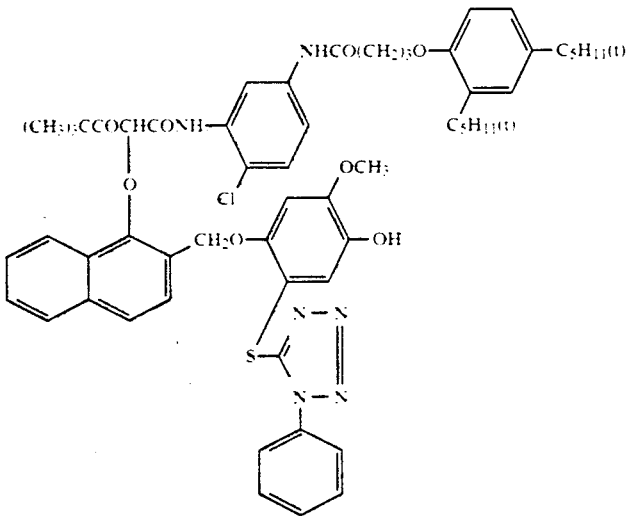
(96)
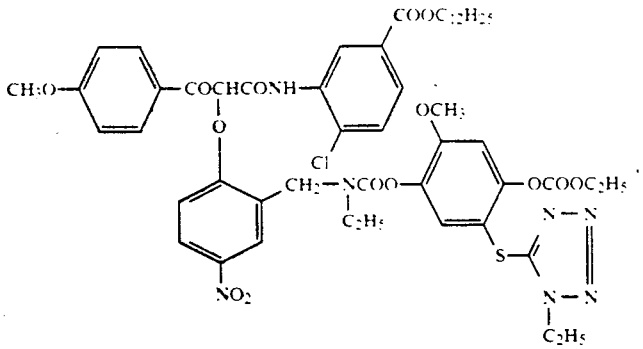
(97)
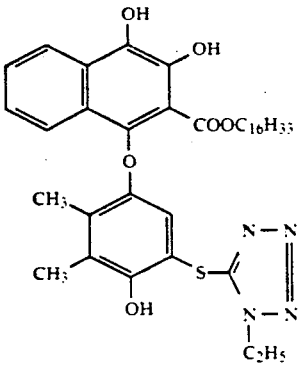

-continued
(98)
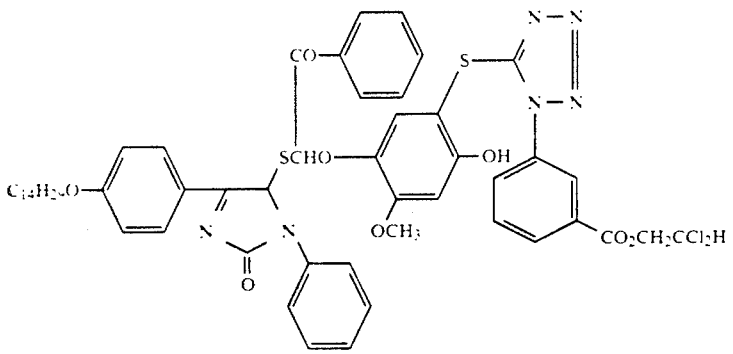
(99)
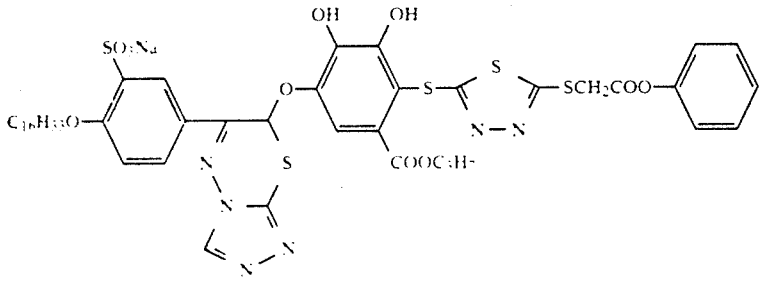
(100)
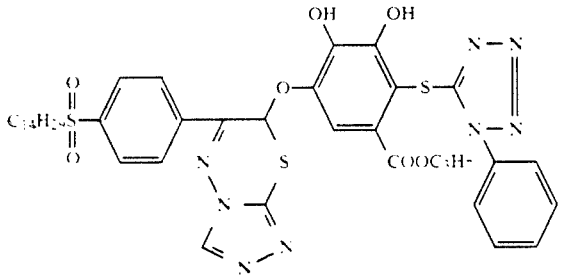
(101)
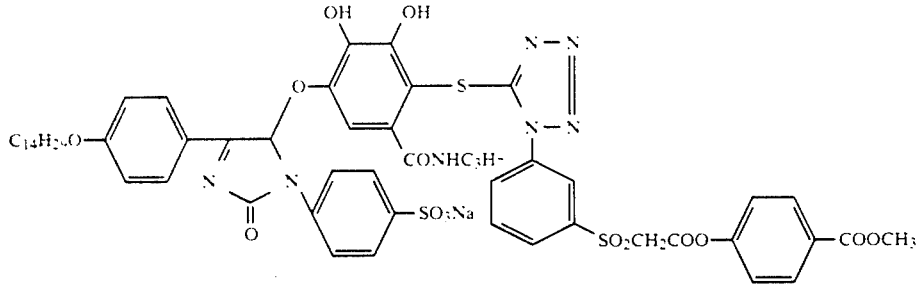
(102)
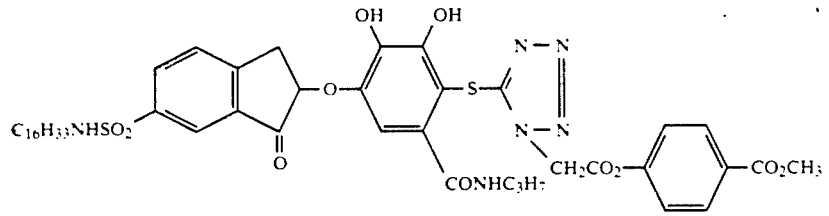
(103)
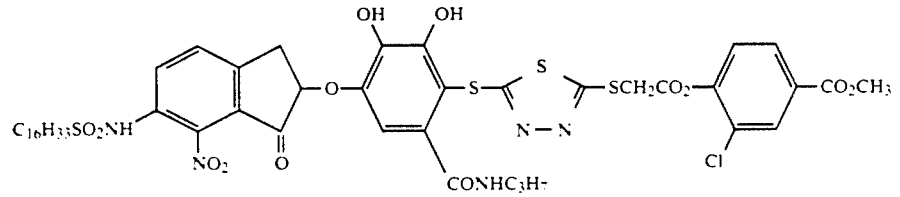

-continued
(104)
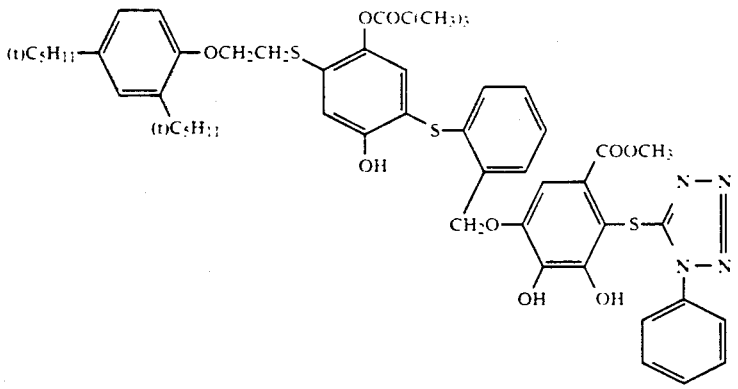
(105)
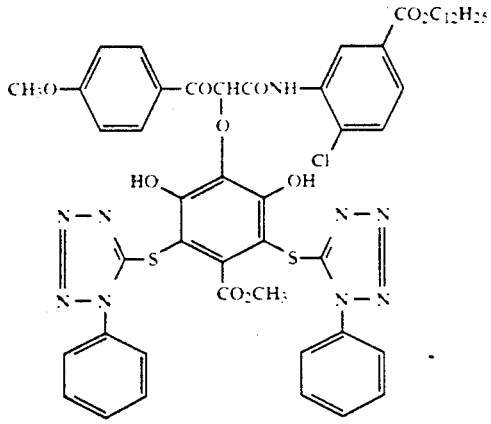
(106)
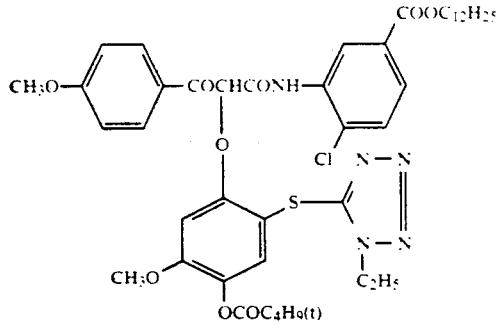
(107)
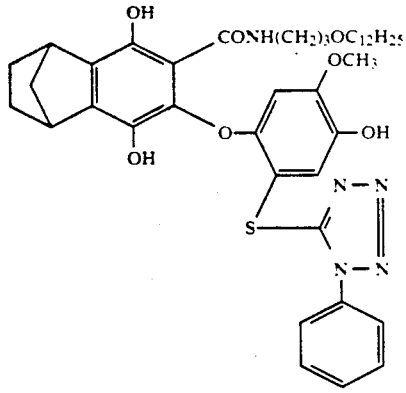

-continued
(108)
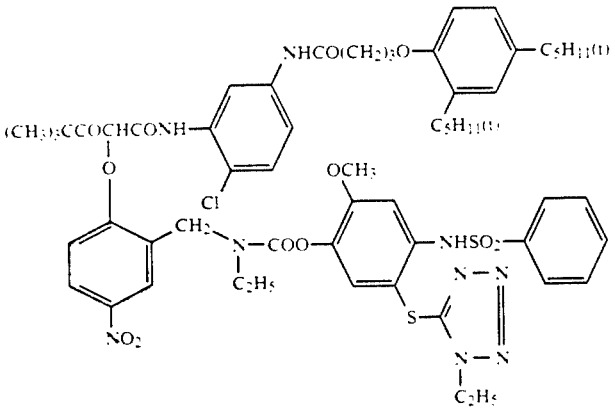
(109)
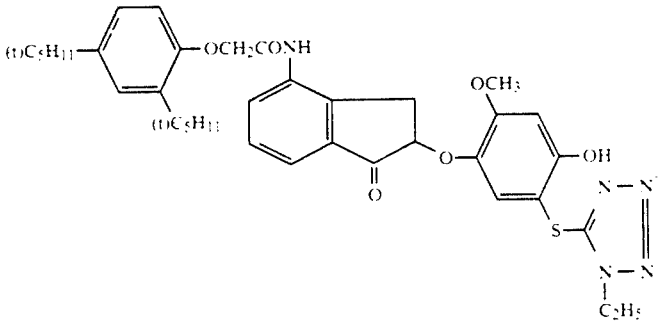
(110)
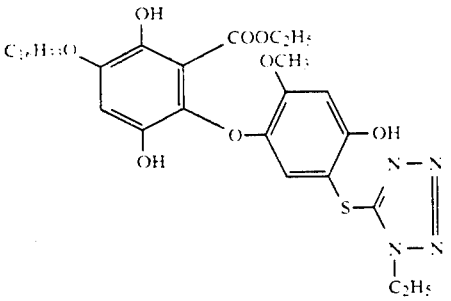
(111)
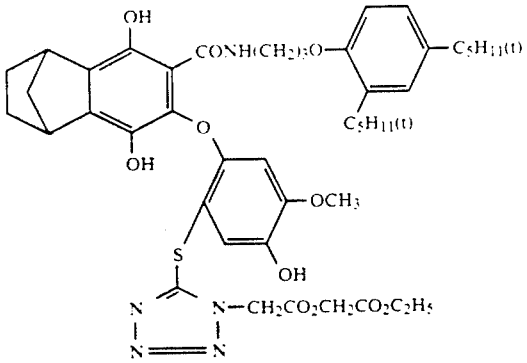
Typical synthesis examples of the compounds according to the present invention are illustrated below, and other compounds can be synthesized in a similar manner.

SYNTHESIS EXAMPLE 1
Synthesis of Compound (1)
Compound (1) was synthesized according to the route schematically shown below.
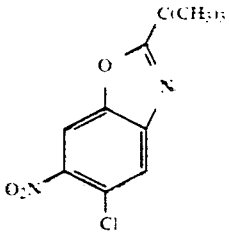
1
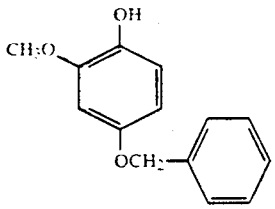
2
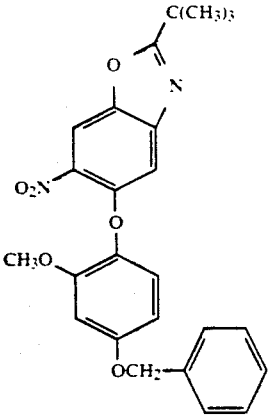
3
-continued
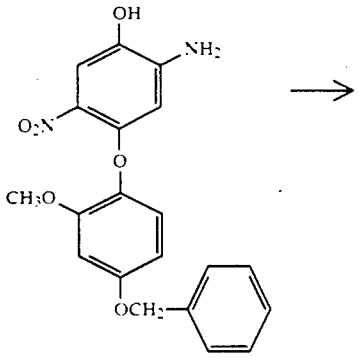
4
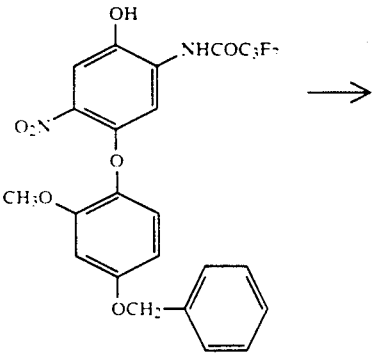
5
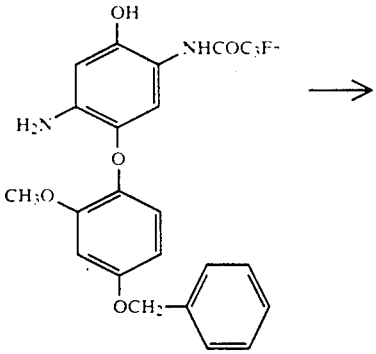
6
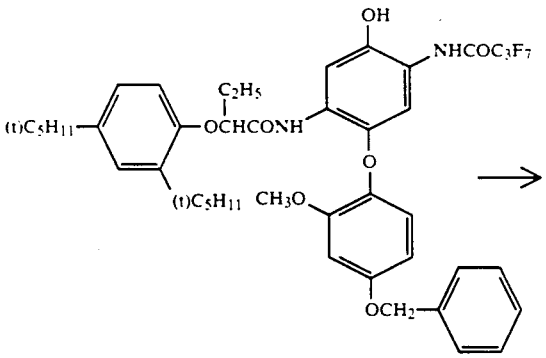
7

-continued

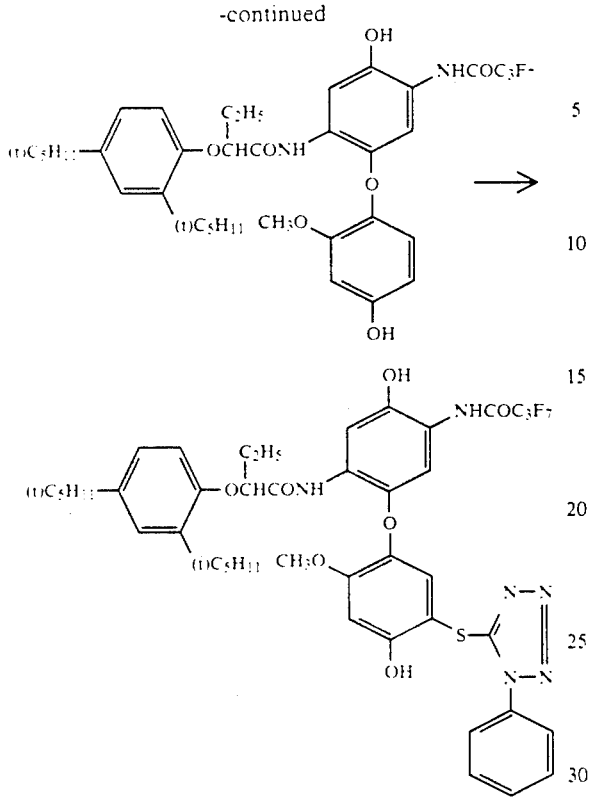

Compound (1)

Typical synthesis examples of the compounds according to the present invention are illustrated below, and other compounds can be synthesized in a similar manner.

SYNTHESIS EXAMPLE 1

Synthesis of Compound (1)

Compound (1) was synthesized according to the route schematically shown below.

Step (1): Synthesis of Compound 3

62 g of Compound 2, 18 g of potassium hydroxide and 10 ml of water were added to 700 ml of toluene and the mixture was refluxed by heating for 1 hour under a nitrogen atmosphere. Then, water was distilled off together with toluene as an azeotropic mixture. To the residue was added 200 ml of N,N-dimethylformamide, the mixture was heated to 100° C. to which was added 57 g of Compound 1. After being reacted at 100° C. for 1 hour, the mixture was cooled to room temperature and ethyl acetate was added thereto. The mixture was put into a separatory funnel and washed with water. The ethyl acetate layer was separated and the solvent was distilled off under a reduced pressure to obtain 53 g of an oily residue containing Compound 3 as the main component.

Step (2): Synthesis of Compound 4

53 g of Compound 3 obtained in Step (1) was dissolved in a solvent mixture of 400 ml of ethanol and 120 ml of water and 40 g of potassium hydroxide was added thereto. After refluxing by heating for 4 hours, the mixture was neutralized with hydrochloric acid and then separately extracted using ethyl acetate and water. The ethyl acetate layer was separated and the solvent was distilled off under a reduced pressure to obtain 43 g of an oily product containing Compound 4 as the main component.

Step (3): Synthesis of Compound 5

43 g of Compound 4 obtained in Step (2) was dissolved in 300 ml of ethyl acetate and to the resulting solution was added dropwise 69 g of anhydrous heptafluorobutyric acid at room temperature. After being reacted for 30 minutes, water was added to the mixture, and then was washed with water using a separatory funnel. The oil layer was separated and the solvent was distilled off. The residue was treated with column chromatography in order to separate and purify the desired compound. Silica gel was used as a packing material and 2.5% ethanol was used as an eluent. 47 g of Compound 5 was obtained as the oil product.

Step (4): Synthesis of Compound 6

47 g of Compound 5 obtained in Step (3), 36.3 g of iron powder and 10 ml of acetic acid were added to a solvent mixture of 40 ml of water and 400 ml of isopropanol, and the mixture was refluxed by heating for 1 hour. The reaction mixture was filtered while it was hot and the filtrate was concentrated to about half volume. The crystals thus-deposited were collected by filtration to obtain 44 g of Compound 6.

Step (5): Synthesis of Compound 7

44 g of Compound 6 obtained in Step (4) was added to 400 ml of acetonitrile and refluxed by heating. 28 g of 2-(2,4-di-tert-amylphenoxy)butanoyl chloride was added dropwise thereto, and the mixture was refluxed by heating for 30 minutes. Then, the mixture was cooled to room temperature, to which was added ethyl acetate and the mixture was washed with water using a separatory funnel. The oil layer was separated and the solvent was distilled off under a reduced pressure. The residue was recrystallized from acetonitrile to obtain 60- g of Compound 7.

Step (6): Synthesis of Compound 8

69 g of Compound 7 obtained in Step (5) was added to 500 ml of dichloromethane, and the mixture was cooled to −10° C. to which was added dropwise 34.5 g of boron tribromide. After being reacted at −5° C. or below for 20 minutes, an aqueous solution of sodium carbonate was added to the mixture until the aqueous layer showed a neutral pH. The mixture was put into a separatory funnel and washed with water. The oil layer was separated and the solvent was distilled off under a reduced pressure. The residue was recrystallized from acetonitrile to obtain 45.2 g of Compound 8.

Step (7): Synthesis of Compound (1)

45.2 g of Compound 8 obtained in Step (6) was added to 600 ml of acetonitrile and to the mixture was added dropwise 100 ml of a chloroform solution containing 20.2 g of 1-phenyltetrazolyl-5-sulfenyl chloride at room temperature (25° C.). After adding ethyl acetate, the mixture was put into a separatory funnel and washed with water. The oil layer was separated and the solvent was distilled off. The residue was recrystallized from a solvent mixture of hexane and ethyl acetate to obtain 45.3 g of Compound (1).

SYNTHESIS EXAMPLE 2

Synthesis of Compound (28)

Compound (28) was synthesized in the same manner as described in Synthesis Example 1 except using 26.7 g of 1-ethoxycarbonylmethoxycarbonylmethyl-5-sulfenyl chloride in place of 20.2 g of 1-phenyltetrazolyl-5-sulfenyl chloride in Step (7). Further, the solvent for crystallization was changed to a solvent mixture of hexane and chloroform to obtain 40.1 g of Compound (28).

SYNTHESIS EXAMPLE 3

Synthesis of Compound (30)

Compound (30) was synthesized according to the route schematically shown below.

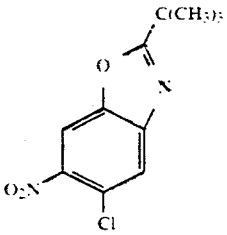

1

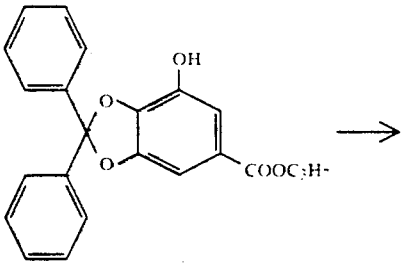

9

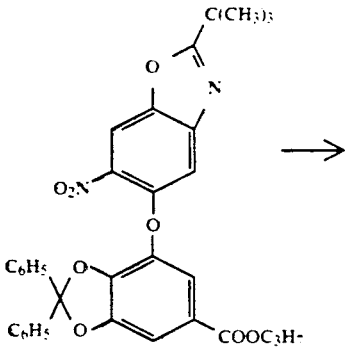

10

-continued

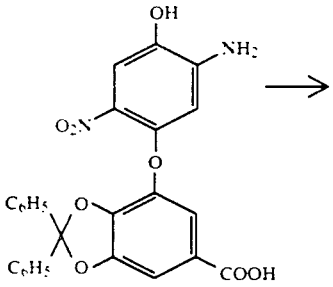

11

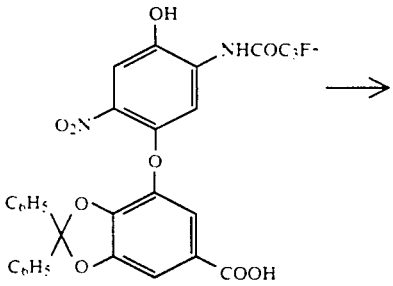

12

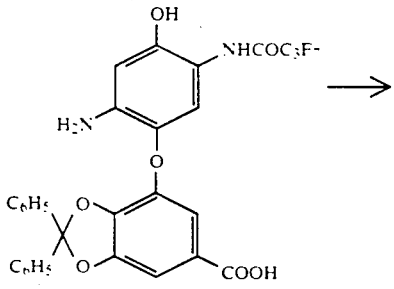

13

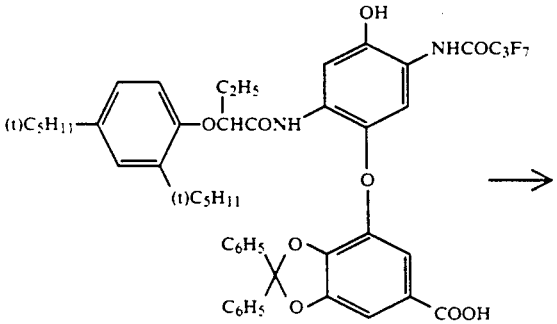

14

-continued

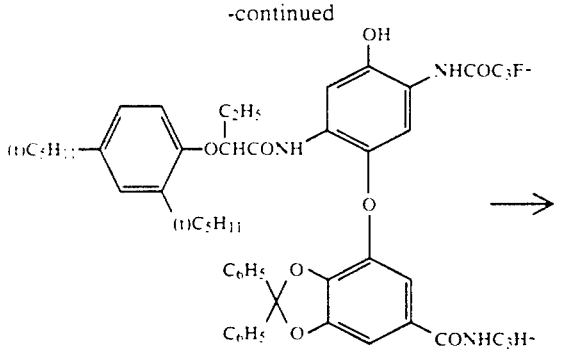

15

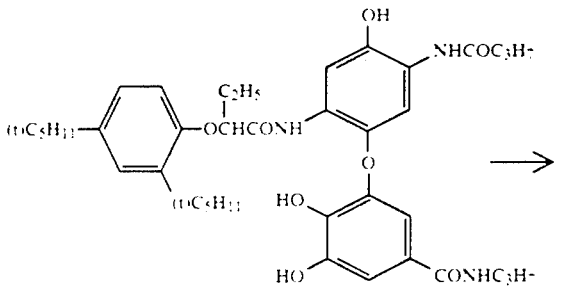

16

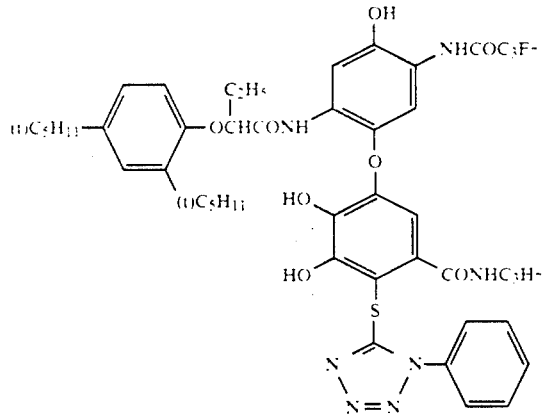

Compound (30)

Step (1): Synthesis of Compound 10

147.7 g of Compound 9 (synthesized according to the method as described in *J. Am. Chem. Soc.*, Vol. 81, page 4606 (1959)), 24.6 g of potassium hydroxide and 15 ml of water were added to 1 liter of toluene, and the mixture was refluxed by heating for 1 hour. Water and toluene were distilled off as an azeotropic mixture. To the residue were added 500 ml of N,N-dimethylformamide, 70 g of Compound 1 and 0.5 g of cuprous chloride, and the mixture was reacted at 120° C. for 4 hours. After cooling to room temperature, 12 ml of hydrochloric acid, 150 ml of water and 500 ml of methanol were added thereto. The crystals thus-deposited were collected by filtration to obtain 120 g of Compound 10.

Step (2): Synthesis of Compound 11

55.9 g of Compound 10 obtained in Step (1) was added to a solvent mixture of 300 ml of ethanol and 100 ml of water, and nitrogen gas was bubbled through the solution. To the resulting solution was added 31.4 g of potassium hydroxide, and the mixture was refluxed by heating for 6 hours. After cooling to room temperature, the mixture was neutralized with hydrochloride acid. 500 ml of ethyl acetate was added thereto and the mixture was put into a separatory funnel and washed with water. The oil layer was separated and the solvent was distilled off under a reduced pressure to obtain 46.2 g of Compound 11.

Step (3): Synthesis of Compound 12

46.2 g of Compound 11 obtained in Step (2) was dissolved in 500 ml of ethyl acetate and to the solution was added dropwise 47.3 g of anhydrous heptafluorobutyric acid at room temperature. After being reacted for 40 minutes at room temperature, an aqueous solution of sodium carbonate was added thereto to neutralize the solution. The oil layer was washed with water in a separatory funnel and separated. The solvent was distilled off under a reduced pressure and to the residue was added chloroform. The crystals thus-deposited were removed by filtration and the filtrate was concentrated to obtain 52.5 g of Compound 12.

Step (4): Synthesis of Compound 13

52.2 g of Compound 12 obtained in Step (3), 53 g of reducing iron, 3 g of ammonium chloride and 3 ml of acetic acid were added to a solvent mixture of 280 ml of isopropanol and 40 ml of water and the mixture was refluxed by heating for 1 hour. The reaction mixture was filtered while it was hot and the filtrate was concentrated under a reduced pressure until the deposition of crystals were obtained, followed by cooling. The crystals thus-deposited were collected by filtration to obtain 45.2 g of Compound 13.

Step (5): Synthesis of Compound 14

45.2 g of Compound 13 obtained in Step (4) was added to 500 ml of acetonitrile and to the solution was added dropwise 28.3 g of 2-(2,4-di-tert-amylphenoxy)-butanoyl chloride under refluxing by heating. After being reacted under refluxing for 30 minutes, the mixture was cooled to room temperature, to which was added 500 ml of ethyl acetate and washed with water. The oil layer was separated and the solvent was distilled off under a reduced pressure. The residue was recrystallized from a solvent mixture of ethyl acetate and n-hexane to obtain 56.7 g of Compound 14.

Step (6):.Synthesis of Compound 15

56.7 g of Compound 14 obtained in Step (5) was added to a solvent mixture of 250 ml of tetrahydrofuran, 250 ml of acetonitrile and 10 ml of N,N-dimethylformamide and to the solution was added dropwise 42.4 g of thionyl chloride at room temperature. After being reacted for 30 minutes, the solution was cooled to -10° C., to which was added dropwise 67.7 g of propylamine while maintaining the temperature below 0° C. After being reacted below 0° C. for 30 minutes, ethyl acetate was added to the solution and washed with water. The oil layer was separated and the solvent was distilled off under a reduced pressure. The residue was recrystallized from a solvent mixture of ethyl acetate and hexane to obtain 45.2 g of Compound 15.

Step (7): Synthesis of Compound 16

45.2 g of Compound 15 obtained in Step (6) was added to a solvent mixture of 300 ml of methanol and 15 ml of hydrochloric acid and the mixture was refluxed by heating for 1 hour. After cooling to room temperature, 200 ml of water was added thereto and the crystals thus-deposited were collected by filtration to obtain 28.6 g of Compound 16.

Step (8): Synthesis of Compound (30)

28.6 g of Compound 16 obtained in Step (7) was added to 600 ml of tetrahydrofuran, and the solution was cooled to −10° C., to which was added 4.6 g of aluminium chloride. To the resulting solution was added dropwise 60 ml of a dichloromethane solution containing 8.8 g of 1-phenyltetrazolyl-5-sulfenyl chloride. After being reacted at −10° C. for 30 minutes, ethyl acetate and water were added to the reaction mixture. The oil layer was separated using a separatory funnel and washed with water. The solvent was distilled off under a reduced pressure, and the residue was recrystallized from a solvent mixture of hexane and ethanol to obtain 24.9 g of Compound (30).

SYNTHESIS EXAMPLE 4

Synthesis of Compound (31)

Compound (31) was synthesized in the same manner as described in Synthesis Example 3 except using 16.8 g of 5-(4-methoxycarbonylphenoxycarbonylmethylthio)-1,3,4-thiadiazolyl-2-sulfenyl chloride in place of 8.8 g of 1-phenyltetrazolyl-5-sulfenyl chloride in Step (8).

SYNTHESIS EXAMPLE 5

Synthesis of Compound (73)

30.2 g of o-chloro-α-benzoyl-2-chloro-5-octadecyloxycarbonylacetanilide, 24.3 g of propyl ester of 2-{1-(4-cyanophenoxycarbonyl)ethyl]tetrazolyl-5-thio}-3,4,5-trihydroxybenzoic acid and 6.9 g of potassium carbonate were added to a solvent mixture of 50 ml of N,N-dimethylformamide and 100 ml of toluene, and the mixture was reacted at 50° C. for 2 hours. After cooling to room temperature, the reaction mixture was put into a separatory funnel and washed successively with water, diluted hydrochloric acid and then water. The oil layer was dried with anhydrous sodium sulfate. The solvent was distilled off under a reduced pressure and the residue was recrystallized from a solvent mixture of ethyl acetate and n-hexane to obtain 25.0 g of Compound (73).

The primary compound represented by general formula (I) used in the present invention is preferably incorporated into a light-sensitive silver halide emulsion layer or an adjacent layer thereto of the color photographic light-sensitive material. The amount of the primary compound added is in a range of from about $1\times10^{-6}$ to about $1\times10^{-3}$ mol/m$^2$, preferably from $3\times10^{-6}$ to $5\times10^{-4}$, and more preferably from $1\times10^{-5}$ to $2\times10^{-4}$ mol/m$^2$.

The compound represented by general formula (I) according to the present invention can be incorporated into the color photographic light-sensitive material in a similar manner used for incorporating conventional couplers into photographic materials, as described hereinafter.

The monodispersed emulsion used in the present invention is an emulsion having a particle size distribution such that a coefficient of variation with respect to particle diameter of silver halide grains, $S/\bar{r}$, is not more than about 0.25, wherein S represents a standard variation with respect to particle size, and $\bar{r}$ represents an average particle diameter.

The average particle diameter ($\bar{r}$) and the standard deviation (S) are defined by the following formulae, respectively:

$$\bar{r} = \frac{\Sigma n_i \cdot r_i}{\Sigma n_i}$$

$$S = \sqrt{\frac{\Sigma(\bar{r} - r_i)^2 \cdot n_i}{\Sigma n_i}}$$

wherein $r_i$ represents a particle diameter of each emulsion grain, and $n_i$ represents a number of the grains having the particle diameter of $r_i$.

The particle diameter means a diameter corresponding to the projected area, that is a diameter corresponding to the projected area obtained by microphotographing a silver halide emulsion using a method well known in the art (usually photographing by an electron microscope) as described in T. H. James, *The Theory of the Photographic Process*, Third Edition, pages 36 to 43, The Macmillan Publishing Co., Inc. (1966). The diameter corresponding to the projected area of a silver halide grain is defined by a diameter of a circle equal to the projected area of a silver halide grain as described in the above-mentioned reference. Thus, it is possible to determine an average particle diameter ($\bar{r}$) and a standard deviation (S) in the manner as described above even where a crystal structure of the silver halide grains is not spherical; for example, where their crystal structure is cubic, octahedral, tetradecahedral, tabular, potato-like, etc.

The coefficient of variation with respect to a particle diameter of silver halide grains is not more than about 0.25, preferably not more than 0.20 and more preferably not more than 0.15.

The size of the silver halide grains is not particularly restricted, and it is preferably from about 0.1 μm to about 2.5 μm, more preferably from 0.3 μm to 2 μm and particularly preferably from 0.4 μm to 1.5 μm.

The silver halide grains used in the present invention may have a regular crystal structure, for example, a hexahedral, octahedral, dodecahedral or tetradecahedral structure, etc., or an irregular crystal structure, for example, a spherical, potato-like or tabular structure, etc.

With respect to the halide composition of the silver halide grains, it is preferred that they comprise not less than about 60 mol% of silver bromide and not more than about 10 mol% of silver chloride. Silver halide grains containing from about 2 mol% to about 40 mol% of silver iodide, particularly from 3 mol% to 20 mol% of silver iodide, are more preferred. A distribution of halide composition between grains is preferably uniform.

In the most preferred halide composition of the monodispersed silver halide emulsion used in the present invention, silver halide grains have a substantially two-layered structure, that is, a inner core portion having a high silver iodide content and an outer shell portion having a low silver iodide content.

In the following description, the grains having such a layered structure are described in further detail The inner core portion is composed of silver halide having a high silver iodide content, and it is preferred that the silver iodide content is from about 10 mol% to about 45 mol%, which is the maximum amount of iodide of solid solution It is preferably from 15 mol% to 45 mol% and more preferably from 20 mol% to 40 mol%.

Any of silver chlorobromide and silver bromide may be used as a silver halide other than silver iodide in the core portion. A high rate of silver bromide is preferred.

The outermost or shell layer is preferably silver halide containing not more than about 5 mol% of silver iodide, more preferably silver halide containing not more than 2 mol% of silver iodide.

Any of silver chloride, silver chlorobromide and silver bromide may be used as a silver halide other than silver iodide in the outermost layer. A high rate of silver bromide is preferred.

The above-described demarcated layer, core/shell structure can be determined by an X-ray diffraction method. The application of an X-ray diffraction method to silver halide grains is described, for example, by H. Hirsch, *Journal of Photographic Science*, Vol. 10, page 129 (1962), etc. When a lattice constant is fixed depending on the halide composition, a peak of diffraction occurs at the diffraction angle which fulfils the Bragg's formula ($2d \sin \theta = n$ ).

Measurement using X-ray diffraction is described in detail in *Course of Basic Analytic Chemistry*, No. 24, "X-ray Analysis" (Kyoritsu Shuppan) and *Manual of X-ray Diffraction* (Rigakudenki Co., Ltd.), etc.

According to the standard method, Cu is used as a target, and Kβ-ray of Cu as a ray source (tube voltage: 40 KV, tube current: 60 mA) in order to obtain a diffraction curve of a (220) plane of silver halide. For the purpose of increasing the resolving power of the measuring equipment, it is necessary to confirm the measurement accuracy using a standard sample such as silicon by appropriately selecting the width of the slit (an emission slit, a light receiver slit, etc.), time constant of the equipment, the scanning rate of a goniometer, and the rate of recording.

In the case of silver halide grains having such a two-layered core/shell structure, two peaks appear, one of which corresponds to the diffraction maximum due to silver halide in a high iodide content layer and the other of which corresponds to the diffraction maximum due to silver halide in a low iodide content layer.

The two-layered, core/shell structure means that a diffraction peak corresponding to the high iodide content layer containing from 10 to 45 mol% of silver iodide, a diffraction peak corresponding to the low iodide content layer containing not more than 5 mol% of silver iodide and one diffraction minimum between these two diffraction maxima are formed, and a rate of diffraction strength of the peak corresponding to the high iodide content layer to diffraction strength of the peak corresponding to the low iodide content layer is from about 1/10 to about 3/1 in a curve of diffraction strength vs diffraction angle (obtained by measurement of a (220) plane of silver halide using Kβ-ray of Cu in a range of diffraction angle (2θ) from 38° to 42° ). More preferably, the rate of diffraction strength is from 1/5 to 3/1 and particularly preferably, the rate of diffraction strength is from ⅓ to 3/1.

It is preferred that the minimum value of diffraction strength between two peaks is not more than about 90%, more preferably not more than 80%, and particularly preferably not more than 60%, of the lower diffraction strength maximum (peak) among two diffraction strength maxima with the emulsion having such a two-layered, core/shell structure. A method for analysis of a diffraction curve composed of two diffraction components is well known and described, for example, in *Course of Experimental Physics*, No. 11, "Lattice Defect" (Kyoritsu Shuppan), etc.

It is useful to analyze using a curve analyzer manufactured by DuPont de Nemerous on the assumption that the diffraction curve is a function such as a Gauss function or a Lorentz function.

In the case of a silver halide emulsion containing two kinds of grains having different halide compositions from each other, but no clear layered structure (such as the core/shell structure described above), two peaks also appear when using the X-ray diffraction analysis technique described above.

However, it is possible to determined whether a silver halide emulsion contemplated for use is an emulsion having the layered structure as described above, or an emulsion wherein two kinds of silver halide grains are co-present as mentioned above using an EPMA method (electron-probe micro-analyzer method) in addition to the X-ray diffraction analysis.

According to the EPMA method, a sample in which silver halide grains are dispersed so as to prevent contact between each grain, is irradiated with an electron beam. By X-ray analysis using excitation due to the electron beam, elementary analysis of a super fine portion can be carried out. The halide composition of each silver halide grain is determined by measuring the specified X-ray strength of silver and iodine irradiated from each grain. It can thus be determined whether the emulsion in question is an emulsion having a layered structure or not by the confirmation of halide composition of at least 50 silver halide grains using an EPMA method.

In such an emulsion having the layered or core/shell structure, it is preferred that the iodide content between the grains is uniform. More specifically, a relative standard deviation is preferably not more than about 50%, more preferably not more than 35%, and particularly preferably not more than 20%, when a distribution of iodide content between grains is measured by an EPMA method.

In order to obtain desirable photographic properties using silver halide grains having the clear, two-layered structure, it is desired that the high iodide content silver halide of the core is wholly covered with the low iodide content silver halide of the shell. The thickness of the shell required for covering the core can be varied depending on grain size, and it is desired to be not less than about 0.1 μm in the case of large size grains of not less than about 1.0 μm, and not less than about 0.05 μm in the case of small size grains of less than about 1.0 μm.

In order to obtain an emulsion having the clear two-layered structure, a silver ratio of the shell portion to the core portion is preferably in a range from about 1/5 to about 5, more preferably in a range from 1/5 to 3 and particularly preferably in a range from 1/5 to 2.

With respect to silver halide grains having a clear two-layered, core/shell structure, silver halide grains in which two regions of substantially different halide compositions from each other are present and the central part and the surface part thereof are designated core portion and shell portion respectively, are exemplary of those useful in the present invention.

Hereafter, silver halide emulsions suitable for use in the present invention, other than the monodispersed emulsion described above, will be described in detail.

In the photographic emulsion layers of the photographic light-sensitive material of the present invention, any of silver bromide, silver iodobromide, silver iodochlorobromide, silver chlorobromide and silver chloride may be used as the silver halide, in addition to the monodispersed emulsion described above according to the present invention. A preferred silver halide is silver iodobromide or silver iodochlorobromide each containing about 30 mol% or less of silver iodide. Silver iodobromide containing from about 2 mol% to about 25 mol% of silver iodide is particularly preferred.

Silver halide grains in the photographic emulsion may have a regular crystal structure, for example, a cubic, octahedral or tetradecahedral structure, etc., an irregular crystal structure, for example, a spherical structure, etc., a crystal defect, for example, a twin plane, etc., or a composite structure thereof.

The grain size of the silver halide may be varied, and includes from fine grains having about 0.1 micron or less to large size grains having about 10 microns of a diameter of projected area.

The silver halide photographic emulsion used in the present invention can be prepared using known methods, for example, those as described in *Research Disclosure*, No. 17643 (December, 1978), pages 22 to 23, § "I. Emulsion preparation and types" and *Research Disclosure*, No. 18716 (November, 1979), page 648, etc.

The photographic emulsion used in the present invention can be prepared in any suitable manner, for example, by the methods as described in P. Glafkides, *Chimie et Physique Photographique*, Paul Montel (1967), G. F. Duffin, *Photographic Emulsion Chemistry*, The Focal Press (1966), and V. L. Zelikman et al., *Making and Coating Photographic Emulsion*, The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, a method (so-called reversal mixing process) in which silver halide particles are formed in the presence of an excess of silver ions can be employed.

One system utilizing the double jet process is a so-called controlled double jet process in which the pAg in a liquid phase where silver halide is formed is maintained at a predetermined level. This process is capable of producing a silver halide emulsion in which the crystal form is regular and the grain size is nearly uniform.

Two or more kinds of silver halide emulsions which are prepared separately may be used as a mixture thereof, if desired.

Silver halide emulsions composed of regular grains as described above can be obtained by controlling pAg and pH during the step of formation of silver halide grains. The details thereof are described, for example, in *Photographic Science and Engineering*, Vol. 6, pages 159 to 165 (1962), *Journal of Photographic Science*, Vol. 12, page 242 to 251 (1964), U.S. Pat. No. 3,655,394, and British Patent 1,413,748, etc.

Further, tabular silver halide grains having an aspect ratio of about 5 or more can be employed in the present invention. The tabular grains may be prepared by the method as described in Gutoff, *Photographic Science and Engineering*, Vol. 14, pages 248 to 257 (1970), U.S. Pat. Nos. 4,434,226, 4,414,310, 4,433,048 and 4,439,520, British Patent 2,112,157, etc. When employing tabular silver halide grains, it is described in detail in, e.g., U.S. Pat. No. 4,434,226 that many advantages, for example, increasing spectral sensitizing efficiency with a sensitizing dye, and improvements in graininess and in sharpness, etc., are obtained.

The crystal structure of silver halide grains may be uniform, or may be composed of different halide compositions between the inner portion and the outer portion, or may have a layer structure. Examples of such emulsion grains are described in British Patent 1,027,146, U.S. Pat. Nos. 3,505,068 and 4,444,877, and Japanese Patent Application (OPI) No. 143331/85.

Further, silver halide emulsions in which silver halide grains having different compositions are connected by epitaxial junctions or silver halide emulsions in which silver halide grains are connected to compounds other than silver halide such as silver thiocyanate, lead oxide, etc., may also be employed. Examples of these emulsion grains are described in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, Japanese Patent Application (OPI) No. 162540/84, etc.

Moreover, a mixture of grains having a different crystal structure may be used, if desired.

The photographic emulsions used in the present invention usually undergo physical ripening, chemical ripening and spectral sensitization. Various kinds of additives which can be employed in these steps are described in *Research Disclosure*, No. 17643 (December, 1978) and *Research Disclosure*, No. 18716 (November, 1979) as mentioned above, and the relevant portions thereof are summarized in Table B shown below.

Further, known photographic additives which can be used in the present invention are also described in the above-mentioned *Research Disclosure* publications, and the relevant portions thereof are summarized in Table B below:

TABLE B

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Super Sensitizers | Pages 23 to 24 | Page 648, right column to Page 649, right column |
| 4. Whitening Agents | Page 24 | — |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to Page 650, left column |
| 7. Antistaining Agents | Page 25, right column | Page 650, left column to right column |
| 8. Dye Image Stabilizers | Page 25 | — |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surface Active Agents | Pages 26 to 27 | Page 650, right column |
| 13. Antistatic Agents | Page 27 | Page 650, right column |

Various color couplers can be employed in the present invention, and specific examples thereof are described in the patents cited in *Research Disclosure*, No. 17643, §§"VII-C" to "VII-G". As dye forming couplers, couplers capable of providing three primary colors (i.e., yellow, magenta and cyan) in the subtractive process upon color development are important. Specific examples of preferred diffusion-resistant, four-equivalent or two-equivalent couplers are described in the patents cited in *Research Disclosure*, No. 17643, §§"VII-C" and "VII-D", mentioned above. In addition, the couplers described below are preferably employed in the present invention.

Typical yellow couplers used in the present invention include hydrophobic acylacetamide type couplers having a ballast group. Specific examples thereof are described in U.S. Pat. Nos. 2,407,210, 2,875,027 and 3,265,506, etc. In the present invention, two-equivalent yellow couplers are preferably employed.

Typical examples of two-equivalent yellow couplers include yellow couplers of an oxygen atom releasing type, as described in U.S. Pat. Nos. 3,408,194, 3,447,928, 3,933,501 and 4,022,620, etc. and yellow couplers of a nitrogen atom releasing type, as described in Japanese Patent Publication No. 10739/83, U.S. Pat. Nos. 4,401,752 and 4,326,024, *Research Disclosure*, No. 18053 (April, 1979), British Patent 1,425,020, West German Patent Application (OLS) Nos. 2,219,917, 2,261,361, 2,329,587 and 2,433,812, etc. α-Pivaloylacetanilide type couplers are characterized by fastness, particularly light fastness, of dyes formed, and α-benzoylacetanilide type couplers are characterized by providing high color density.

Suitable magenta couplers which can be used in the present invention include hydrophobic indazolone type couplers, cyanoacetyl type couplers, and preferably 5-pyrazolone type couplers and pyrazoloazole type couplers each having ballast group. Of these 5-pyrazolone type couplers, those substituted with an arylamino group or an acylamino group at the 3-position thereof are preferred in view of hue and color density of dyes formed therefrom. Typical examples thereof are described in U.S. Pat. Nos 2,311,082, 2,343,703, 2,600,788, 2,908,573, 3,062,653, 3,152,896 and 3,936,015, etc. As releasing groups for two-equivalent 5-pyrazolone type couplers, nitrogen atom releasing groups, as described in U.S. Pat. No. 4,310,619, and arylthio groups as described in U.S. Pat. No. 4,351,897, are particularly preferred. Further, 5-pyrazolone type couplers having a ballast group as described in European Patent 73,636 are advantageous since they provide high color density.

Examples of pyrazoloazole type couplers include pyrazolobenzimidazoles, as described in U.S. Pat. No. 3,061,432, and preferably pyrazolo[5,1-c][1,2,4]triazoles as described in U.S. Pat. No. 3,725,067, pyrazolotetrazoles as described in *Research Disclosure*, No. 24220 (June, 1984) and Japanese Patent Application (OPI) No. 33552/85 and pyrazolopyrazoles as described in *Research Disclosure*, No. 24230 (June, 1984) and Japanese Patent Application (OPI) No. 43659/85. Imidazo[1,2-b]pyrazoles as described in U.S. Pat. No. 4,500,630 are preferred, and pyrazolo[1,5-b][1,2,4]triazoles as described in U.S. Pat. No. 4,540,654 are particularly preferred in view of less yellow subsidiary absorption and light fastness of dyes formed therefrom.

Suitable cyan couplers which can be used in the present invention include hydrophobic and diffusion-resistant naphthol type and phenol type couplers. Typical examples thereof include naphthol type couplers as described in U.S. Pat. No. 2,474,293, and preferably oxygen atom releasing type two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers capable of forming cyan dyes fast to humidity and temperature are preferably used in the present invention. Typical examples thereof include phenol type cyan couplers having an alkyl group higher than a methyl group at the meta-position of the phenol nucleus as described in U.S. Pat. No. 3,772,002, 2,5-diacylamino-substiphenol type couplers as described in U.S. Pat. Nos. 2,772,162, 3,758,308, 4,126,396, 4,334,011 and 4,327,173, West German Patent Application (OLS) No. 3,329,729, and European Patent 121,365, etc., phenol type couplers having a phenylureido group at the 2-position thereof and an acylamino group at the 5-position thereof as described in U.S. Pat. Nos. 3,446,622, 4,333,999, 4,451,559 and 4,427,767, etc. Cyan couplers having a sulfonamido group, or an amido group, etc. at the 5-position of the naphthol nucleus as described in European Patent 161,626A are also excellent in fastness of color images formed therefrom, and are preferably employed in the present invention.

It is preferred to conduct masking by using colored couplers together in color photographic light-sensitive materials for photography in order to correct undesirable absorptions of dyes formed. Typical examples include yellow-colored magenta couplers as described in U.S. Pat. No. 4,163,670 and Japanese Patent Publication No. 39413/82, etc. and magenta-colored cyan couplers as described in U.S. Pat. Nos. 4,004,929 and 4,138,258 and British Patent 1,146,368, etc. Further, colored couplers as described in *Research Disclosure*, No. 17643, §"VII-G", mentioned above, may be employed.

Further, couplers capable of forming appropriately diffusible dyes can be used together in order to improve graininess. Specific examples of such types of magenta couplers are described in U.S. Pat. No. 4,366,237 and British Patent 2,125,570, etc. and those of yellow, magenta and cyan couplers are described in European Patent 96,570 and West German Patent Application (OLS) No. 3,234,533, etc.

Dye forming couplers and the above-described special couplers may form polymers, including dimers or high polymers. Typical examples of polymerized dye forming couplers are described in U.S. Pat. Nos. 3,451,820 and 4,080,211, etc. Specific examples of polymerized magenta couplers are described in British Patent 2,102,173 and U.S. Pat. No. 4,367,282, etc.

Couplers capable of releasing a photographically useful residue during the course of coupling are also preferably employed in the present invention. Specific examples of useful DIR couplers capable of releasing a development inhibitor are described in the patents cited in *Research Disclosure*, No. 17643, § "VII-F" described above.

Suitable DIR couplers include the deactivation type in a developing solution as represented by Japanese Patent Application (OPI) No. 151944/82, the timing type as represented by U.S. Pat. No. 4,248,962 and Japanese Patent Application (OPI) No. 154234/82, and the reactive type as represented by Japanese Patent Application (OPI) No. 184248/85. It is preferred to employ these DIR couplers in combination in the present invention. Further, DIR couplers of the deactivation type in a developing solution as described in Japanese Patent Application (OPI) Nos. 151944/82 and 21932/83, 218644/85, 225156/85, 221750/85, 233650/85, etc. and DIR couplers of the reactive type as described in Japanese Patent Application (OPI) No. 184248/85, etc., are particularly preferred.

Couplers which imagewise release a nucleating agent, a development accelerator or a precursor thereof at the time of development can be employed in the photographic light-sensitive material of the present invention. Specific examples of such compounds are described in British Patents 2,097,140 and 2,131,188, etc. Couplers which release a nucleating agent having an adsorption function to silver halide are particularly preferred, and specific examples thereof are described in Japanese Patent Application (OPI) Nos. 157638/84 and 170840/84, etc.

Furthermore, competing couplers (for example, couplers as described in U.S. Pat. No. 4,130,427, etc.), polyequivalent couplers (for example, couplers as described in U.S. Pat. Nos. 4,283,472, 4,338,393 and 4,310,618, etc.), couplers capable of releasing a dye which converts into a colored form after being released (for example, couplers as described in European Patent Application (OPI) No. 173,302, etc.), etc. may be employed in the photographic light-sensitive material of the present invention.

The couplers which can be used in the present invention can be incorporated into the photographic light-sensitive material according to various known dispersing methods. Typical examples of the dispersing methods include a solid dispersing method, an alkali dispersing method, preferably a latex dispersing method, and more preferably, an oil droplet-in-water type dispersion method. By means of the oil droplet-in-water type dispersing method, couplers are dissolved in either an organic solvent having a high boiling point of 175° C. or more, a so-called auxiliary solvent having a low boiling point, or a mixture thereof, and then the solution is finely dispersed in an aqueous medium such as water or an aqueous gelatin solution, etc. in the presence of a surface active agent. Specific examples of the organic solvents having a high boiling point are described in U.S. Pat. No. 2,322,027, etc. In order to prepare a dispersion, phase inversion may also take place. Further, dispersions are utilized for coating after removing or reducing the auxiliary solvent therein by distillation, noodle washing or ultrafiltration, etc., if desired.

The processes and effects of latex dispersing methods and the specific examples of latexes to be used are described in U.S. Pat. No. 4,199,363, West German Patent Application (OLS) Nos. 2,541,274 and 2,541,230, etc.

Suitable supports which can be used in the present invention are described, for example, in *Research Disclosure*, No. 17643, page 28 and *Research Disclosure*, No. 18716, page 647, right column to page 648, left column, as described above.

The color photographic light-sensitive material according to the present invention can be subjected to development processing in a conventional manner as described in *Research Disclosure*, No. 17643, page 28 to 29, and *Research Disclosure*, No. 18716, page 651, left column to right column, as described above.

A color developing solution which can be used in development processing of the color photographic light-sensitive material according to the present invention is an alkaline aqueous solution preferably containing an aromatic primary amine type color developing agent as a main component. An aminophenol type compound is useful as the color developing agent, but a p-phenylenediamine type compound is preferably employed. Typical examples of the p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or sulfate, hydrochloride or p-toluenesulfonate thereof, etc. These diamines are preferably employed in the form of salts since the salts are generally more stable than their free forms.

The color developing solution usually contains pH buffering agents, such as carbonates, borates or phosphates of alkali metals, etc.; and development inhibitors or antifogging agents such as bromides, iodides, benzimidazoles, benzothiazoles or mercapto compounds, etc. Further, if necessary, the color developing solution may contain preservatives such as hydroxylamine, sulfites, etc.; organic solvents such as triethanolamine, diethylene glycol, etc.; development accelerators such as benzyl alcohol, polyethyleneglycol, quaternary ammonium salts, amines, etc.; dye forming couplers; completing couplers; nucleating agents such as sodium borohydride, etc.; auxiliary developing agents such as 1-phenyl-3-pyrazolidone, etc.; viscosity imparting agents; and various chelating agents as represented by aminopolycarboxylic acids, aminopolyphosphonic acids, alkylphosphonic acids and phosphonocarboxylic acids, etc.; and antioxidants as described in West German Patent Application (OLS) No. 2,622,950; etc.

In the case of development processing for color reversal photographic light-sensitive materials, color development is usually conducted after black-and-white development. In a black-and-white developing solution, known black-and-white developing agents, for example, dihydroxybenzenes such as hydroquinone, etc., 3-pyrazolidones such as 1-phenyl-3-pyrazolidone, etc., or aminophenols such as N-methyl-p-aminophenol, etc. may be employed individually or in combination.

After color development, the photographic emulsion layer is usually subjected to a bleach processing. The processing can be carried out simultaneously with or separately from a fix processing. Further, in order to perform rapid processing, a processing method in which a bleach-fix processing is conducted after a bleach processing can be employed.

Examples of bleaching agents which can be employed include compounds of a multivalent metal such as iron (III), cobalt (III), chromium (VI), copper (II), etc.; peracids; quinones; nitroso compounds, etc. Representative examples of the bleaching agents include ferricyanides; dichloromates; organic complex salts of iron (III) or cobalt (III), (for example, complex salts of aminopolycarboxylic acids such as ethylenediaminetetraacetic acid, diethylenetriaminepentaacetic acid, nitrilotriacetic acid, 1,3-diamine-2-propanoltetraacetic acid, etc. or complex salts of organic acids such as citric acid, tartaric aciad, malic acid, etc.); persulfates; manganates; nitrosophenol; etc. Of these compounds, iron (III) salts of ethylenediaminetetraacetic acid, iron (III) salts of diethylenetriaminepentaacetic acid and persulfates are preferred in view of rapid processing and less environmental pollution. Further, ethylenediaminetetraacetic acid iron (III) complex salts are particularly useful both in an independent bleaching solution and in a mono-bath bleach-fixing solution.

In a bleaching solution, a bleach fixing solution or a prebath thereof, a bleach accelerating agent can be used, if desired. Specific examples of the bleach accelerating agents which can be used include compounds having a mercapto group or a disulfide group as described in U.S. Pat. No. 3,893,858, West German Patents 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, *Research Disclosure*, No. 17129 (July, 1978), etc., thiazolidine derivatives as described in Japanese Patent Application (OPI) No. 140129/75, etc., thiourea derivatives as described in Japanese Patent Publication No. 8506/70, Japanese Patent Application (OPI) Nos. 20832/77 and 32735/78, U.S. Pat. No. 3,706,561, etc., iodides as described in West German Patent 1,127,715, Japanese Patent Application (OPI) No. 16235/83, etc., polyethyleneoxides as described in West German Patents 960,410 and 2,748,430, etc., polyamine compounds as described in Japanese Patent Publication No. 8836/70, etc., compounds as described in Japanese Patent Application (OPI) Nos. 2434/74, 59644/74, 94927/78, 35727/79, 26506/80, and 63940/83, etc., iodine ions, bromine ions, etc. Of these compounds, the compounds having a mercapto group or a disulfide group are preferred in view of their increased accelerating effects, and the compounds as described in U.S. Pat. No. 3,893,858, West German Patent 1,290,812 and Japanese Patent Application (OPI) No. 95630/78 are particularly preferred. Further, the compounds as described in U.S. Pat. No. 4,552,834 are preferably employed. These bleach accelerating agents may also be incorporated into the photographic light-sensitive material. These bleach accelerating agents are particularly effective where color photographic light sensitive materials for photography are bleach-fixed.

Examples of fixing agents include thiosulfates, thiocyanates, thioether type compounds, thioureas, an iodides, etc. Of these compounds, thiosulfates are ordinarily employed. In the bleach-fixing solution or the fixing solution, sulfites, bisulfites, carbonylbisulfite adducts, etc. are preferably employed as preservatives.

After the bleach-fix processing or fix processing, water wash processing or stabilization processing are generally conducted. In the water washing step or stabilizing step, various known compounds may be employed for the purpose of preventing precipitation or saving water, etc. For example, a water softener such as an inorganic phosphoric acid, an aminopolycarboxylic acid, an organic aminopolyphosphonic, or an organic phosphoric acid, etc. for the purpose of preventing the formation of precipitation; a sterilizer or antimold agent for the purpose of preventing the propagation of various bacteria, algae and molds; a metal salt such as a magnesium salt, an aluminum salt, a bismuth salt, etc.; or a surface active agent for the purpose of reducing drying load or preventing drying marks, various hardening agents; etc. may be added, if desired. Further, the compounds as described in L. E. West, *Photo. Sci. and Eng.*, Vol. 6, pages 344 to 359 (1965) may be added. Particularly, the addition of chelating agents and antimold agents is effective.

The water washing step is ordinarily carried out using a countercurrent water washing processing with two or more tanks in order to save water. Further, in place of the water washing step, a multistage countercurrent stabilizing processing step as described in Japanese Patent Application (OPI) No. 8543/82 may be conducted. In the case of utilizing this latter type of processing, it is desirable to employ a countercurrent processing with two to nine tanks. Various kinds of compounds are added to the stabilizing bath for the purpose of stabilizing images formed, as well as the above-described additives. Representative examples of the additives include various buffers (for example, borates, metaborates, borax, phosphates, carbonates, potassium hydroxide, sodium hydroxide, aqueous ammonia, monocarboxylic acids, dicarboxylic acids, polycarboxylic acids, etc., which may be used in combination) for the purpose of adjusting the pH of layers (for example, pH of 3 to 9), and aldehydes such as formalin, etc. In addition, various additives, such as chelating agents (for example, inorganic phosphoric acids, aminopolycarboxylic acids, organic phosphoric acids, organic phosphonic acids, aminopolyphosphonic acids, phosphonocarboxylic acids, etc.), sterilizers (for example, benzoisothiazolinones, isothiazolones, 4-thiazolinebenzimidazoles, halogenated phenols, sulfanylamides, benzotriazoles, etc.), surface active agents, brightening agents, hardening agents, etc. may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as a pH adjusting agent for layers after processing.

In the case of processing color photographic light-sensitive materials for photography, water washing and stabilizing steps which are ordinarily carried out after fixing can be substituted with the above-described stabilizing step and water washing step (water saving process). In such a case, formalin in the stabilizing bath may be eliminated, when two-equivalent magenta couplers are employed in the color photographic light-sensitive materials.

The processing time for water washing and stabilizing according to the present invention can be varied depending on the type of color photographic light-sensitive material to be processed and processing conditions, but is usually from about 20 seconds to about 10 minutes, preferably from 20 seconds to 5 minutes.

For the purpose of simplification and acceleration of processing, a color developing agent may be incorporated into the color photographic light-sensitive material according to the present invention. In order to incorporate the color developing agent therein, it is preferred to employ various precursors of color developing agents. Suitable examples of the precursors of developing agents include indoaniline type compounds as described in U.S. Pat. No. 3,342,597, Schiff's base type compounds as described in U.S. Pat. No. 3,342,599 and *Research Disclosure*, No. 14850 (August, 1976), and *Research Disclosure*, No. 15159 (November, 1976), aldol compounds as described in *Research Disclosure*, No. 13924 (November, 1975), metal salt complexes as described in U.S. Pat. No. 3,719,492, urethane type compounds as described in Japanese Patent Application (OPI) No. 135628/78, and various salt type precursors as described in Japanese Patent Application (OPI) No. 6235/81, 16133/81, 59232/81, 67842/81, 83734/81, 83735/81, 83736/81, 89735/81, 81837/81, 54430/81, 10624/81, 107236/81, 97531/82 and 83565/82, etc.

Further, the color photographic light-sensitive material according to the present invention may contain, if desired, various 1-phenyl-3-pyrazolidones for the purpose of accelerating color development. Typical examples of these compounds are described in Japanese Patent Application (OPI) Nos. 64339/81, 144547/82, 211147/82, 50532/83, 50536/83, 50533/83, 50534/83, 50535/83 and 115438/83, etc.

In the present invention, various kinds of processing solution can be employed within a temperature range from about 10° C. to about 50° C. Although a standard temperature is from 33° C. to 38° C., it is possible to carry out the processing at high temperatures in order to accelerate processing whereby the processing time is shortened, or at lower temperature in order to achieve improvement in image quality and to maintain stability of the processing solutions.

Further, for the purpose of saving an amount of silver employed in the color photographic light-sensitive material, the photographic processing may be conducted utilizing color intensification using cobalt or hydrogen peroxide as described in West German Patent Application (OLS) No. 2,226,770 or U.S. Pat. No. 3,674,499.

In each of the processing baths, a heater, a temperature sensor, a liquid level sensor, a circulation pump, a filter, a floating cover, a aqueezer, etc. may be provided, if desired.

Moreover, for continuous processing, variations of the composition in each processing solution can be prevented by using a replenisher for each processing solution, whereby a constant finish can be achieved. The amount of replenisher can be reduced to one half or less of the standard amount of replenishment for the purpose of reducing cost.

The present invention is explained in greater detail with reference to the following examples, but the present invention should not be construed as being limited thereto. Unless otherwise indicated, all parts, percents, ratios and the like are by weight.

EXAMPLE 1

Preparation of Emulsions A to D

Three kinds of silver halide emulsions containing octahedral grains having an iodide content of 12 mol%, average particle size of 0.4 μm, 0.6 μm and 0.9 μm, and coefficient of variation of 0.16, 0.19 and 0.20, respectively, were prepared in the presence of ammonia using a controlled double jet method. These three emulsions were designated Core Emulsions (i), (ii) and (iii), respectively.

Core Emulsions (i), (ii) and (iii) were washed with water and desalted. The three core emulsions were mixed in various ratios, and on these cores grains pure silver bromide was deposited as a shell layer until the silver amount of the shell portion became equal to the silver amount of the core portion, to prepare tetradecahedral grains. These emulsions were desalted in a conventional manner, sodium thiosulfate and chloroduric acid were added thereto and ripening was conducted at 60° C. for 70 minutes (thereby, these emulsions were subjected to chemical sensitization) to prepare Emulsions A to D. Average particle sizes and coefficients of variation of these emulsions are shown in Table 1-1 below.

Preparation of Emulsions E and F

Onto the same core grains as used in the preparation of Emulsion C, a shell layer containing silver iodide as shown in Table 1-1 below was deposited, until a silver amount of the shell portion became equal to the silver amount of the core portion, to prepare tetradecahedral grains. Since gradation became soft due to high silver iodide content in the shell portion, the amount of the chemical sensitizers and time of the chemical sensitization were controlled so as to prepare silver halide emulsions which were designated Emulsions E and F, respectively, having almost the same gradation as Emulsions A to D described above.

TABLE 1-1

| Emulsion | Average Particle Size (r) (μm) | Coefficient of Variation (S/r) | Silver Iodide Content of Shell Portion (mol %) |
|---|---|---|---|
| A | 0.77 | 0.34 | 0 |
| B | 0.78 | 0.27 | 0 |
| C | 0.77 | 0.22 | 0 |
| D | 0.79 | 0.17 | 0 |
| E | 0.79 | 0.23 | 1 |
| F | 0.80 | 0.24 | 2 |

Sample 101

On a cellulose triacetate film support provided with a subbing layer were coated layers having the compositions set forth below to prepare a multilayer color photographic light-sensitive material which was designated Sample 101.

With respect to the compositions of the layers, coated amounts are shown in a unit of g/m², coated amounts of silver halide and colloidal silver are shown by a silver coated amount in a unit of g/m², those of couplers and sensitizing dyes are shown using a molar amount per mol of silver halide present in the layer.

| | |
|---|---|
| First Layer: Antihalation Layer | |
| Black colloidal silver | 0.18 (as silver) |
| Gelatin | 1.40 |
| Second Layer: Intermediate layer | |
| 2,5-Di-tert-pentadecylhydroquinone | 0.18 |
| C-1 | 0.07 |
| C-3 | 0.02 |
| U-1 | 0.08 |
| U-2 | 0.08 |
| HBS-1 | 0.10 |
| HBS-2 | 0.02 |
| Gelatin | 1.04 |
| Third Layer: First Red-Sensitive Emulsion Layer | |
| Silver iodobromide emulsion (silver iodide: 6 mol %, average particle size: 0.8μ) | 0.50 (as silver) |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| C-2 | 0.146 |
| HBS-1 | 0.005 |
| Compound (35) of the present invention | 0.0050 |
| Gelatin | 1.20 |
| Fourth Layer: Second Red-Sensitive Emulsion Layer | |
| Silver iodobromide emulsion (silver iodide: 5 mol %, average particle size: 0.85μ) | 1.15 (as silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| C-2 | 0.060 |
| C-3 | 0.008 |
| Compound (35) of the present invention | 0.004 |
| HBS-1 | 0.005 |
| Gelatin | 1.50 |
| Fifth Layer: Third Red-Sensitive Emulsion Layer | |
| Silver iodobromide emulsion (silver iodide: 10 mol %, average particle size: 1.5μ) | 1.50 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| C-5 | 0.012 |
| C-3 | 0.003 |
| C-4 | 0.004 |
| HBS-1 | 0.32 |
| Gelatin | 1.63 |
| Sixth Layer: Intermediate Layer | |
| Gelatin | 1.06 |
| Seventh Layer: First Green-Sensitive Emulsion Layer | |
| Silver iodobromide emulsion (silver iodide: 6 mol %, average particle size: 0.77μ) | 0.35 (as silver) |
| Sensitizing Dye V | $3.9 \times 10^{-6}$ |
| Sensitizing Dye VI | $1.3 \times 10^{-5}$ |
| Sensitizing Dye VII | $4.9 \times 10^{-5}$ |
| C-6 | 0.120 |
| C-1 | 0.021 |
| C-7 | 0.031 |
| C-8 | 0.025 |
| HBS-1 | 0.20 |
| Gelatin | 0.70 |
| Eighth Layer: Second Green-Sensitive Emulsion Layer | |
| Silver iodobromide emulsion (silver iodide: 6 mol %, average particle size: 0.07μ) | 0.75 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| C-6 | 0.021 |
| C-8 | 0.004 |
| C-1 | 0.002 |
| C-7 | 0.003 |
| HBS-1 | 0.15 |
| Gelatin | 0.80 |
| Ninth Layer: Third Green-Sensitive Emulsion Layer | |
| Silver iodobromide emulsion (silver iodide: 10 mol %, average particle size: 1.5μ) | 1.80 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| C-6 | 0.011 |
| C-1 | 0.001 |
| HBS-2 | 0.69 |
| Gelatin | 1.74 |
| Tenth Layer: Yellow Filter Layer | |
| Yellow colloidal silver | 0.05 (as silver) |

-continued

| | |
|---|---|
| 2,5-Di-tert-pentadecylhydroquinone | 0.03 |
| Gelatin | 0.95 |
| Eleventh Layer: First Blue-Sensitive Emulsion Layer | |
| Silver iodobromide emulsion (silver iodide: 6 mol %, average particle size: 0.6μ) | 0.24 (as silver) |
| Sensitizing Dye VIII | $3.5 \times 10^{-4}$ |
| C-9 | 0.27 |
| C-8 | 0.005 |
| HBS-1 | 0.28 |
| Gelatin | 1.28 |
| Twelfth Layer: Second Blue-Sensitive Emulsion Layer | |
| Silver iodobromide emulsion (silver iodide: 10 mol %, average particle size: 1.0μ) | 0.45 (as silver) |
| Sensitizing Dye VIII | $2.1 \times 10^{-4}$ |
| C-9 | 0.098 |
| HBS-1 | 0.03 |
| Gelatin | 0.46 |
| Thirteenth Layer: Third Blue-Sensitive Emulsion Layer | |
| Silver iodobromide emulsion (silver iodide: 10 mol %, average particle size: 1.8μ) | 0.77 (as silver) |
| Sensitizing Dye VIII | $2.2 \times 10^{-4}$ |
| C-9 | 0.036 |
| HBS-1 | 0.07 |
| Gelatin | 0.69 |
| Fourteenth Layer: First Protective Layer | |
| Silver iodobromide emulsion (silver iodide: 1 mol %, average particle size: 0.07μ) | 0.5 (as silver) |
| U-1 | 0.11 |
| U-2 | 0.17 |
| HBS-1 | 0.90 |
| Gelatin | 1.20 |
| Fifteenth Layer: Second Protective Layer | |
| Polymethyl methacrylate particle (diameter: about 1.5μ) | 0.54 |
| S-1 | 0.15 |
| S-2 | 0.10 |
| Gelatin | 0.72 |

Gelatin Hardener H-1 and a surface active agent were added to each of the layers in addition to the above-described components.

Samples 102 to 107

Samples 102 to 107 were prepared in the same manner as described for Sample 101 except using Emulsions B, C, D, E and F and a mixture of Emulsions A and D in a ratio of 1:1 in place of Emulsion A used in the seventh layer and the eighth layer of Sample 101, respectively.

Samples 108 to 114

Samples 108 to 114 were prepared in the same manner as described for Samples 101 to 107, except using twice the molar amount of Compound (30) according to the present invention in place of C-8 used in the seventh layer and the eighth layer of Samples 101 to 107, respectively.

Samples 101 to 114 exhibited almost the same gradations and sensitivities when they were subjected to color development processing described hereinafter.

Since the same emulsion was employed in the seventh layer and the eighth layer, the desired sensitivity of the seventh layer was obtained by controlling the amounts of sensitizing dyes to 40% of those used in the eighth layer.

Samples 101 to 104 thus-obtained were uniformly exposed to blue light, and then imagewise exposed to green light and thereafter subjected to color development processing described below. The results shown in the drawing were obtained wherein Curve 1 represents a characteristic curve of a magenta color image and Curve 2 represents a density curve of a yellow color image. In the drawing, $\Delta D_B$ indicates a degree of development inhibition in the blue-sensitive emulsion layer uniformly fogged with the green-sensitive emulsion layer was developed between the unexposed area (Point A) and the exposed area (Point B). In other words, Curve 1 represents the characteristic curve of the magenta color image in the green-sensitive emulsion layer, Curve 2 represents the yellow image density of the blue-sensitive emulsion layer upon uniform exposure to blue light, Point A represents the fogged area of the magenta image and Point B represents the exposed area providing a magenta density of 2.0 in the drawing.

A density difference (a−b) between the yellow density (a) at the unexposed area (Point A) and the yellow density at the exposed area (Point B) was indicated by $\Delta D_B$, and used as a measure for color reproducibility (color turbidity).

The measurement of MTF (Modulation Transfer Function) value was carried out using the method as described in C. E. K. Mees, *The Theory of the Photographic Process*, Third Edition (The Macmillan Publishing Co., Inc.).

Color development processing was carried out according to the following processing steps at 38° C.:

| Processing Steps | Time |
|---|---|
| Color development | 3 min 15 sec |
| Bleaching | 6 min 30 sec |
| Washing with water | 2 min 10 sec |
| Fixing | 4 min 20 sec |
| Washing with water | 3 min 15 sec |
| Stabilizing | 1 min 05 sec |

The processing solutions used in te color development processing had the following compositions:

| | |
|---|---|
| Color Developing Solution | |
| Diethylenetriaminepentaacetic acid | 1.0 g |
| 1-Hydroxyethylidene-1,1-diphosphoric acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| Bleaching Solution | |
| Ammonium ethylenediamine-tetraacetato Ferrate | 100.0 g |
| Disodium ethylenediaminetetraacetate | 10.0 g |
| Ammonium bromide | 150.0 g |
| Ammonium nitrate | 10.0 g |
| Water to make | 1.0 liter |
| pH | 6.0 |
| Fixing Solution | |
| Disodium ethylenediaminetetraacetate | 1.0 g |
| Sodium sulfite | 4.0 g |
| Ammonium thiosulfate (70% aq. soln.) | 175.0 ml |
| Sodium bisulfite | 4.6 g |

-continued

| | |
|---|---|
| Water to make | 1.0 liter |
| pH | 6.6 |
| Stabilizing Solution | |
| Formalin (40%) | 2.0 ml |
| Polyoxyethylene-p-monononylphenyl-ether (average degree of polymerization = 10) | 0.3 g |
| Water to make | 1.0 liter |

The results thus-obtained are shown in Table 1-2:

TABLE 1-2

| Sample | Emulsion Used in Seventh Layer and Eighth Layer | DIR Compound Used in Seventh Layer and Eighth Layer | MTF Value of Magenta Image (40 cycles/mm) | $\Delta D_B$[1] |
|---|---|---|---|---|
| 101 (Comparison) | A | C-8 | 0.68 | 0.13 |
| 102 (Comparison) | B | C-8 | 0.69 | 0.13 |
| 103 (Comparison) | C | C-8 | 0.70 | 0.14 |
| 104 (Comparison) | D | C-8 | 0.71 | 0.14 |
| 105 (Comparison) | E | C-8 | 0.70 | 0.14 |
| 106 (Comparison) | F | C-8 | 0.69 | 0.14 |
| 107 (Comparison) | D, A[2] | C-8 | 0.69 | 0.14 |
| 108 (Comparison) | A | (30) | 0.72 | 0.23 |
| 109 (Comparison) | B | (30) | 0.72 | 0.24 |
| 110 (Present Invention) | C | (30) | 0.76 | 0.25 |
| 111 (Present Invention) | D | (30) | 0.78 | 0.25 |
| 112 (Present Invention) | E | (30) | 0.76 | 0.25 |
| 113 (Present Invention) | F | (30) | 0.75 | 0.25 |
| 114 (Present Invention) | D, A | (30) | 0.76 | 0.25 |

[1]Shown in the drawing
[2]Emulsion D and Emulsion A were mixed in a ratio of 1:0.1:0 which had a coefficient of variation of 0.24

From the results shown in Table 1-2, it can be seen that Samples 110 to 114 according to the present invention are excellent in MTF value (sharpness) and $\Delta D_B$ (color turbidity) in comparison with Samples 103 to 107 using the DIR compounds other than those according to the present invention. Further, in Samples 110 to 114 according to the present invention, MTF values were greatly improved and $\Delta D_B$ values were also improved in comparison with Samples 108 and 109, which employed DIR compounds according to the present invention, but emulsions other than those according to the present invention.

EXAMPLE 2

Sample 201

On a cellulose triacetate film support provided with a subbing layer were coated layers having the compositions set forth below to prepare a multilayer color photographic light-sensitive material which was designated Sample 201.

The coated amounts of the compositions are indicated in the same manner as shown in Example 1.

| | |
|---|---|
| First Layer: Antihalation Layer | |
| Black colloidal silver | 0.15 (as silver) |
| U-1 | 0.5 |
| U-2 | 0.2 |
| HBS-3 | 0.4 |
| Gelatin | 1.5 |
| Second Layer: Intermediate layer | |
| C-7 | 0.10 |
| C-3 | 0.11 |
| 2,5-Di-tert-octylhydroquinone | 0.05 |
| HBS-1 | 0.10 |
| Gelatin | 1.50 |
| Third Layer: First Red-Sensitive Emulsion Layer | |
| Monodispersed silver iodobromide emulsion (silver iodide: 5 mol %, coefficient of variation: 0.17, average particle size: 0.4μ) | 0.9 (as silver) |
| C-12 | 0.35 |
| C-13 | 0.37 |
| C-3 | 0.12 |
| C-10 | 0.052 |
| HBS-3 | 0.30 |
| Sensitizing Dye I | $4.5 \times 10^{-4}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| Gelatin | 1.50 |
| Fourth Layer: Second Red-Sensitive Emulsion Layer | |
| Polydispersed silver iodobromide emulsion (silver iodide: 6 mol %, coefficient of variation: 0.34, average particle size: 0.77μ) | 1.0 (as silver) |
| Sensitizing Dye I | $3.0 \times 10^{-4}$ |
| Sensitizing Dye II | $1.0 \times 10^{-5}$ |
| Sensitizing Dye III | $1.5 \times 10^{-4}$ |
| Sensitizing Dye IV | $2.0 \times 10^{-5}$ |
| C-4 | 0.078 |

-continued

| | |
|---|---|
| C-3 | 0.045 |
| HBS-1 | 0.010 |
| Gelatin | 0.80 |
| Fifth Layer: Intermediate Layer | |
| 2,5-Di-tert-octylhydroquinone | 0.12 |
| HBS-1 | 0.20 |
| Gelatin | 1.0 |
| Sixth Layer: First Green-Sensitive Emulsion Layer | |
| Monodispersed silver iodobromide emulsion (silver iodide: 6 mol %, coefficient of variation: 0.17, average particle size: 0.4μ) | 0.5 (as silver) |
| Sensitizing Dye V | $6.0 \times 10^{-5}$ |
| Sensitizing Dye VI | $2.0 \times 10^{-4}$ |
| Sensitizing Dye VII | $4.0 \times 10^{-4}$ |
| C-6 | 0.27 |
| C-1 | 0.072 |
| C-7 | 0.12 |
| C-8 | 0.010 |
| HBS-1 | 0.15 |
| Gelatin | 0.70 |
| Seventh Layer: Second Green-Sensitive Emulsion Layer | |
| Polydispersed silver iodobromide emulsion (silver iodide: 6 mol %, coefficient of variation: 0.34, average particle size: 0.77μ) | 0.80 (as silver) |
| Sensitizing Dye V | $4.0 \times 10^{-5}$ |
| Sensitizing Dye VI | $1.5 \times 10^{-4}$ |
| Sensitizing Dye VII | $3.0 \times 10^{-4}$ |
| C-6 | 0.071 |
| C-1 | 0.021 |
| C-7 | 0.016 |
| HBS-2 | 0.10 |
| Gelatin | 0.91 |
| Eighth Layer: Intermediate Layer | |
| 2,5-Di-tert-octylhydroquinone | 0.05 |
| HBS-2 | 0.10 |
| Gelatin | 0.70 |
| Ninth Layer: Emulsion Layer | |
| Monodispersed silver iodobromide emulsion (silver iodide: 4 mol %, coefficient of variation: 0.15, average particle size: 0.4μ) | 0.40 (as silver) |
| Sensitizing Dye X | $5.0 \times 10^{-4}$ |
| C-8 | 0.051 |
| C-14 | 0.095 |
| HBS-1 | 0.15 |
| HBS-2 | 0.15 |
| Gelatin | 0.60 |
| Tenth Layer: Yellow Filter Layer | |
| Yellow colloidal silver | 0.85 (as silver) |
| 2,5-Di-tert-octylhydroquinone | 0.15 |
| HBS-1 | 0.20 |
| Gelatin | 0.80 |
| Eleventh Layer: First Blue-Sensitive Emulsion Layer | |
| Monodispersed silver iodobromide emulsion (silver iodide: 4 mol %, coefficient of variation: 0.16, average particle size: 0.3μ) | 0.25 (as silver) |
| Sensitizing Dye VIII | $7.0 \times 10^{-4}$ |
| C-9 | 1.10 |
| Compound (30) of the present invention | 0.050 |
| HBS-1 | 0.40 |
| Gelatin | 1.5 |
| Twelfth Layer: Second Red-Sensitive Emulsion Layer | |
| Monodispersed silver iodobromide emulsion (silver iodide: 8 mol %, coefficient of variation: 0.19, average particle size: 0.7μ) | 0.45 (as silver) |
| Sensitizing Dye VIII | $1.5 \times 10^{-4}$ |
| C-9 | 0.31 |
| HBS-1 | 0.12 |
| Gelatin | 0.88 |
| Thirteenth Layer: Intermediate Layer | |
| U-1 | 0.12 |
| U-2 | 0.16 |
| HBS-3 | 0.12 |
| Gelatin | 0.75 |
| Fourteenth Layer: Protective Layer | |
| Silver iodobromide emulsion (silver iodide: 4 mol %, coefficient of variation: 0.10, average particle size: 0.08μ) | 0.15 (as silver) |
| Polymethyl methacrylate particle (diameter: 1.5μ) | 0.2 |
| S-1 | 0.05 |
| S-2 | 0.15 |
| Gelatin | 0.80 |

A surface active agent and Gelatin Hardener H-1 were added to each of the layers in addition to the above-described components.

Samples 202 to 205

Samples 202 to 205 were prepared in the same manner as described above for Example 201, except using comparative compounds C-11, C-15 and Compounds (32) and (33) according to the present invention and adjusting the amount thereof so as to provide the same degree of development inhibition in place of C-10 used in the third layer of Sample 201, respectively.

Samples 206 to 210

Samples 206 to 210 were prepared in the same manner as described above for Samples 201 to 205, except using Emulsion D in place of Emulsion A used in the fourth layer and the seventh layer of Samples 201 to 205, respectively.

These samples thus-prepared were subjected to the same exposure and color development processing as described in Example 1, and their photographic properties were measured. The results obtained are shown in Table 2-1 below.

Further, these samples were exposed through a step-wedge for measuring RMS (Root Mean Square) granularity and subjected to the same color development processing as described above. RMS values were measured using an aperture having a diameter of 48. The results obtained are also shown in Table 2-1:

TABLE 2-1

| Sample | Emulsion Used in Fourth Layer and Seventh Layer | DIR Compound Used in Third Layer | Amount[2)] of DIR Compound | $\Delta D_B'$[1)] | MTF Value of Cyan Image (25 cycles/mm) | RMS Value × 1000 (DR = 0.7) (Aperture Having a Diameter of 48μ) |
|---|---|---|---|---|---|---|
| 201 (Comparison) | A | C-10 | 1 | 0.08 | 0.60 | 10.8 |
| 202 (Comparison) | A | C-11 | 0.25 | 0.04 | 0.55 | 10.5 |
| 203 (Comparison) | A | C-15 | 1 | 0.07 | 0.59 | 10.8 |
| 204 (Comparison) | A | (32) | 0.8 | 0.15 | 0.63 | 10.7 |

TABLE 2-1-continued

| Sample | Emulsion Used in Fourth Layer and Seventh Layer | DIR Compound Used in Third Layer | Amount[2] of DIR Compound | $\Delta D_B$[1] | MTF Value of Cyan Image (25 cycles/mm) | RMS Value × 1000 (DR = 0.7) (Aperture Having a Diameter of 48μ) |
|---|---|---|---|---|---|---|
| 205 (Comparison) | A | (33) | 0.7 | 0.16 | 0.64 | 10.8 |
| 206 (Comparison) | D | C-10 | 1 | 0.09 | 0.63 | 11.3 |
| 207 (Comparison) | D | C-11 | 0.25 | 0.04 | 0.58 | 11.0 |
| 208 (Comparison) | D | C-15 | 1 | 0.07 | 0.62 | 11.3 |
| 209 (Invention) | D | (30) | 0.8 | 0.20 | 0.68 | 10.7 |
| 210 (Invention) | D | (33) | 0.7 | 0.22 | 0.68 | 10.7 |

[1]Degree of development inhibition resulted from the red-sensitive layer which was imagewise exposed to red light in place of the development inhibition resulting from the green-sensitive layer as in Example 1

[2]Relative addition amount ratio in moles taking the amount of C-10 as 1

From the results shown in Table 2-1, it can be seen that with Samples 206 to 208 wherein monodispersed Emulsion D ($S/\bar{r}=0.17$) is used in place of Emulsion A ($S/\bar{r}=0.34$) of Samples 201 to 203 which do not contain the DIR compounds according to the present invention, the RMS values are severely degraded while the MTF values are improved. On the contrary, in Samples 209 and 210 wherein the DIR compound according to the present invention and the monodispersed emulsion according to the present invention are used in combination, both the RMS values, the MTF values and $\Delta D_B$ are greatly improved as compared with those in Samples 206 to 208 containing DIR compounds other than those according to the present invention.

The chemical structures or chemical names of the compounds employed for preparing the samples as described Examples 1 and 2 are shown below:

U-1

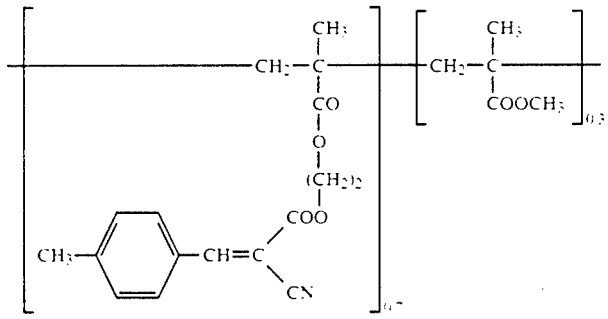

C-1

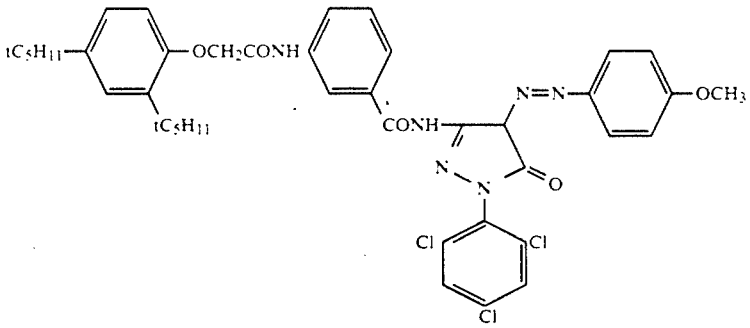

U-2

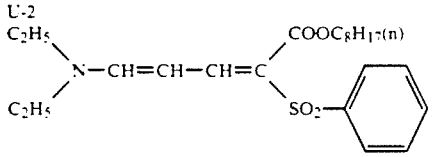

-continued
C-2
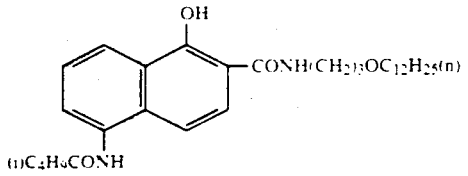
C-3
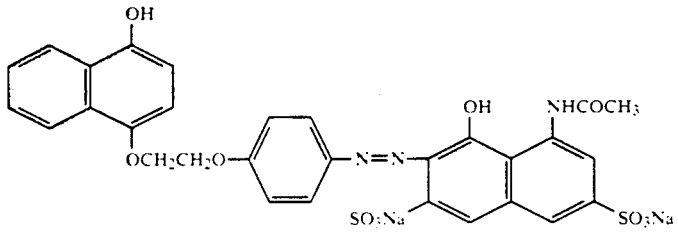
C-4
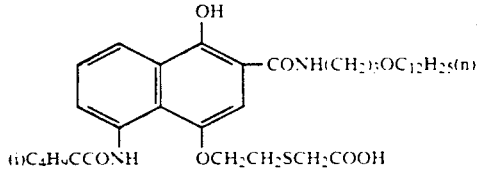
C-5
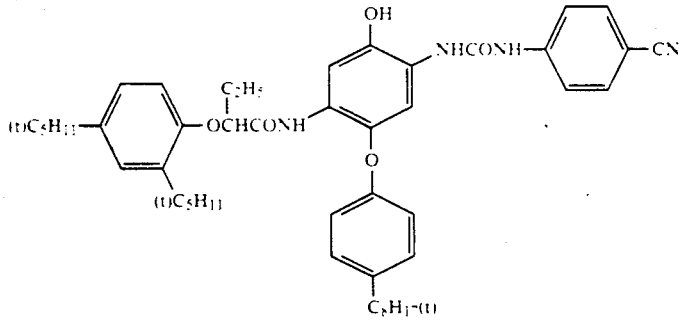
C-6
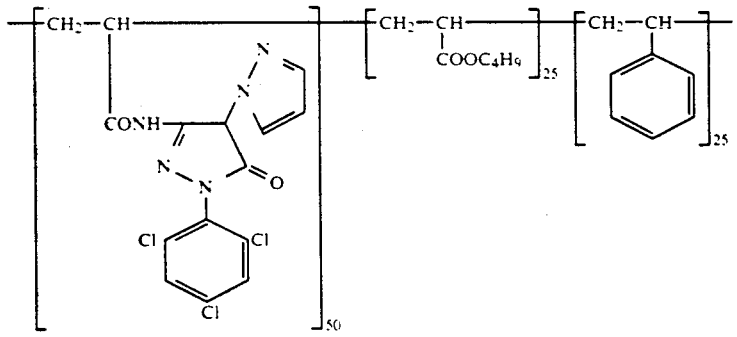
Average molecular weight: 30,000

-continued
C-7
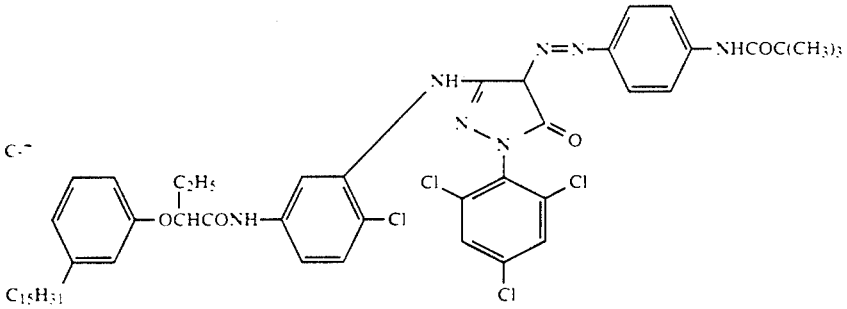
C-8 (described in U.S. Pat. No. 4,477,563)
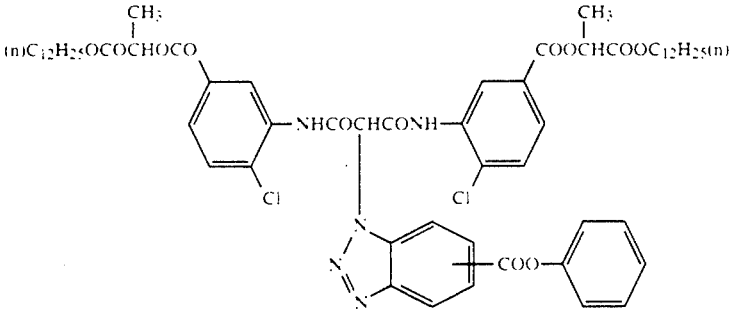
C-9
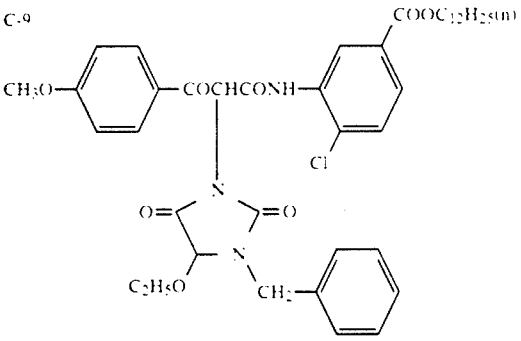
C-10 (described in U.S. Pat. No. 4,477,563)
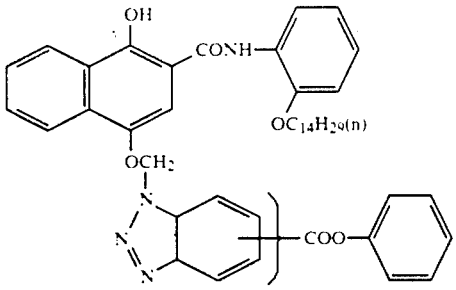
S-1
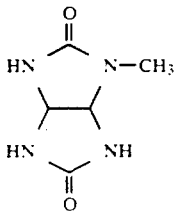

-continued
S-2
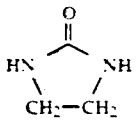
HBS-1: Tricresylphosphate
HBS-2: Dibutylphthalate
HBS-3: Tri-n-hexylphosphate
H-1
$CH_2{=}CH{-}SO_2{-}CH_2CONH{-}CH_2$
$CH_2{=}CH{-}SO_2{-}CH_2{-}CONH{-}CH_2$
Sensitizing Dyes
I
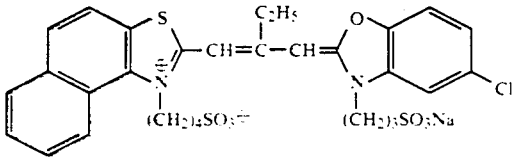
II
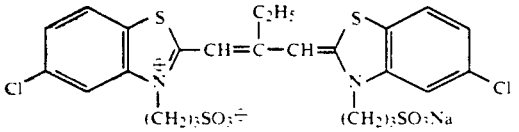
III
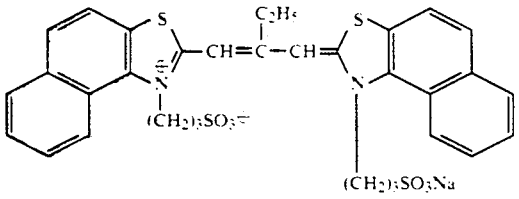
IV
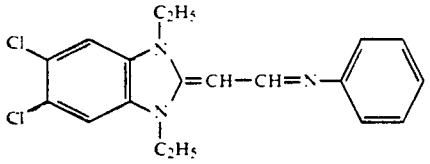
V
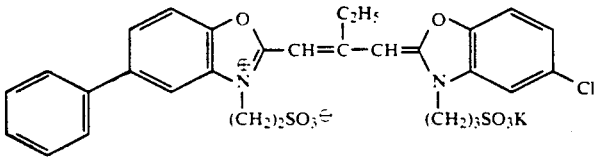
VI
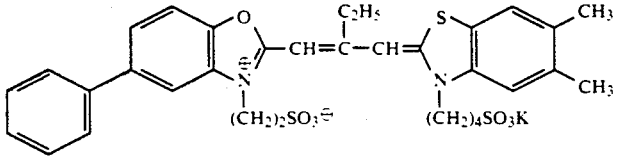

-continued
VII
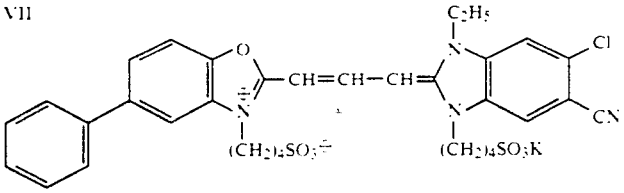
VIII
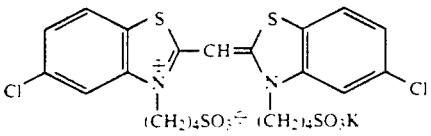
IX
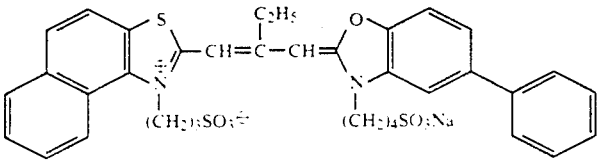
X
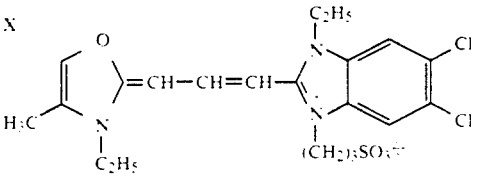
C-11 (described in U.S. Pat. No. 3,227,554)
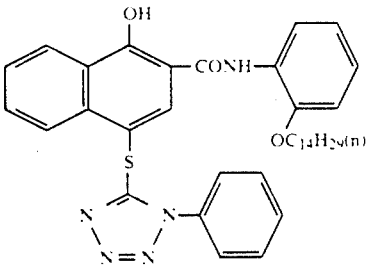
C-12
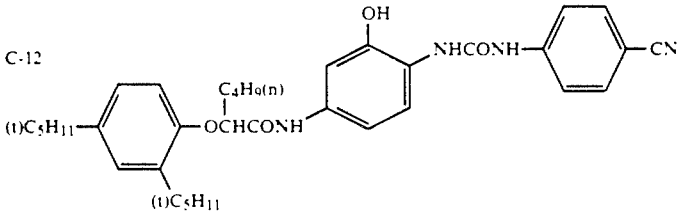
C-13
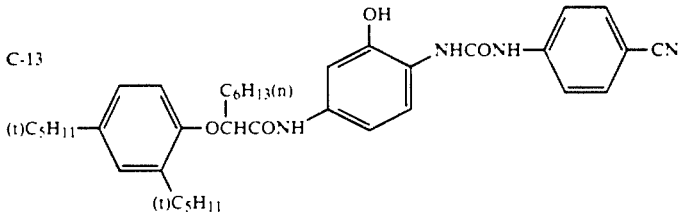

-continued

C-14

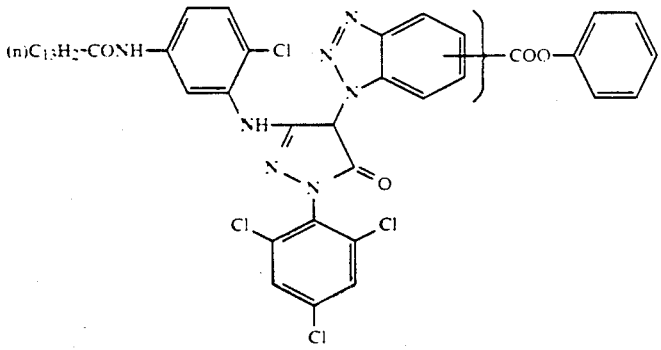

C-15 (described in Japanese Patent Application (OPI) No. 154234/82)

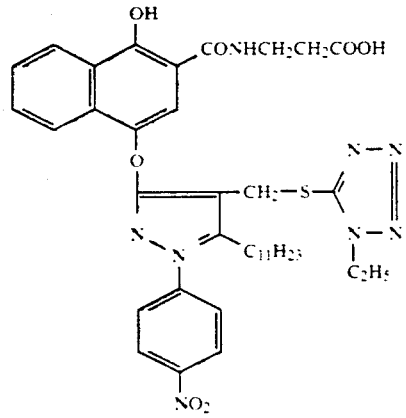

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer, wherein the light-sensitive silver halide emulsion layer contains at least one monodispersed emulsion having a particle size distribution such that a coefficient of variation with respect to a particle diameter of silver halide grains, $S/\bar{r}$, where S represents a standard deviation with respect to a particle diameter and $\bar{r}$ represents an average particle diameter, is not more than about 0.25, and said monodispersed emulsion comprises silver halide grains having a 2-layered structure comprising an inner core portion wherein the silver iodide content is from about 10 to about 45 mol% and an outer shell portions having a silver iodide content of not more than about 2 mol%, and (b) comprising not less than about 60 mol% of silver bromide, and not more than about 10 mol% of silver chloride, and the silver halide color photographic material contains at least one primary compound which releases, upon a reaction with an oxidation product of a developing agent, a secondary compound which releases a development inhibitor upon a reaction with another molecule of an oxidation product of a developing agent.

2. A silver halide color photographic material as claimed in claim 1, wherein said coefficient of variation $S/\bar{r}$ is not ore than 0.20.

3. A silver halide color photographic material as claimed in claim 2, wherein said coefficient of variation $S/\bar{r}$ is not more than 0.15.

4. A silver halide color photographic material as claimed in claim 1, wherein silver is present in the outer shell portion and inner core portion at a silver ratio of the outer shell portion to the inner core portion of form 1/5 to about 5.

5. A silver halide color photographic material as claimed in claim 1, wherein the primary compound is represented by the following general formula (I):

$$A—PDI \quad (I)$$

wherein A represents a group capable of releasing PDI upon a reaction which an oxidation product of a developing agent; and PDI represents said secondary compound which releases a development inhibitor through a reaction with an oxidation product of a developing agent after being released from A.

6. A silver halide color photographic material as claimed in claim 1, wherein the primary compound is represented by the following general formula (II):

$$A—(L_1)_t—B—(L_2)_u—DI \quad (II)$$

wherein A represents a group which releases $(L_1)_v$—B—$(L_2)_w$—DI after being released from A; $L_1$ represents a group which releases B—$(L_2)_w$—DI after being released from A; B represents a group which releases $(L_2)_w$—DI upon a reaction with an oxidation product of a developing agent after being released from A—$(L_1)_v$; $L_2$ represents a group which releases DI after being released from B; DI represents a development inhibitor; and v and w each represents 0 or 1.

7. A silver halide color photographic material as claimed in claim 6, wherein A represents a coupler residue or an oxidation reduction group.

8. A silver halide color photographic material as claimed in claim 7, wherein the coupler residue is a yellow coupler residue, a magenta coupler residue, a cyan coupler residue or a non-color forming coupler residue.

9. A silver halide color photographic material as claimed in claim 8, wherein the coupler residue is selected from an open-chain ketomethylene type coupler residue, a 5-pyrazolone type coupler residue, a pyrazoloimidazole type coupler residue, a pyrazolotriazole type coupler residue, a phenol type coupler residue, a naphthol type coupler residue, an indanone type coupler residue and an acetophenone type coupler residue.

10. A silver halide color photographic material as claimed in claim 7, wherein the oxidation reduction group is represented by the following general formula (III):

$$A_1—P—(X=Y)_n—Q—A_2 \qquad (III)$$

wherein P and Q, which may be the same or different, each represents an oxygen atom or a substituted or unsubstituted imino group; one of X and Y represents methine group having a group of —$(L_1)_v$—B$(L_2)_w$—DI as a substituent, and the other of X and Y represents asubstituted or unsubstituted methine group or a nitorgen atom; n represents an integer from 1 to 3; if n is 2 or 3, X and Y may be the same as or different from X and Y defined above, respectively, $A_1$ and $A_2$, which maybe the same or different, each represents a hydrogen atom or a group capable of being removed upon reaction with an alkali; and any two of substituents of P, X, Y, Q, $A_1$ and $A_2$ may be dilvanet groups and connected with each other to form a cyclic structure.

11. A silver halide color photographic material as claimed in claim 6, wherein B represents a group forming a coupler after being released from A—$(L_1)_v$— or a group forming an oxidation reduction group after being released from A—$(L_1)_v$.

12. A silver halide color photographic material as claimed in claim 6, wherein DI is selected from a tetrazolylthio group, a benzimidazolylthio group, a benzothiazolylthio group, a benzoxazolylthio group, a benzotriazolyl group, a benzindazolyl group, a triazolylthio group, an imidazolylthio group, a thiadiazolylthio group, a thioether-substituted triazolyl group and an oxadiazolyl group, each of which may be substituted by one or more substituents.

13. A silver halide color photographic material as claimed in claim 1, wherein the primary compound is incorporated into a light-sensitive silver halide emulsion layer or a layer adjacent to said emulsion layer.

14. A silver halide color photographic material as claimed in claim 1, wherein the primary compound is present in an amount of from about $1\times10^{-6}$ to about $1\times10^{-}$ mol/m$^2$.

15. A silver halide color photographic material as claimed in claim 14, wherein the primary compound is present in an amount of from $3\times10^{-6}$ to $5\times10^{-4}$ mol/m$^2$.

16. A silver halide color photographic material as claimed in claim 15, wherein the primary compound is present in an amount of from $1\times10^{-5}$ to $2\times10^{-4}$ mol/m$^2$.

17. A silver halide color photographic material as claimed in claim 1, wherein the monodispersed emulsion comprises silver halide grains comprising from about 2 to about 40 mol% of silver iodide.

* * * * *